US005967223A

United States Patent [19]

Kagan et al.

[11] Patent Number: 5,967,223

[45] Date of Patent: Oct. 19, 1999

[54] PERMANENT-MAGNETIC HYDRODYNAMIC METHODS AND APPARATUS FOR STABILIZING A CASTING BELT IN A CONTINUOUS METAL-CASTING MACHINE

[75] Inventors: Valery G. Kagan; R. William Hazelett, both of Colchester, Vt.

[73] Assignee: Hazelett Strip-Casting Corporation, Colchester, Vt.

[21] Appl. No.: 08/885,092

[22] Filed: Jun. 30, 1997

Related U.S. Application Data

[63] Continuation of application No. 08/677,953, Jul. 10, 1996, abandoned.

[51] Int. Cl.[6] ..... B22D 11/06; B22D 11/124

[52] U.S. Cl. ..... 164/481; 164/485; 164/502; 164/443; 164/431; 164/466

[58] Field of Search ..... 164/481, 482, 164/485, 431, 432, 433, 434, 466, 502, 423, 463

[56] References Cited

U.S. PATENT DOCUMENTS

| | | | |
|---|---|---|---|
| 2,640,235 | 6/1953 | Hazelett . | |
| 3,036,348 | 5/1962 | Hazelett et al. . | |
| 3,933,193 | 1/1976 | Baker et al. | 164/146 |
| 3,937,270 | 2/1976 | Hazelett et al. | 164/50 |
| 4,002,197 | 1/1977 | Hazelett et al. | 164/250 |
| 4,061,177 | 12/1977 | Sivilotti | 164/87 |
| 4,061,178 | 12/1977 | Sivilotti et al. | 164/87 |
| 4,062,235 | 12/1977 | Hazelett et al. | 73/159 |
| 4,082,101 | 4/1978 | Hazelett et al. | 134/127 |
| 4,190,103 | 2/1980 | Sivilotti et al. | 165/120 |
| 4,193,440 | 3/1980 | Thorburn et al. | 164/432 |

(List continued on next page.)

FOREIGN PATENT DOCUMENTS

| | | | |
|---|---|---|---|
| 2709540 | 9/1978 | Germany | B22D 11/06 |
| 2729339 | 1/1979 | Germany | B22D 11/06 |
| 2729425 | 1/1979 | Germany | B22D 11/06 |
| 2729431 | 1/1979 | Germany | B22D 11/06 |
| 59-153551 | 9/1984 | Japan | 164/502 |

OTHER PUBLICATIONS

Malcolm McCaig, *Permanent Magnets in Theory and Practice* (New York: John Wiley & Sons, 1977) Title Page (front and back); Dedication (one page); pp. 1–9; 122–125; 194–199; 208–213.

*Primary Examiner*—Harold Pyon
*Assistant Examiner*—I.-H. Lin
*Attorney, Agent, or Firm*—G. Kendall Parmelee; Parmelee & Bollinger, LLP

[57] ABSTRACT

Permanent-magnetic hydrodynamic methods and apparatus stabilize a moving, flexible, thin-gauge, heat-conducting, magnetically soft ferromagnetic casting belt against thermal distortion while moving along a mold cavity being heated at its front surface by heat coming from molten metal being cast while being cooled at its reverse surface by flowing pumped liquid coolant. Hydro-magnetic devices are arranged in an array wherein flows of pumped coolant pass through fixedly throttling passageways feeding pressure pockets facing the belt's reverse surface. These pockets are shown rimmed by magnetic pole faces. Coolant issues from the pressure pockets as fast-moving films radiating therefrom and travelling in gaps between the belt's reverse surface and the pole faces. These films cool the belt and apply hydrodynamic forces levitating the belt spaced from the pole faces while the belt is stabilized in even condition by powerful reach-out magnetic attraction forces reaching out from these pole faces and extending across the gaps to the moving belt. Pumped liquid coolant is twice throttled: once in feeding into the pressure pockets and once again in flowing out from the pockets escaping over the pole faces which rim the pockets. A hydro-magnetic array includes powerful permanent magnets formed of unique permanent-magnetic material in magnetic circuits in the array providing reach-out magnetic attraction having unusual characteristics critical to successful operation of disclosed embodiments of the invention. A hydro-pillow array without magnets may be positioned downstream from the hydro-magnetic array.

62 Claims, 26 Drawing Sheets

U.S. PATENT DOCUMENTS

| | | | |
|---|---|---|---|
| 4,552,201 | 11/1985 | Wood | 164/481 |
| 4,601,326 | 7/1986 | Zingler | 164/502 |
| 4,658,883 | 4/1987 | Hazelett et al. | 164/432 |
| 4,671,341 | 6/1987 | Wood | 164/432 |
| 4,674,558 | 6/1987 | Hazelett et al. | 164/481 |
| 4,749,027 | 6/1988 | Allyn et al. | 164/455 |
| 4,825,935 | 5/1989 | Tozawa et al. | 164/481 |
| 4,901,785 | 2/1990 | Dykes et al. | 164/481 |
| 5,728,036 | 3/1998 | Kagan et al. | 164/502 |

AVERAGE PRESSURE ON BELT, PSI
20
16
12
8
4
0
MM
IN.
0
.2
.008
.4
.016
.6
.024
.8
.032
1
.040
1.5
.060
GAP SPACING 75
MAGNETS 32 (MINUS)
ALNICO 5 (MINUS)
COOLANT (PLUS)
REACH-OUT PULL
PUSH
230
240
242
250
252

FIG. 7A"
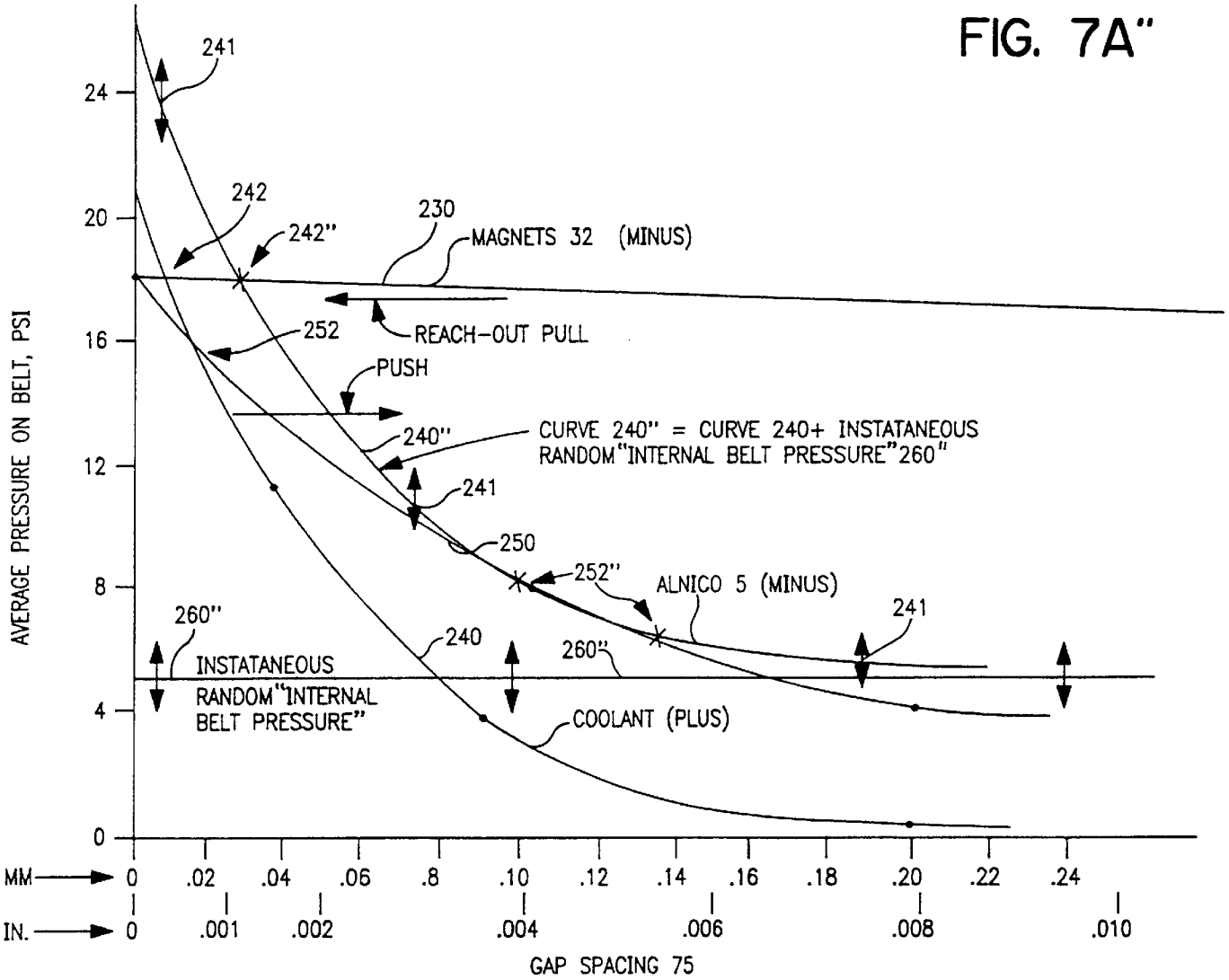

XII
N
C
S
75
50
102
90
34
66
162'
145
147
N'
156
51
146
149
153
154
92
39
155
151
152
162
161
158
S'
96
163
166
167
160
165
98
164
100

"OFF"

"ON"

PERMANENT-MAGNETIC HYDRODYNAMIC METHODS AND APPARATUS FOR STABILIZING A CASTING BELT IN A CONTINUOUS METAL-CASTING MACHINE

CROSS-REFERENCE TO RELATED APPLICATION

This application is a continuation of application Ser. No. 08/677,933, filed Jul. 10, 1996 and now abandoned.

FIELD OF THE INVENTION

The present invention is in the field of continuous casting of molten metal by pouring it into belt-type casting machines using one or more endless, flexible, moving heat-conducting casting belts, e.g., metallic casting belts, for defining a moving mold cavity or mold space along which the belt or belts are continuously moving with successive areas of each belt entering the mold cavity, moving along the mold cavity and subsequently leaving the moving mold cavity. The product of such continuous casting is normally a continuous slab, plate, sheet or strip or a generally rectangular continuous bar.

More particularly this invention relates to permanent-magnetic hydrodynamic methods and apparatus for stabilizing a moving, flexible, thin-gauge, heat-conducting, magnetically soft ferromagnetic casting belt against thermal distortion while it is moving along the mold cavity being heated at its front surface by heat coming from molten metal while being cooled at its reverse surface by flowing pumped liquid coolant.

BACKGROUND OF THE INVENTION

During the continuous casting of molten metal in a machine using at least one moving, flexible, thin-gauge, heat-conducting casting belt, e.g., a metallic casting belt, it is vitally important that the moving belt remain travelling along a predetermined desired path requiring substantial evenness or flatness of the belt itself despite the presence of hot metal and resultant thermal stresses induced in the belt by intense heat from hot metal entering its front surface while its reverse surface is being cooled by suitable liquid coolant. The continuous casting of molten metals in a machine using at least one such casting belt often has been affected by thermally-induced warping, buckling, fluting or wrinkling (herein called "distortions") of the casting belt. Hazelett et al. in U.S. Pat. Nos. 3,937,270; 4,002,197; 4,062,235; and 4,082,101 in FIG. 8 of each Patent and Allyn et al. in FIG. 5 of U.S. Pat. No. 4,749,027 illustrate thermally-induced transverse bucking and fluting occurring in such a casting belt. Thermally-induced warping or wrinkling also has occurred in such belts. These belt distortions can occur quite suddenly, like a sudden popping of a lid on an evacuated container when the lid initially is opened and air rushes into the container. Moreover, these distortions can be erratic and unpredictable as to their extent and their particular locations in a casting belt which is intended to be even, without distortions, as it moves along the mold cavity.

Such thermally-induced distortions are more likely to occur near an input region of the mold cavity where the moving casting belt first experiences intense heating effects of hot molten metal introduced into or soon after its introduction into the moving mold cavity. Near the input region initial freezing of molten metal is occurring or commencing, and belt distortions during such freezing may result in a cast product containing slivers, stains or segregation of alloying constituents. In turn, these defects in the cast product lead to problems of strength, formability, and appearance.

C. W. Hazelett in U.S. Pat. No. 2,640,235 (in Column 7) described upper and lower cooling assemblies for upper and lower chilling bands. These cooling assemblies were identical in operation, and each cooling assembly comprised a plate that may be of some suitable readily magnetized material which formed the soft core of an electromagnet. It was the function of a plate when rendered magnetic by flow of current to pull a band toward itself. To prevent this movement of the band toward the plate, copper or brass spacers were utilized, these spacers allowing a formation of chambers between the band and the plate. In these chambers cooling water was introduced to chill the band. Even though this cooling water was introduced at considerable pressure, and sufficient normally to distort the band, the specification stated it will not do so because of the influence of the magnetic plate holding the band firmly against the rigid spacers. In this way, the specification stated, it is possible to cool the band while guiding it and holding it against distortion, and thereby maintaining accurate gauge of the product.

William Baker et al. in U.S. Pat. No. 3,933,193 disclosed apparatus for continuous casting of metal strip between moving belts. The belts were held against closely spaced support surfaces by means of externally applied attractive forces achieved by sub-atmospheric pressure conditions on the reverse side of the belts or magnetic forces employed for the same purpose.

Olivio Sivilotti et al. in U.S. Pat. No. 4,190,103 (in Column 2, lines 38–44) stated: "Thus in a practical embodiment of the above-mentioned apparatus, the belt has been drawn against the faces of the closely spaced supports by subatmospheric pressure in the water-filled housing. An alternative arrangement was to provide magnetic means, acting through ferromagnetic supports on a ferromagnetic belt, to hold the belt in the desired path."

The assignee of the present invention, Hazelett Strip-Casting Corporation, experimentally has tried stationary electromagnetic belt-backup finned platens in sliding contact with the reverse surfaces of moving casting belts but without performance which was satisfactory enough to justify their continuance in view of excessive wear and friction. Moreover, these electromagnetic finned platens failed to reliably retain or stabilize the moving casting belt in flat condition.

SUMMARY OF THE DISCLOSURE

We have discovered that magnetic devices as described by C. W. Hazelett, Sivilotti et al., or Baker et al. in the foregoing patents did not come into industrial use in continuous casting of molten metal, because their magnetic attraction forces, i.e., pull exerted on the belt or band, diminished too rapidly and/or too abruptly as a function of spacings (gaps) between the casting belt or band and the magnetic devices which were intended to pull thermally distorted portions of the moving belt or band back toward themselves into a predetermined desired even condition. The magnetic attraction (pull) of these prior devices on a casting belt or band did not reach out across significant gaps and therefore did not suitably pull back portions of a belt or band which became significantly displaced from a desired even condition due to thermally-induced distortions. There was a failure or lack in what we call "reach-out attraction force", i.e., a failure or lack in "reach-out pull".

There was no disclosure nor suggestion by Baker et al. of the critical importance we have discovered in what we call "reach-out attraction forces" (i.e., "reach-out pull").

In our invention, this reach-out pull is provided by the unique permanent-magnetic materials described herein arranged in magnetic circuits as described for reaching out across spacings (gaps) between pole faces of the magnetic circuits and a moving, flexible, thin-gauge, heat-conducting casting belt of magnetically soft ferromagnetic material for pulling thermally distorting portions of the belt toward the pole faces for keeping the belt held within close limits in a predetermined desired stabilized even condition where it is supported by hydrodynamic forces provided by flows of pumped coolant as explained later such that the stabilized belt is moving along its predetermined path while hovering in stabilized even condition levitated by hydrodynamic repulsive forces exerted by pumped liquid coolant and fast-travelling coolant films, and the belt is not sliding nor wearing against stationary objects but moves along water films substantially without friction.

In preferred embodiments of the invention we include a plurality of hydro-magnetic devices arranged in arrays wherein flows of pumped liquid coolant pass through fixedly throttling passageways leading into pressure pockets acting as throttling nozzles facing the casting belt's reverse surface. These coolant flows are issued from these throttling nozzles which are adjacent to or are rimmed by the magnetic pole faces for exerting repulsive forces against the reverse surface of the belt with coolant escaping (ejecting) from the pressure pockets in the form of fast-moving films of liquid coolant radiating from the pressure pockets and travelling in the gaps between the reverse surface of the moving casting belt and the magnetic pole faces. These fast-moving films cool the belt and apply hydrodynamic forces which push against the reverse surface of the moving belt for supporting the belt and for keeping the belt spaced (levitated) slightly away from these coolant-ejection pole faces while the belt is stabilized in even condition by powerful reach-out magnetic attraction forces (pull) reaching out from these pole faces and extending across the gaps to the moving belt. Thus, the pumped liquid coolant is twice throttled. It is throttled once as it passes through the fixedly throttling passageways feeding into the pressure pockets facing the belt. It is throttled once again as it flows out from these pressure pockets and escapes over the magnetic pole faces which rim the pressure pockets. In effect the coolant is being ejected from these pressure pockets in the form of fast-travelling coolant films passing through gaps between the belt and the magnetic pole faces which rim the pressure pockets and are acting like coolant-ejection faces.

The hydro-magnetic devices in these arrays include powerful permanent magnets formed of unique permanent-magnetic material. These magnets positioned in magnetic circuits in each array provide reach-out magnetic attraction forces having unusual characteristics which we believe are critical to successful operation of the disclosed embodiments of the invention. The unusual very powerful magnetomotive force provided by such permanent magnets (which have a very high maximum energy product expressed in Mega-Gauss-Oersteds) is not the sole reason in our view for their successful operation in magnetic circuits employed in these arrays or "pillows" of hydro-magnetic devices. Another characteristic which we believe is critical for their successful operation is their very low demagnetizing permeability which is so low it is of the same order of magnitude as that of air or water or vacuum. This very low demagnetizing permeability enables pole faces and poles of magnetic circuits as disclosed to exert very powerful magnetic attraction forces (pulling forces) on a moving, flexible, thin-gauge, heat-conducting casting belt containing magnetically soft ferromagnetic material with such attraction forces extending out (reaching out) relatively far away from the pole faces and extending across gaps (spacings) between the pole faces and the moving casting belt with air and/or water filling these spacings. These magnets in their magnetic circuits provide an array of coplanar magnetic pole faces of alternate North and South polarity facing toward the reverse surface of a moving, flexible, thin-gauge, heat-conducting casting belt containing magnetically soft ferromagnetic material.

In preferred embodiments of the invention, we are utilizing the inherently variable repulsive (pushing) forces of the pumped coolant which issues from throttling nozzles in the hydro-magnetic devices and provides fast-travelling coolant films passing over magnetic pole faces and acting against the reverse surface of the moving belt. These repulsive forces diminish relatively rapidly as a function of increasing spacing (increasing gap) between the reverse surface of the belt and a magnetic pole face over which the fast-travelling coolant films are flowing. These repulsive forces are balanced against the reach-out attraction force (pull) exerted on the moving belt by the pole face in the same location, which attraction force diminishes relatively more slowly as a function of such increasing spacing. Advantageous interaction of a rapidly diminishing repulsive effect balanced against a relatively more slowly diminishing reach-out magnetic pull causes the moving casting belt to hover, being reliably stabilized within close limits by the balancing of pull/push forces. Thus, the moving belt hovers forcibly stabilized in even condition supported (levitated) upon throttled pumped coolant in pressure pockets and thin escaping films of fast-moving liquid coolant travelling in the spaces between the reverse surface of the casting belt and the pole faces.

Within these hydro-magnetic devices are incorporated specially devised sweep nozzles for delivering additional coolant applied to the belt at an acute angle to result in a sheet of fast-moving coolant flowing in one direction along the reverse surface of the belt providing additional cooling as well as diverting, redirecting and finally sweeping away the fast travelling coolant films which have passed over the magnetic pole faces.

Thus, the moving belt is stabilized with predetermined desired evenness or flatness by balancing this reach-out pull against hydrodynamic forces of pumped liquid coolant issuing from throttling nozzles in the hydro-magnetic devices and exerting a push against the reverse surface of the moving belt at locations closely adjacent to the magnetic pole faces for keeping the moving belt stabilized in a hovering (levitated) relationship spaced away from contact with the pole faces.

This powerful reach-out attraction force (pull) on a thin-gauge belt of magnetically soft ferromagnetic material is unlike the behavior of magnets made of traditional materials, even alnico 5, which materials lose much of their attraction force or pull when significant gaps, for example such as gaps of 1.5 mm (0.060 of an inch) occur in magnetic circuits such as shown and described.

We envision that any permanent magnetic material is capable of successful performance in embodiments of the invention, if such material is capable of being mounted as permanent magnets in magnetic circuits including magnetically soft ferromagnetic material providing an array of magnetic poles of opposite polarity having pole faces faceable toward the reverse surface of a moving casting belt with such pole faces being immediately adjacent to throttling nozzles (for example with such pole faces rimming or encircling the throttling nozzles), such nozzles being faceable toward the reverse surface of the casting belt and wherein such pole faces and pole members are capable of exerting reach-out magnetic attraction forces (pull) on a moving, flexible, thin-gauge, heat-conducting casting belt containing magnetically soft ferromagnetic material wherein this reach-out magnetic attraction is sufficiently powerful at an initial value at the pole faces and wherein this reach-out magnetic attraction exerted on the casting belt near the arrays diminishes from its initial value sufficiently slowly as a function of increasing spacing up to 1.5 mm (0.060 of an inch) gap between the portion of the belt and the pole faces so that the belt is forcibly held stabilized within suitable narrow limits of flatness and gap spacing while being hydrodynamically levitated away from the pole faces on pumped coolant flows issuing from the throttling nozzles and being ejected from pressure pockets in the throttling nozzles as fast-travelling thin films flowing across the pole faces in the gaps between the pole faces and the reverse surface of the belt.

Rotating devices may be provided for rotating the permanent magnets in order to reduce, whenever desired, their powerful reach-out pull on the belt, with sufficient reduction in pull to permit installing and removing wide thin-gauge flexible casting belts without damage to them. Alternatively, magnetic flux from the powerful magnets may be shunted away from the casting belt by a suitably movable shunt to reduce pull on the belt sufficiently to permit appropriate handling of the belt.

The present invention successfully addresses or substantially overcomes or substantially reduces the above-mentioned persistent problems caused by thermally induced distortions of a moving, endless, flexible, thin-gauge, heat-conducting casting belt in a continuous casting machine.

As used herein the term "thin-gauge" as applied to a heat-conducting casting belt formed predominantly of steel is intended to mean a casting belt having a thickness less than about one-tenth of an inch (about 2.5 mm) and usually less than about 0.070 of an inch (about 2.0 mm).

Magnetic permeability of magnetically soft ferromagnetic material is defined as B/H wherein "B" is magnetic flux density in Gauss in a material and "H" is magnetic coercive force in Oersteds applied to the material. As used herein, the term "magnetically soft ferromagnetic material" means a material which has a maximum magnetic permeability of at least about 500 times the magnetic permeability of air or water or vacuum, each of which has a magnetic permeability of about 1. For example, ordinary transformer steel has a maximum magnetic permeability of about 5,450 as measured at a magnetic flux density B of about 6,000 Gauss with a magnetic coercive force H of about 1.1 Oersted, stated on page E-115 of the *CRC Handbook of Chemistry and Physics,* 66th Edition, dated 1985–1986. The phrase "magnetically soft" as used in this term "magnetically soft ferromagnetic material" means that such material is relatively easily magnetized or demagnetized. Thus, the adjective "soft" is herein being used in contradistinction to the adjective "hard" which is applied to magnetic materials requiring a large coercive force to become magnetized or demagnetized such that they are difficult to magnetize and demagnetize. Ordinary transformer steel and also the quarter-hard-rolled low-carbon sheet steel usually employed in forming thin-gauge casting belts for use in twin-belt continuous casting machines are within the category of "magnetically soft ferromagnetic material".

In ASTM Designation: A 340-93, *Standard Terminology of Symbols and Definitions Relating to Magnetic Testing,* "residual induction, $B_r$" is defined "the value of magnetic induction corresponding to zero magnetizing field when the magnetic material is subjected to symmetrically cyclically magnetized conditions".

The permeability of a hard magnetic material is $\Delta B/\Delta H$ as measured in a useful portion of the demagnetization curve, which curve is in turn defined as that portion of the B—H hysteresis loop, i.e., the B—H loop or B—H curve, lying in the second (or fourth) quadrant of the normal hysteresis loop. "Normal hysteresis loop" is defined in the above ASTM Designation.

Other objects, aspects, features and advantages of the present invention will become understood from the following detailed description of the presently preferred embodiments considered in conjunction with the accompanying drawings, which are presented as illustrative and are not intended to limit the invention and which are not necessarily drawn to scale but rather are drawn for clarity of illustrating principles of the invention. In particular, the specification will proceed in terms of a twin-belt casting machine and usually in terms of the lower carriage of such a casting machine. Corresponding reference numbers are used to indicate like components or elements throughout the various Figures. Large outlined arrows point in a "downstream" direction relative to the longitudinal direction (upstream-downstream orientation) of the moving mold cavity or mold space, and thus they indicate the direction of freezing metal and product flow from entrance into the moving mold cavity or moving mold space to the exit therefrom. The direction of flow of liquid coolant is normally in the same direction as the freezing metal. Local flows of liquid coolant are shown by simple one-line arrows.

BRIEF DESCRIPTION OF THE DRAWINGS

FIG. 2 is a view as seen looking generally in the direction II—II in FIG. 3 and also in FIGS. 4 and 4A.

In FIG. 3, the casting belt and its pulley drums are omitted for clear illustration.

In FIG. 5, the three respective zones marked VA, VB and VC are the areas identified by the respective viewing lines VA—VA, VB—VB and VC—VC in FIG. 4A.

FIG. 7 illustrates pull/push balancing between: (i) the relatively slowly decreasing reach-out magnetic attraction forces which may be called inward pulling forces and (ii) the relatively rapidly decreasing repulsive hydrodynamic forces of the pumped liquid coolant and high-speed thin coolant films which may be called outward pushing forces. Also, for contrast and for clarity of explanation, the relatively rapid and undesirable decrease of attraction force provided by alnico 5 magnets is shown.

FIGS. 7A' and 7A" are included for purposes of explanation.

FIG. 12 is a section taken along XII—XII in FIG. 11.

FIG. 13 is an oblique view, as seen generally from the vantage point of FIG. 5, illustratively showing an array of hydro-magnetic devices positioned below a moving casting belt with a castellated bar of magnetically soft ferromagnetic material acting as a shunt and being shown in the "off" position (pole faces demagnetized).

FIG. 16 is analogous to FIG. 4A which shows the lower casting belt and lower nip pulley; whereas FIG. 16 shows the upper casting belt and upper nip pulley in cooperative association with the present alternative construction of an embodiment of the invention.

DETAILED DESCRIPTION OF THE PREFERRED EMBODIMENTS

The specification will proceed in relation to twin-belt casting machines, which typically have upper and lower carriages for revolving upper and lower casting belts. For convenience of illustration the description will relate to the lower carriage. In a twin-belt casting machine the pass line followed by the freezing metal is generally straight. In a single-belt machine (not described herein), the pass line may follow a slightly curved path. Also, in twin-belt machines the pass line may extend generally straight in a direction longitudinally of the machine while the belt may be slightly bowed in a direction transversely of the machine in a portion of the mold cavity. For all these cases, the pass line or its guides provided by the positions of the pole faces in an array may be referred to as a "coplanar array" or "even surface array".

Although an "even" belt may be moving along a pass line which follows a slightly curved path, the even belt may be considered to be in a flat condition when it is moving along the pass line with a desired evenness throughout the extent of the pass line, and also an even belt which is slightly bowed transversely at some portion of the pass line may be considered to be in a flat condition when it is moving along the pass line with a desired evenness throughout the extent of the pass line. An array of magnetic pole faces for guiding a moving casting belt along a pass line with a desired evenness may be called a "coplanar array" of magnetic pole faces or may be called an "even surface array".

Figure 1:
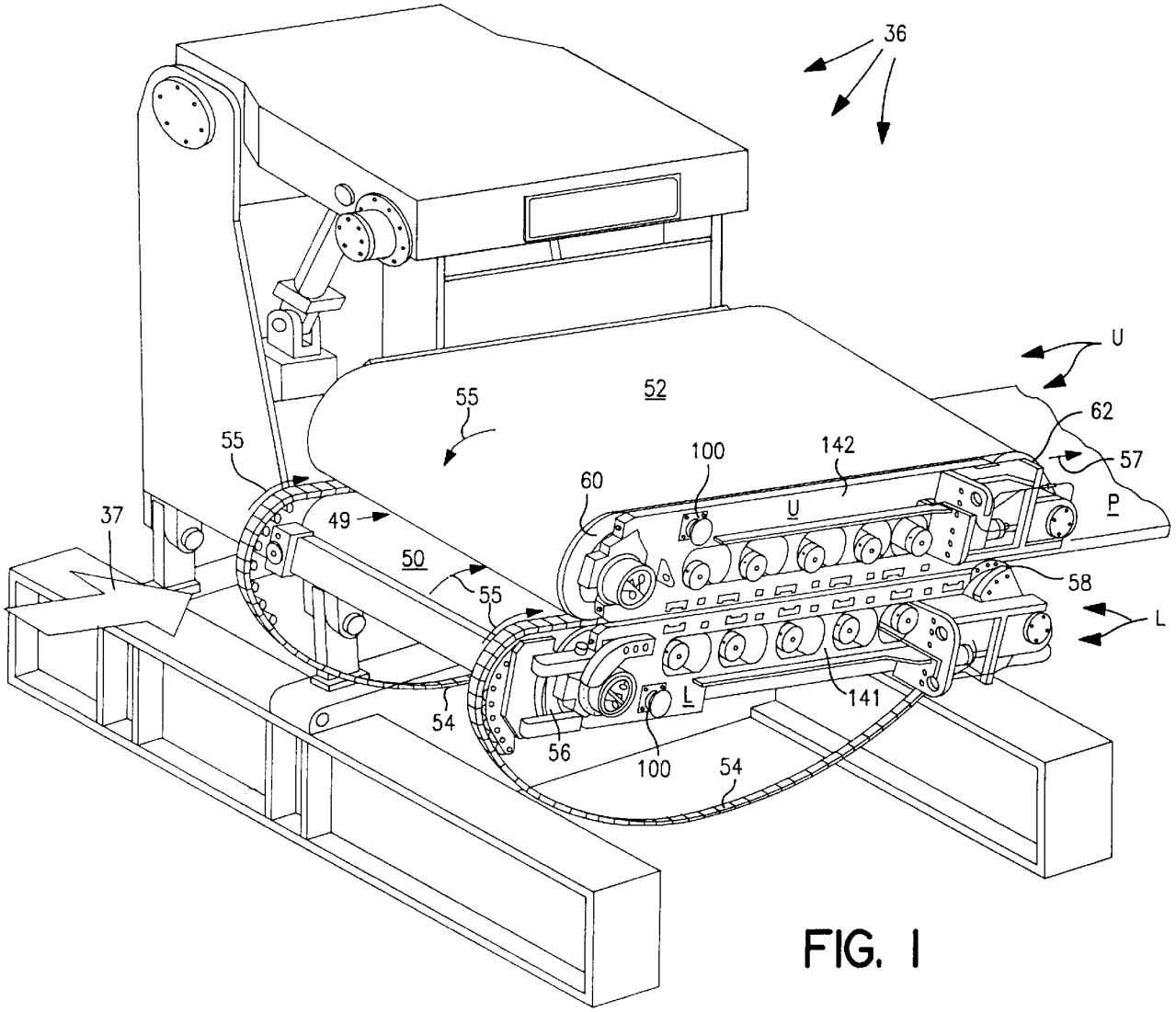
FIG. 1 is a perspective view of a twin-belt casting machine as seen looking from upstream, above, and from the outboard side. This machine is shown as an illustrative example of a relatively wide, moderately-thin-gauge-belt-type continuous metal-casting machine in which the present invention may be employed to advantage.

FIG. 1 is a view of a relatively wide twin-belt casting machine 36 as seen from upstream, above, and from the outboard side. The lower carriage is indicated at L and the upper carriage at U. Through molten-metal-feeding equipment (not shown) which is known in the art of continuous casting machines, molten metal is introduced into the entrance end 49 of the moving mold cavity or mold space C (FIGS. 4, 4A, 5, 6, 8, 9 and 10). This introduction of molten metal is schematically indicated by the large open arrow 37 shown at the left in FIG. 1. A continuously cast product P shown at the right in FIG. 1 emerges (arrow 57) from the exit end of moving mold cavity C.

The lower and upper sides of the moving mold cavity C are bounded by revolving lower and upper endless, flexible, thin-gauge, heat-conducting casting belts 50 and 52, respectively. These casting belts 50, 52 in preferred embodiments of this invention are fabricated from magnetically soft ferromagnetic material. For example, they are formed of metallic material such as quarter-hard-rolled low-carbon sheet steel. The front surfaces of the casting belts may be suitably treated as known in the art, for example by sand blasting and/or by coating them. The two lateral sides of the moving mold cavity C are bounded by two revolving block-chain edge dams 54 as known in the art. Lower belt 50 and block chains 54 revolve as shown by motion arrows 55 around a lower (nip) pulley 56 opposite the entrance (upstream) end 49 of the moving mold cavity and around a lower pulley 58 opposite the exit end of the moving mold cavity. Upper belt 52 revolves around an upper upstream (nip) pulley 60 and around an upper downstream pulley 62. The structure and operation of such twin-belt casting machines is well known in the art of belt-type casting machines. Further information if desired by the reader regarding such machines may be found in the herein referenced patents of Hazelett et al.

Figure 2:
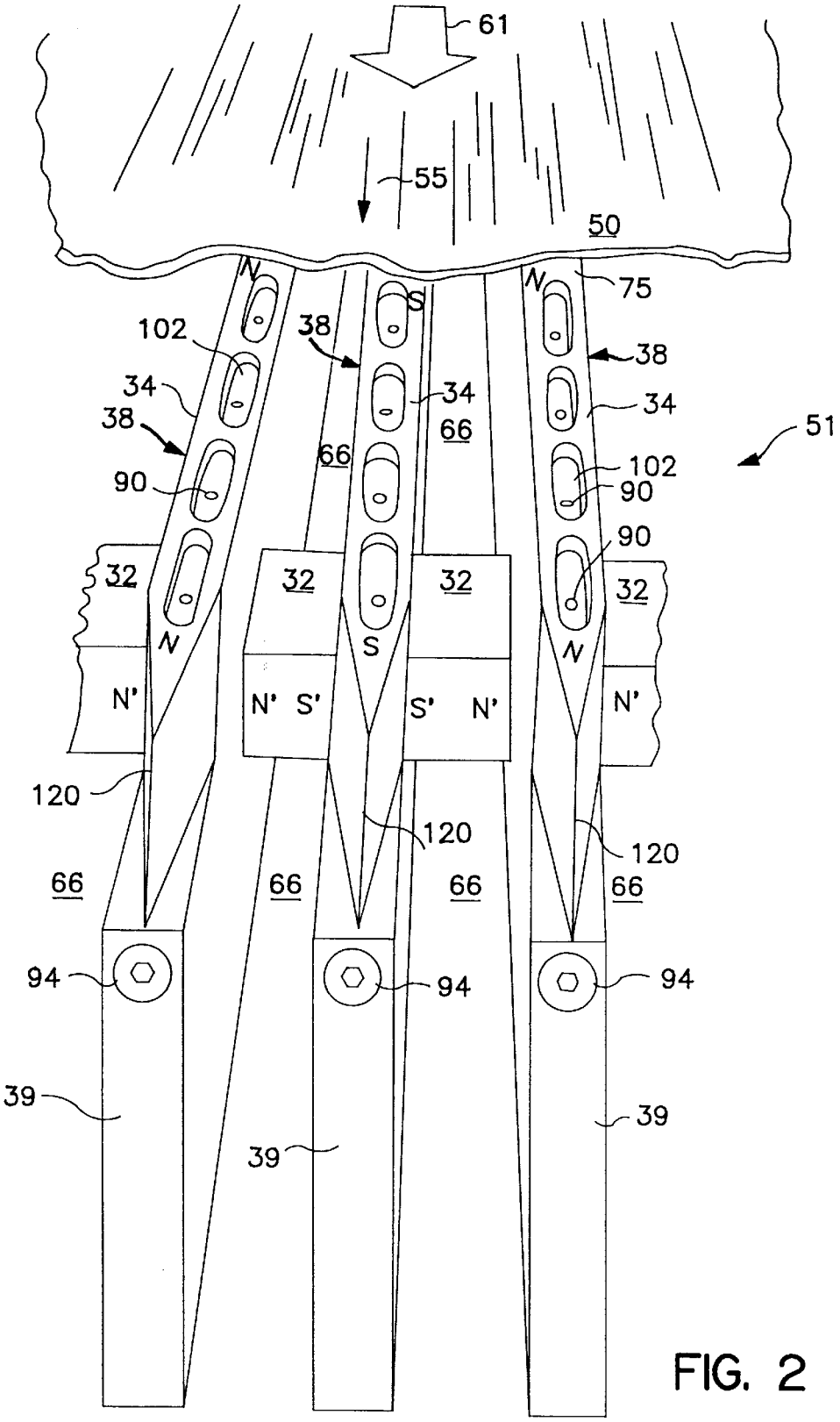
FIG. 2 is an enlarged partial perspective view showing an array of hydro-magnetic devices in an embodiment of this invention as positioned in the lower carriage and as seen from above and downstream. The moving flexible casting belt is partially shown broken away in FIG. 2 for clarity of illustration.
Figure 3:
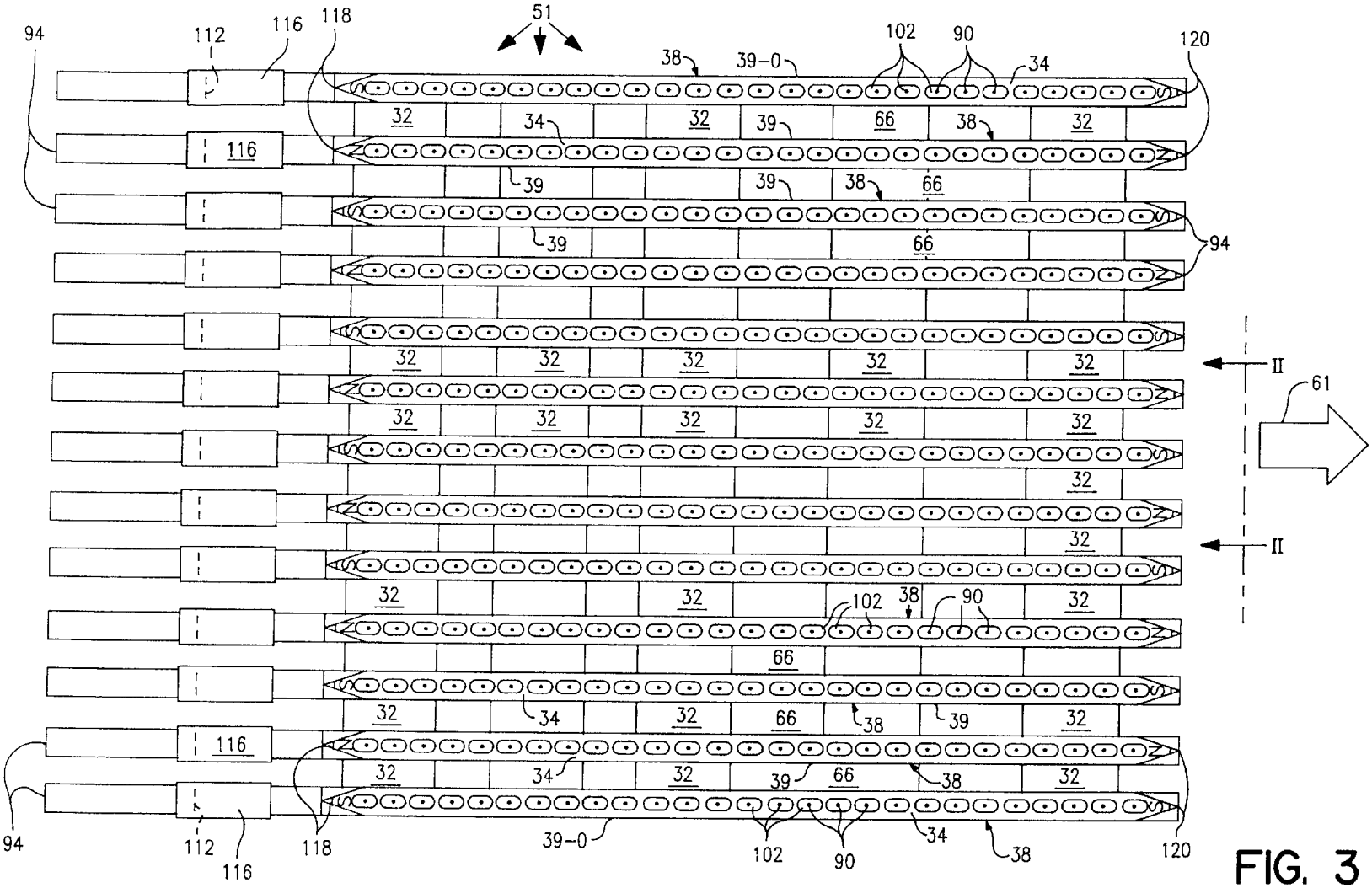
FIG. 3 is a top view of an array of the hydro-magnetic devices, three of which are shown in FIG. 2.
Figure 8:
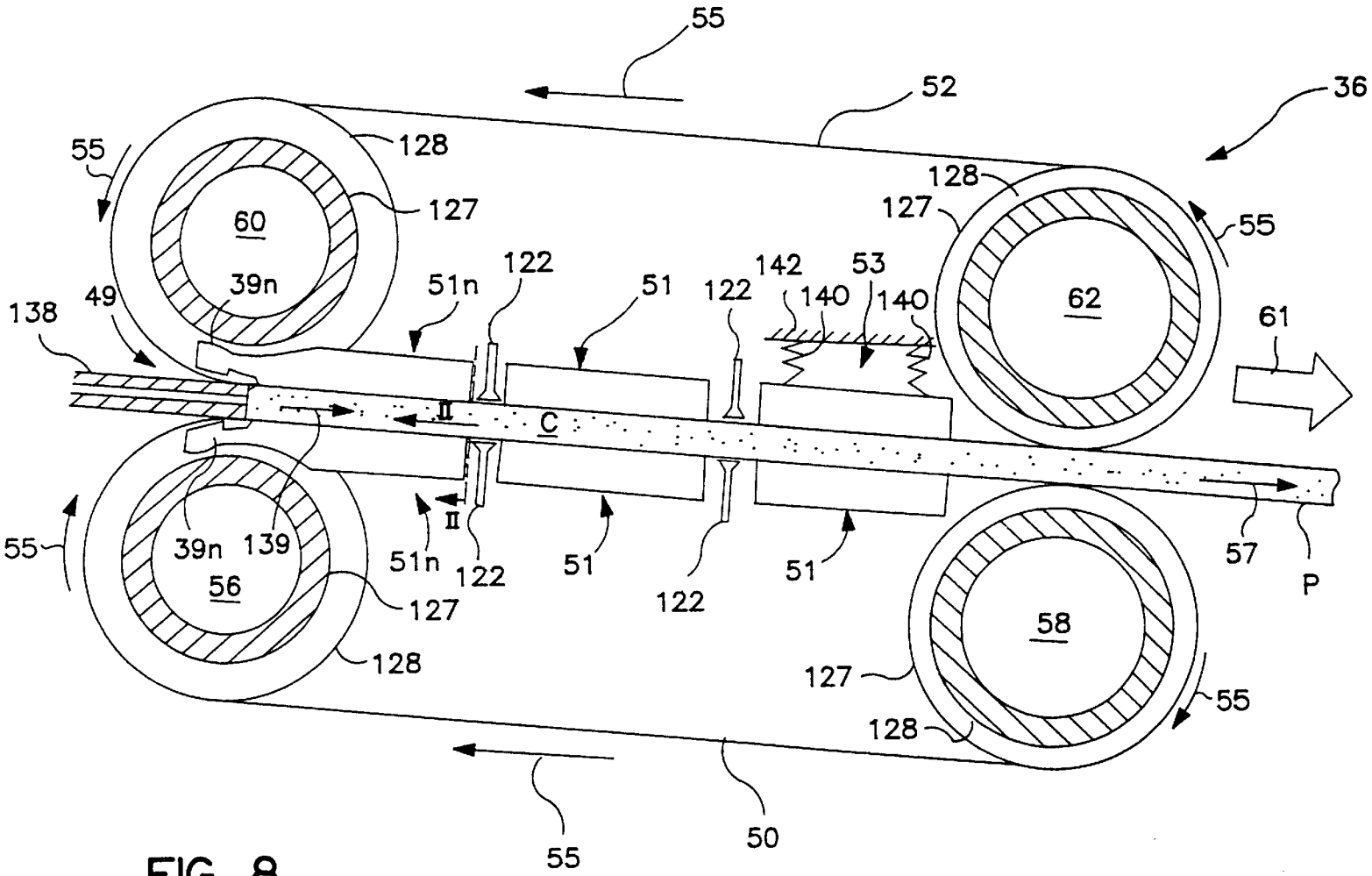
FIG. 8 is a longitudinal sectional elevation view as seen from the outboard side of the moving mold-cavity region of the carriages showing arrays of hydro-magnetic devices, that is hydro-magnetic pillows, positioned in respective places along the length of the moving mold cavity. One of these arrays of hydro-magnetic devices is shown flexibly mounted.

The viewpoint of FIG. 2 is indicated in FIGS. 3 and 8 by the dashed and dotted line II—II. The lower casting belt 50 is shown being guided by an array generally indicated at 51 of hydro-magnetic devices 38. The array 51 may be called a hydro-magnetic pillow. Each hydro-magnetic device includes a magnetic pole member 39 extending longitudinally with respect to the upstream-downstream direction (arrow 61) of the moving mold cavity C. In the array 51 these elongated pole members 39 are arranged in spaced parallel relationship. Their top surfaces are shown providing a coplanar array of magnetic pole faces 34. Between these elongated pole members 39 are defined elongated spaces 66 which are shown extending longitudinally with respect to the mold cavity.

The elongated pole members 39 are formed of magnetically soft ferromagnetic material, for example such as magnetically soft steel such as type 430 chromium stainless steel. The casting belt 50 moves in close proximity to the magnetic pole faces 34 being supported by hydrodynamic forces provided by pumped liquid coolant issuing from throttling nozzles as will be explained later.

In an array 51 of hydro-magnetic devices 38 we mount a multiplicity of relatively compact permanent magnets 32 having North and South magnetic polarities as indicated on each magnet in FIG. 2 at N' and S', respectively. These magnets are inter-posed into the elongated spaces 66 between successive spaced parallel elongated pole members 39 in the array 51. It is preferred that there be at least one of these permanent magnets 32 positioned in each space 66 so that in an overall array 51, as will be understood from FIGS. 3 and 5, each pole member 39 in an array (except as shown in FIG. 3 for the two outermost pole members 39-0 in the array) has a pair of same polarity permanent magnet poles facing toward its opposite sides. These pairs of same polarity permanent magnet poles have alternate North (N') and South (S') polarity across the array 51. Thus, for example as seen in FIG. 2, the pole member 39 at the left has a pair of North polarity permanent magnet poles N' facing toward its opposite sides. The next successive pole member 39 seen at the center in FIG. 2 has a pair of South polarity permanent magnet poles S' facing toward its opposite sides. Then, the next successive pole member 39 seen at the right in FIG. 2 has a pair of North polarity permanent magnet poles N' facing toward its opposite sides, and so forth across the array 51.

Figure 5:
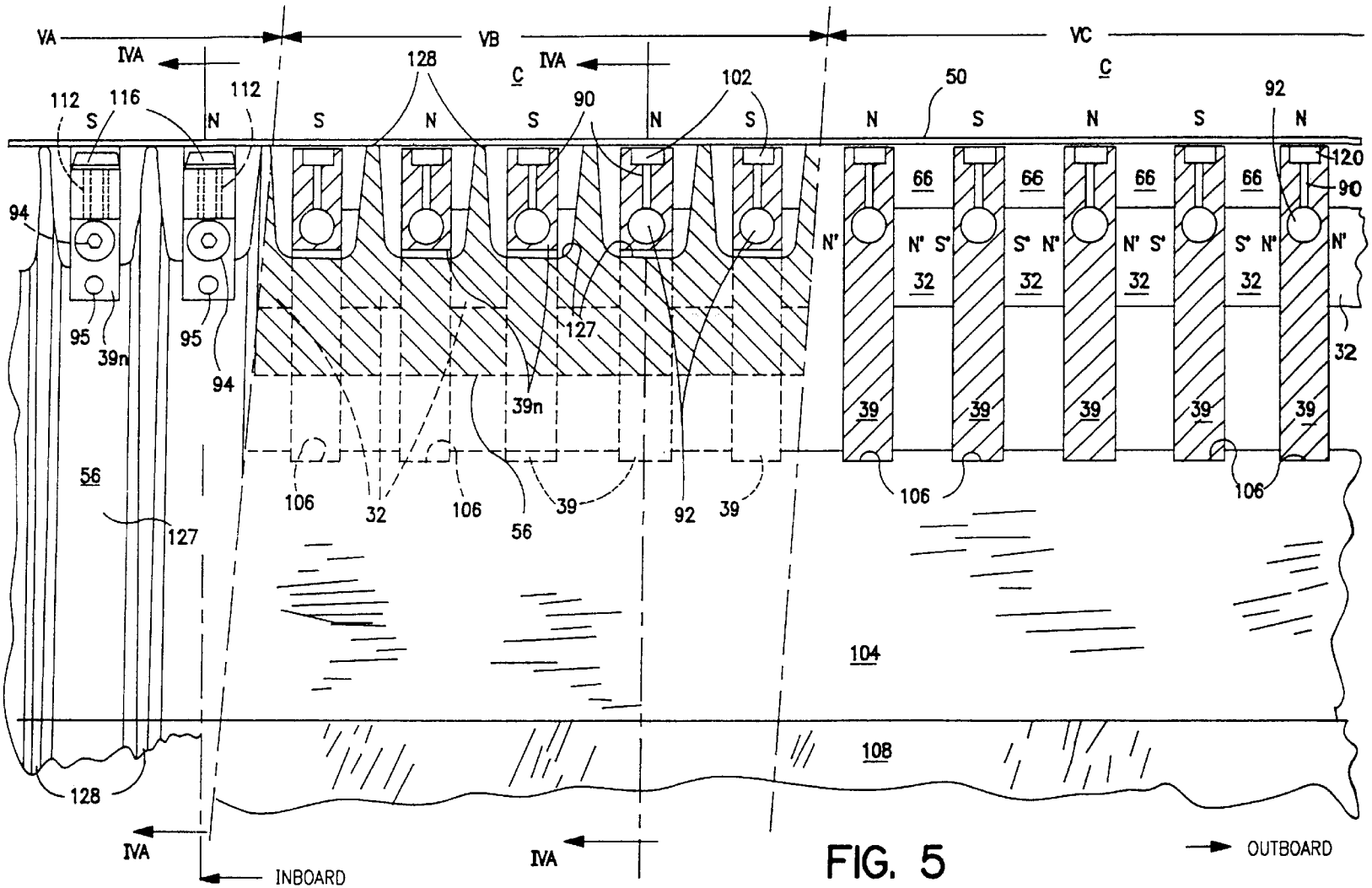
FIG. 5 is a partial elevational view combined with partial cross-sectional views of apparatus within the lower carriage of a casting machine embodying the present invention as seen from upstream looking downstream.
Figure 6:
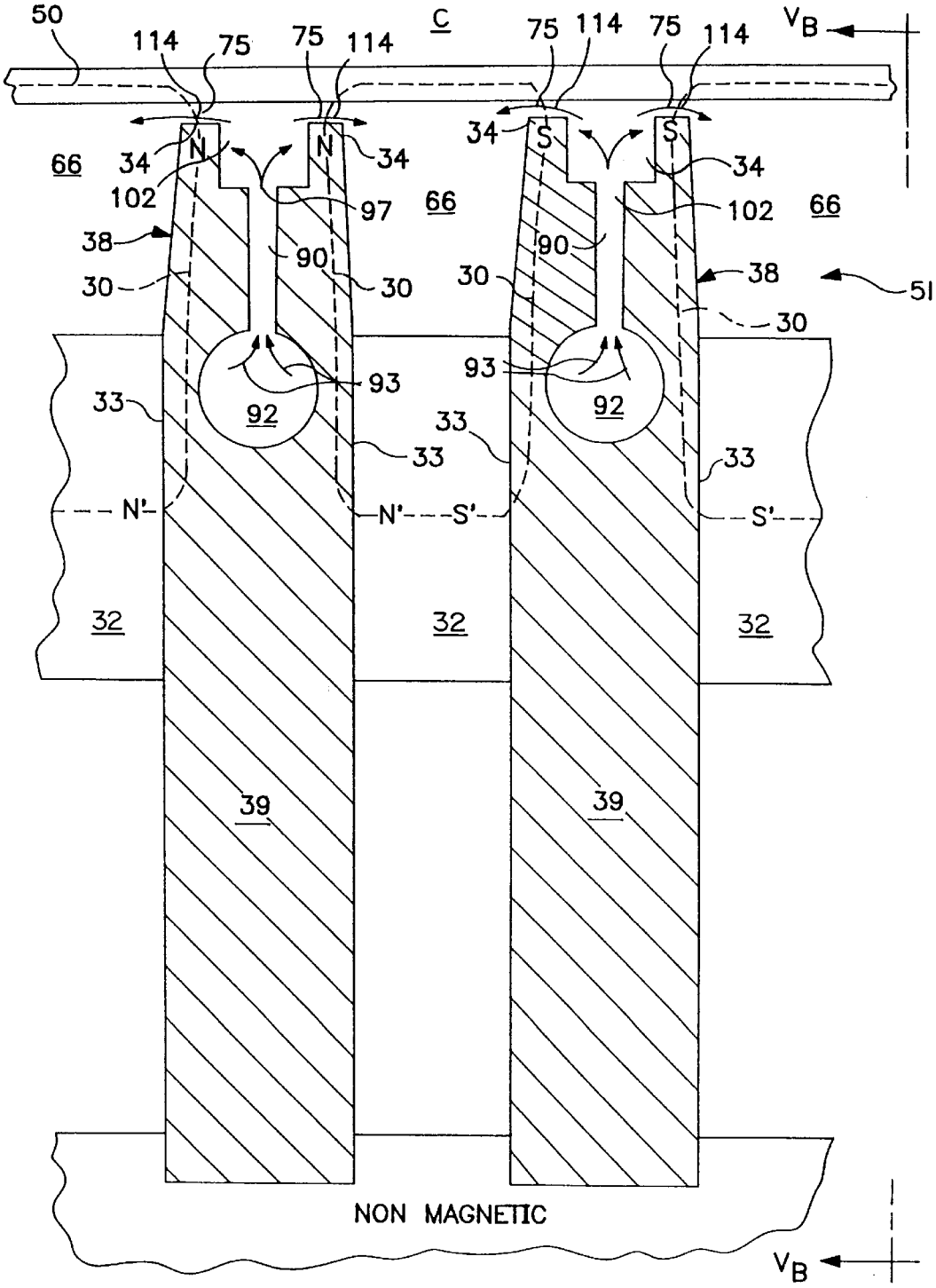
FIG. 6 is an enlarged view of a portion of FIG. 5, showing a typical magnetic circuit with thin, fast-travelling coolant-films passing through gaps between pole faces and the reverse surface of a moving casting belt. The relative thickness of the coolant-film gap is here exaggerated for clarity of illustration.

The result of this arrangement of the permanent magnets 32 is that pole faces 34 of pole members 39 in successive hydro-magnetic devices 38 spaced across the array 51 have alternate North (N) and South (S) polarities providing powerful reach-out attraction force (pull) on the moving casting belt 50 (FIGS. 2, 5 and 6).

Figure 4:
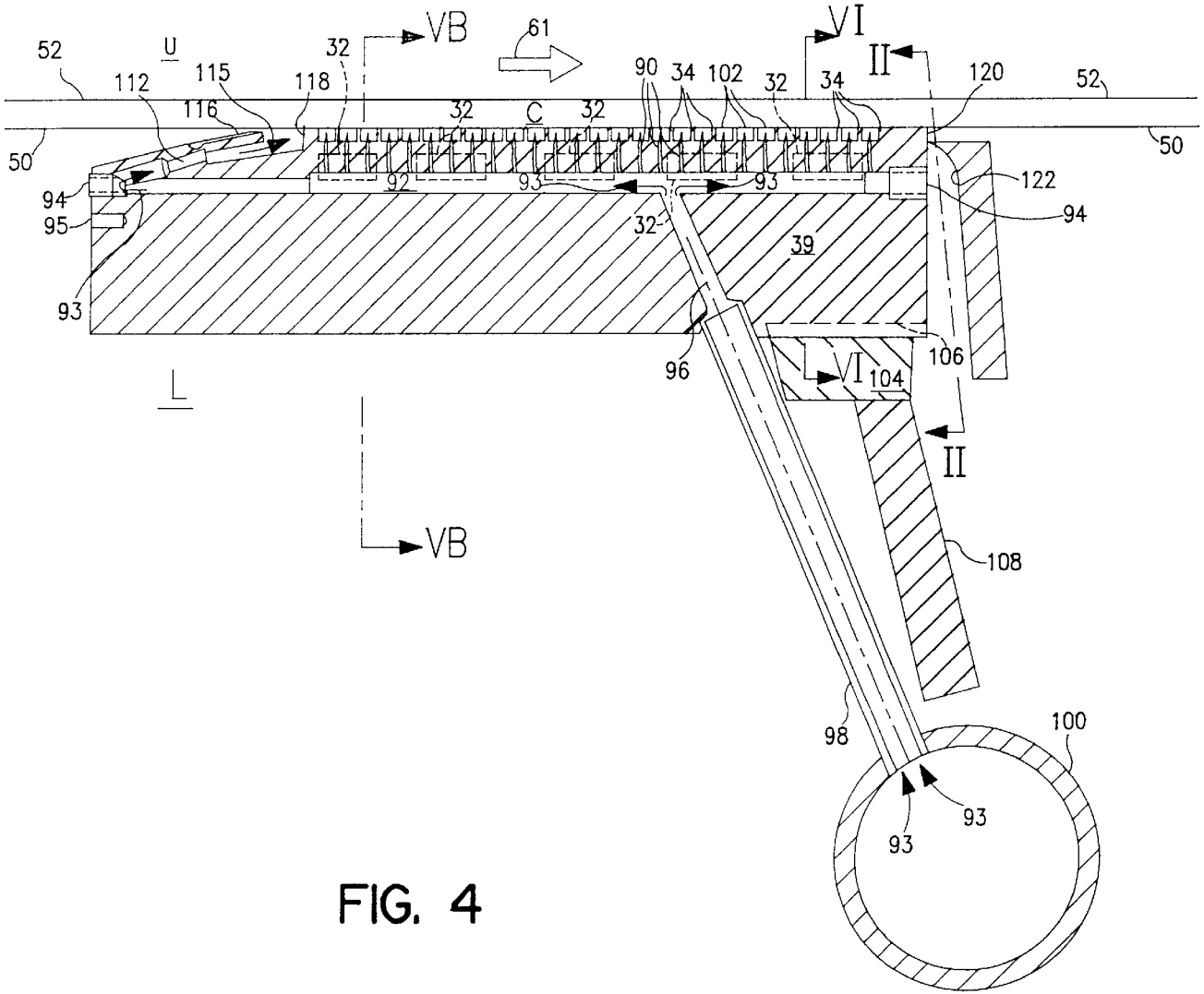
FIG. 4 is an elevational longitudinal sectional view as seen from the outboard side of the machine showing a typical hydro-magnetic device or sub-assembly of a hydro-magnetic pillow or array as it appears surrounded by other elements of the lower carriage of a belt-type casting machine such as shown in FIG. 1. The moving edge dams of the casting machine are shown in FIG. 1 and are not shown in FIG. 4 for clear illustration.
Figure 4A:
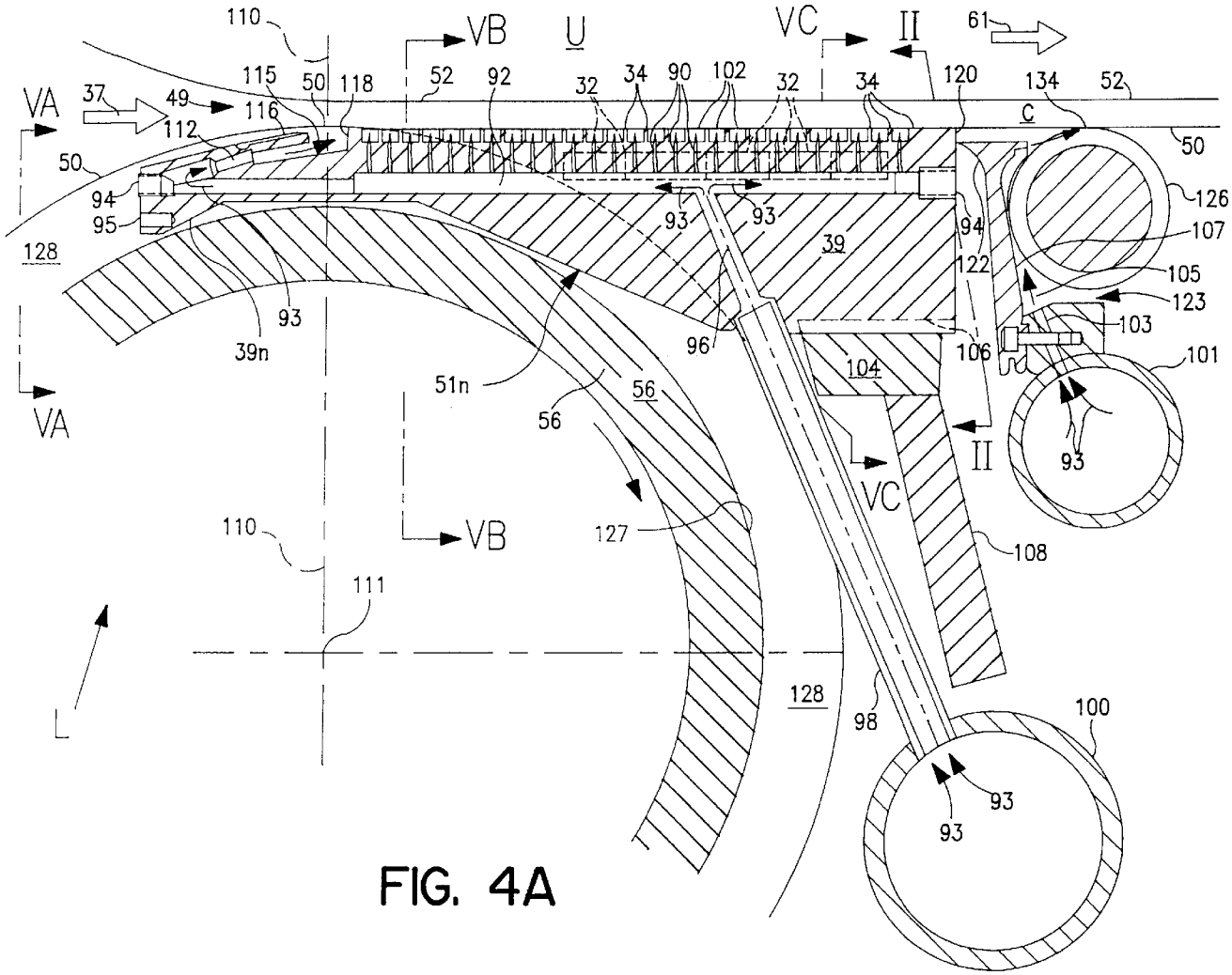
FIG. 4A is similar to FIG. 4 but shows a configuration of a hydro-magnetic device for cooperative interaction with an upstream nip pulley drum, also called a nip pulley roll.

In an array 51 as seen in FIG. 3 there are a plurality of permanent magnets 32, for example five are shown in FIG. 4, interposed in each of the elongated spaces 66 at longitudinally-spaced, longitudinally-aligned positions along the length of the elongated pole members 39, as is seen most clearly in FIG. 3. In this array 51, a first of the magnets 32 in each space 66 is positioned near an upstream end 118 of the pole faces 34 of two neighboring pole members 39. A last of the plurality of magnets in each space is positioned near a downstream end 120 of the pole faces 34 of the two neighboring pole members 39. In FIG. 4A which shows a nose array 51*n* the five magnets in each space 66 are shown positioned adjacent to each other near a downstream end of this nose array in order to avoid interference with pulley fins 128.

In FIG. 6 the dashed lines 30 indicate a complete magnetic circuit shown near the center of FIG. 6 and indicate portions of two other magnetic circuits at the left and right. The relative thickness of casting belt 50 and the size of gaps (spacings) 75 between pole faces 34 and the belt are exaggerated for clarity of illustration. A complete magnetic circuit 30 can be traced starting from the North pole N' of a permanent magnet 32 seen in the center of FIG. 6. For example, with five magnets in each space 66, this circuit 30 is representative of each of five such circuits in regard to each space 66 and two neighboring pole members 39. The magnetic circuit extends from magnet pole N' into a first pole member 39 of a hydro-magnetic device 38 and thence extends within this first member to a first pole face 34 thereon where the powerful magnetomotive force of the magnet magnetizes a powerful first magnetic pole N at this first pole face. The circuit extends from this first pole face 34 across a first gap 75 and enters the magnetically soft ferromagnetic belt 50 and then extends within the belt toward a second gap 75. The circuit extends across this second gap 75 and enters a pole face 34 on a neighboring pole member of a neighboring hydro-magnetic device 38 in the array 51, entering at a powerful South magnetic pole S magnetized by the powerful magnetomotive force of the magnet 32. The circuit extends within the second pole member 39 to the magnet pole S' and enters this pole S. This magnetic circuit is completed within the magnet from its pole S' to its pole N'.

As an example of a suitable arrangement, pole members 39 in an array 51 are shown spaced uniformly on centers. This center-to-center spacing of pole members 39 may, for example, be in a range from about ¾ inch to about 2 inches. These elongated pole members may be, for example, about ½ inch thick defining elongated spaces 66 between neighboring pole members extending longitudinally relative to the mold cavity. In FIG. 6, these spaces are shown slightly wider near belt 50 due to slight narrowing of pole members 39 toward their pole faces 34. Permanent magnets 32 in the embodiments as shown extend from pole S' to pole N'.

Each permanent magnet 32 may comprise a plurality of individual permanent magnet bodies arranged end-to-end in series in appropriate additive North-to-South polarity and/or a plurality of individual permanent magnet bodies arranged side-by-side in parallel in appropriate additive side-by-side relationship for providing a very powerful magnet 32 having resultant North (N') and South (S') polarities at its opposite ends or faces 33 (FIGS. 3A and 6) through which magnetic flux travels. If the magnet bodies are formed of material subject to corrosion, then these bodies are suitably coated for resisting corrosion, for example being nickel plated. These permanent magnets 32 as shown in FIGS. 2, 3, 5 and 6 are arranged as rectangular parallelepipeds being about one-half inch long to about one-inch long in the S' to N' direction of their internal magnetic flux and at least about one square inch in transverse cross section.

It is not necessary that end surfaces 33 of magnets 32 having poles N' and S' be placed in actual contact with side surfaces of the pole members 39. These magnet end surfaces 33 need only be adjacent to the side surfaces of their neighboring pole members. The term "adjacent" as used herein is intended to include actual contact. If there is any spacing between end surfaces 33 and side surfaces of pole members 39, then the resulting air gaps between end surfaces 33 and pole members 39 should be sufficiently small in the direction of the magnetic flux circuit 30 so that in practical effect there are only two significant gaps 75 in each complete magnetic circuit 30. With small air gaps or no air gaps at the magnet pole surfaces 33, each resultant complete magnetic circuit 30, which is magnetized by powerful magnetomotive force provided by the unique characteristics of its permanent magnet 32, will have an uncanny ability to "reach out" through gaps 75 for exerting powerful attraction forces on the moving casting belt 50 in a manner which traditional magnets or electromagnets of practical size cannot perform. These attraction forces diminish relatively slowly with increasing gap spacings 75, as will be explained further in connection with FIGS. 7 and 7A.

Inviting attention again to FIG. 6, it is seen that the two gaps 75 in each complete magnetic circuit 30 are filled with relatively thin films 114 of relatively fast-travelling liquid coolant as now will be explained. This liquid coolant 93 is pumped into a tunnel passageway 92 extending longitudinally in each pole member 39 by means of a coolant supply system shown in FIGS. 4 and 4A. The liquid coolant 93 which is typically water containing rust inhibitors is suitably filtered to remove particulate matter and then is pumped into a header pipe 100 extending transversely within the lower carriage L. An end of this header pipe 100 is shown in FIG. 1. In header 100 pumped coolant 93 may be pressurized, for example, above about 30 pounds per square inch (p.s.i.), but not pressurized too greatly in a particular machine set-up so as to levitate the belt beyond gap spacings 75 wherein available reach-out magnetic attraction can forcibly stabilize the belt against thermal distortions. Supply tubes 98 (only one is shown) extend from header 100. Each such supply tube connects to a diagonal drilled passage 96 in a pole member 39 connecting with a tunnel passage 92 in the pole member.

The shape of an elongated pole member 39 as shown in FIG. 4A is modified as compared with the shape as shown in FIG. 4 in order that an elongated pole member having the FIG. 4A configuration can project upstream beyond the nip region 110 so its nose portion 39*n* can fit into grooves 127 (FIG. 4A) between fins 128 on the lower nip pulley roll 56. This nip region 110 of the entrance 49 is shown in FIG. 4A by a dash and dot line passing through the entrance and through the axis 111 of the lower nip pulley 56 and also passing through the axis (not shown) of the upper nip pulley 60 (FIG. 1).

To accommodate crowded conditions of numerous supply tubes 98 uniformly spaced side-by-side along the header 100 at a spacing of about one to about two and a half inch on centers, these supply tubes may be oval in cross section for providing suitable flow capacity. A tunnel passage 92 extending longitudinally in an elongated pole member 39 may be considered to be a plenum tunnel, because it supplies pumped coolant 93 to numerous ones of the specially devised throttling nozzles which include fixedly throttling passageways 90 and pressure pockets 102 facing the belt and rimmed by pole faces 34. The upstream and downstream end of each tunnel passage 92 is plugged as shown at 94 in FIGS. 4 and 4A.

From the tunnel passageway 92 pumped coolant 93 enters fixedly throttling passageways 90 leading throttled pumped coolant flow 97 into pressure pockets 102 facing toward the reverse surface of the casting belt. Shown in FIGS. 2, 3, 3A, 4 and 5 are a multiplicity of these pressure pockets. They are shown as being oval shape, elongated longitudinally of the pole surfaces 34. For example, these pressure pockets 102 may be about 3/16ths of an inch deep and about 3/16 of an inch wide with a length longitudinally of pole surfaces 34 of about ⅜ of an inch. These oval-shaped pressure pockets 102 are shown closely spaced along the length of the pole faces 34, for example with a spacing of about one-eighth of an inch between respective downstream and upstream ends of their oval shapes; so that as shown, for example there are two pressure pockets per inch longitudinally of the pole surfaces 34 (i.e., a center-to-center spacing of about one-half inch). For example, as shown each pressure pocket 102 has an area of about 0.06 of a square inch facing the belt surface.

Throttled pumped coolant flow 97 in the pressure pockets 102 applies pushing force (repulsive force) against the reverse surface of the moving belt 50. This throttled pumped coolant flow 97 escapes from each pressure pocket in the form of fast-travelling liquid films 114 radiating outwardly from the pressure pocket into the gaps 75 and travelling across the pole face 34 which rims the pressure pocket. In addition to pushing force applied to the reverse surface of the moving belt 50 by throttled pumped coolant flow 97, each of the fast-travelling liquid films 114 also applies dynamic pushing force (repulsive force) against the reverse surface of the belt. These hydrodynamic pushing (repulsive) forces arising in and around each pressure pocket 102 decrease immediately (almost instantaneously) with any increase in the associated adjacent gaps 75 due to any distortion displacement of a local region of the belt 50 away from the associated pole faces 34.

Among the purposes of each throttling passageway 90 is to isolate (decouple, uncouple) its associated pressure pocket 102 from the associated tunnel passage 92 from which pumped liquid coolant 93 is being fed into the pressure pocket. By virtue of this isolation decoupling, any variation of pressure of coolant flow 97 into a particular pocket 102 (due to momentary distortion displacement of a nearby local region of the moving belt 50) does not affect the pressure of the pumped coolant 93 in the nearby tunnel passage 92. Thus, no positive feedback effect takes place with respect to localized pressure variations which may momentarily occur in coolant flow 97 into any pressure pocket. Consequently, each pressure pocket 102 with its coolant flow 97 and its radiating flowing films 114 functions independently of neighboring pockets. Behavior of any flow 97 and any film 114 does not significantly affect the pressure of pumped coolant 93 in tunnel passages 92 and does not significantly affect the functioning of any other pressure pockets nor any other coolant films.

In order to achieve this isolation decoupling, the throttling passageways 90 (which may be considered to be fixed throttling orifices of significant length) are preferred to be no larger in inside diameter (I.D.) for example than about 1/16th of an inch (about 0.063") and preferably are not smaller than about 0.04 of an inch, due to possibility of an inadvertent clogging of openings having a smaller I.D. than about 0.04". As shown in FIG. 6, the passageways 90 are about three-quarters of an inch long with an I.D. of about 0.045 of an inch.

As examples of suitable operating parameters, the pressure of pumped liquid 93 in the header 100 (FIGS. 4 and 4A) may be in a range above about 30 p.s.i. but not pressurized too greatly as stated above. In the following example for purpose of explanation, header pressure is assumed to be in a range of about 100 p.s.i. to about 110 p.s.i. (in a range of about 7 bars). Since a relatively insignificant pressure drop is assumed to occur in a supply tube 98 and in the connection passage 96, the pressure of the coolant 93 (FIG. 6) in each tunnel passage 92 is in a range of about 100 p.s.i. to about 110 p.s.i.

It is initially assumed for purposes of explanation that the moving casting belt 50 in FIG. 6 is stable in position in response to balancing of the pull/push forces. The moving belt is being supported by throttled pressurized flow 97 and also by relatively thin films 114 of fast-travelling coolant escaping from pressure pocket 102 through gaps 75. In accord with such stable-belt initial conditions, only a modest flow 97 is entering into the pocket 102. "Flow" as used herein means amount of coolant volume (i.e., quantity) per unit of time. Consequently, for example, under these initial conditions a pressure drop of about 30 to about 40 p.s.i. is assumed to occur in throttling passageway 90. Thus, for example, the pressure of flow 97 entering into the pressure pocket 102 is the header pressure of about 100 to about 110 p.s.i. minus a pressure drop of about 30 to about 40 p.s.i. causing pressure of flow 97 to be assumed to be in a range of about 60 to about 80 p.s.i. in these initial conditions of a stable position of the moving belt.

Now, assume for purposes of explanation that thermal distortion starts to cause a localized region of the moving belt 50 in FIG. 6 to become displaced farther from the magnetic pole faces 34, thereby enlarging the gaps 75, resulting in increased thickness of fast-travelling films 114, resulting immediately in increased escaping flow in these films 114 radiating from the pressure pocket 102, resulting in increased flow 97 into the pressure pocket, resulting in an immediate increase in pressure drop occurring in throttling passageway 90 which pressure drop becomes, for example, about 40 to about 50 p.s.i. Consequently, immediately, the pressure of flow 97 into the pressure pocket 102 is assumed to become about 50 to about 70 p.s.i., and then immediately a relatively unchanged reach-out pull of magnetic attraction forces in magnetic circuits 30 powerfully pulls the distorted region of the belt 50 back into its original stable position again being hydrodynamically supported by immediately-restored, stable throttled pressurized flow 97 and stable, relatively-thin, fast-travelling films 114.

In overall effect in hydro-magnetic devices 38 there is a fixed throttling passageway (fixed elongated orifice) 90 located immediately upstream from pressure pocket 102 in relationship to coolant-flow direction 93 to 97. And then there is a variable throttling orifice provided by variable spacings occurring in gaps 75 located immediately downstream from the pressure pocket 102 in relationship to the escaping coolant flow in the fast-travelling films 114. Thus, advantageously, the pressure of coolant flow 97 entering into a pressure pocket 102 immediately (almost instantaneously) responds to changes in spacings of gaps 75 and thereby immediately allows the powerful reach-out magnetic pull forces to overbalance the weakened hydrodynamic push forces, thereby immediately acting to restore a desired stable, even condition of the moving casting belt 50.

Figure 3A:
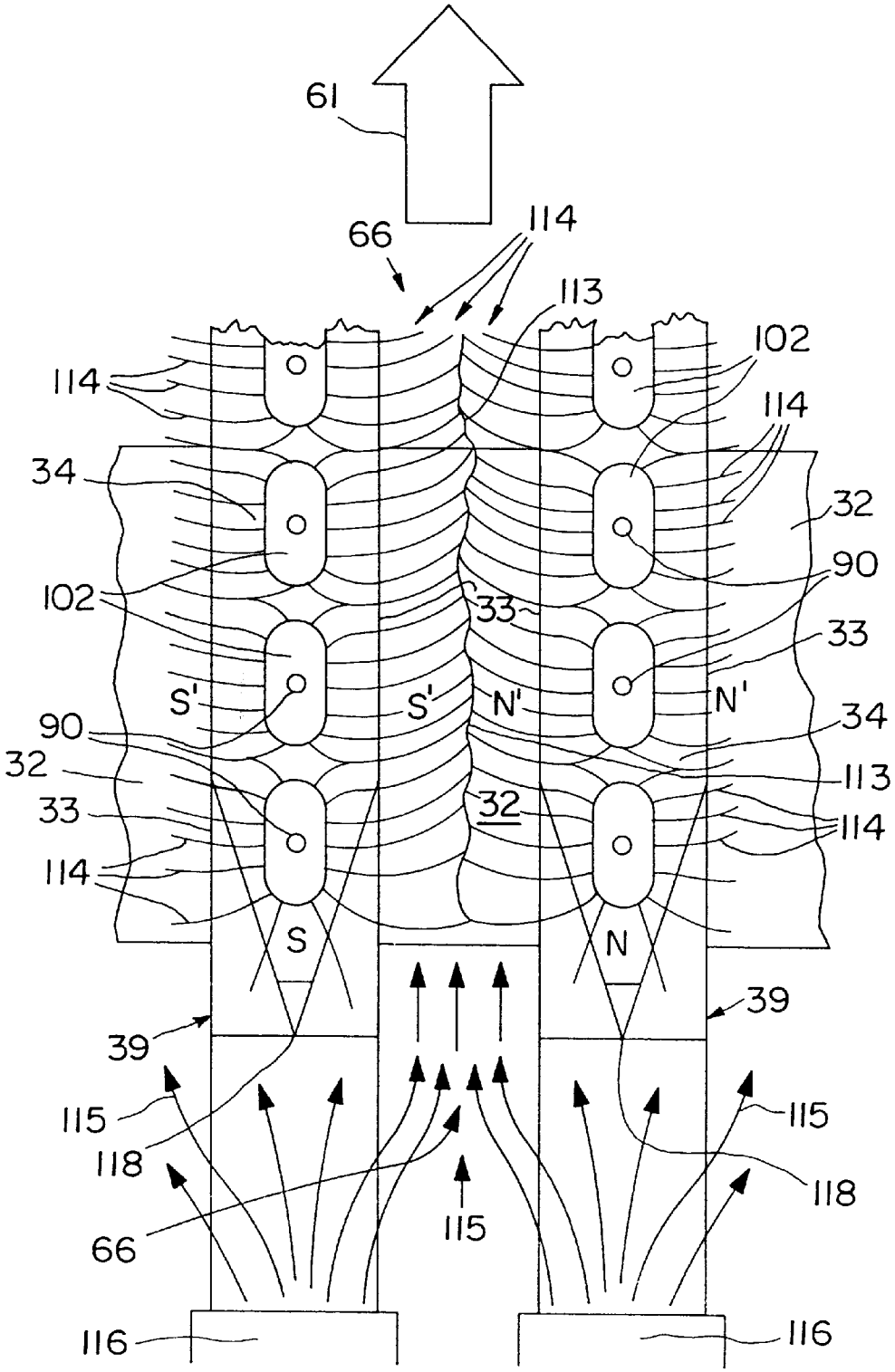
FIG. 3A is a close-up view of a portion of FIG. 3 revealing schematically the flows of liquid coolant against the lower reverse surface of the unshown lower casting belt.

It is to be noted from FIGS. 3A and 6 that throttled pressurized coolant flows 97 and the fast-travelling coolant films 114 (FIG. 6) are emitted from pressure pockets 102 immediately contiguous with pole faces 34 at which magnetic flux is powerfully active in circuits 30. In this localized manner the reach-out magnetic attraction pull forces and hydrodynamic push forces are balanced in pull/push relationship in their own immediate locale, i.e., there is a balance of opposed pull and push forces occurring over only a small lateral distance along the thin-gauge casting belt 50. Consequently, only an insignificant moment arm is involved in regard to effective application to the belt of these opposed pull and push forces. Thus, advantageously there is insignificant mechanical (in contradistinction to thermal) distortion introduced into the thin-gauge casting belt by these opposed pull and push forces acting in their localized manner.

In FIG. 3A are shown directions and patterns of fast-travelling coolant films escaping past magnetic pole faces 34 as indicated by flow lines 114. The throttled pumped coolant flows 97 (FIG. 6) and these fast-escaping coolant films 114 float (levitate) the casting belt 50 keeping it away from the pole faces 34, and the problems of friction and wear due to contact of a moving belt with sliding supports or belt-backups are thereby advantageously solved.

Also, these fast-travelling films 114 effectively scour heat away from the reverse surface of the casting belt (not shown in FIG. 3A) cutting past or through any slower moving coolant for effectively cooling the belt. Without use of unidirectional sweeping flow 115 (which is described later) fast-travelling coolant films 114 after escaping past respective pole faces 34 would collide with fast-travelling coolant films simultaneously escaping past pole faces 34 in a neighboring pole member, and an intermediate turbulent collision zone 113 may occur near a mid-line of each elongated space 66 wherein coolant would have substantially zero net unidirectional momentum, thereby being ineffective for clearing coolant away from pole members 39, except for gravitational fall-off or spill-off effects.

In order to divert, redirect, merge with, rejuvenate and sweep away from each elongated space 66 any turbulent coolant 113 together with fast-travelling coolant films 114 so as to make room for continual flows of coolant from the pressure pockets 102 and so as to provide suitable cooling of the belt, a fast-moving, high-volume, unidirectional sweeping coolant flow 115 (FIGS. 3A, 4 and 4A) is shown being introduced into an upstream end of each space 66. This unidirectional sweeping flow 115 prevents any flows of coolant near the reverse surface of the belt from becoming relatively too slow for suitably scouring heat away from this reverse surface (i.e., too slow for suitably cooling the belt so as to prevent thermal damage to the casting belt). This sweeping flow 115 causes all coolant to end up flowing in one direction while maintaining a substantial relative velocity between coolant and belt at all points on the reverse surface of the casting belt for preventing thermal damage to the belt. These unidirectional sweeping flows 115 of coolant are provided as shown most clearly in FIGS. 4 and 4A by sweep nozzles 112 which communicate with upstream ends of the tunnel passages 92 near the upstream plugs 94 so that pumped coolant flow 93 enters these sweep nozzles.

Each sweep nozzle 112 (FIGS. 4 and 4A) is shown aimed downstream at an acute angle at a relatively shallow angle of approach toward the reverse surface of the moving casting belt. Each sweep nozzle 112 has a hood-like fingernail deflector 116 mounted near a downstream discharge end of the sweep nozzle for laterally spreading a forceful stream 115 of sweeping coolant issuing at high velocity from the sweep nozzle. The fingernail deflectors 116 are shown aimed toward the reverse surface of the moving casting belt 50 at a slightly more acute angle (i.e., a smaller angle) than their associated sweep nozzles 112.

Each fingernail deflector 116 directs the forceful stream 115 (FIG. 3A) issuing from its sweep nozzle against the belt's reverse surface at an acute angle of impingement in a relatively uniform, closely-defined location on the casting belt near an upstream, prow-shaped, pointed end 118 (most clearly seen in FIGS. 3 and 3A) of each elongated pole member 39. Downstream ends of the pole members 39 also are normally pointed in a prow-shape 120 (FIGS. 2 and 3) like their upstream prows 118. The bore of sweep nozzle 112 has a cross-sectional area which is larger than throttling orifices 90 but smaller than the tunnel passage 92. The relative proportion of cross-sectional area of sweep nozzle bore 112 compared with cross-sectional area of the tunnel passage 92 is determined and scaled in size such that at the pumped pressure of coolant 93 in the headers 100 (FIGS. 4 and 4A) there is no starving of the coolant flows 97 (FIG. 6) into the pressure pockets 102 and also no starving of the sweeping flows 115. Thus, velocity, flow and momentum of sweeping coolant 115 are fast enough and voluminous enough to merge with and deflect and sweepingly to carry away in the downstream direction 61 all of turbulent coolant 113 and all fast-travelling films 114 after they escape from the gaps 75, while maintaining a substantial relative velocity at all points on the reverse surface of the belt sufficient to prevent thermal damage to the belt.

Soon after the sweeping coolant 115 (plus other coolant being carried downstream therewith) exits from downstream ends of the elongated spaces 66, a deflector scoop 122, which extends transversely relative to the moving belt, scoops coolant away from the moving belt. An associated coolant-removal gutter (not shown) serves to return this scooped-away coolant to a supply reservoir (not shown). Such a coolant deflector scoop 122 and its coolant removal gutter, for example, may be similar to deflector scoops shown in FIGS. 6 and 7 of U.S. Pat. No. 3,036,348 of Hazelett et al. listed on the cover page, except that deflector scoops 122 do not include header ducts nor nozzles for re-application of coolant to the belt.

Shown in FIG. 4A, magnetic pole members 39 (only one is shown) have a slender upstream-projecting nose end portion 39*n* which projects beyond the nip region 110 so that this nose portion 39*n* fits into a groove 127 between two fins 128 on a nip pulley roll. Thus, seen in FIG. 4A sweep nozzle 112 and its deflector fingernail 116 both are positioned slightly upstream relative to nip region 110. An array of hydro-magnetic devices 38 having slender nose end portions 39*n* are called nose arrays as indicated at 51*n* in FIGS. 8, 9 and 10.

Figure 11:
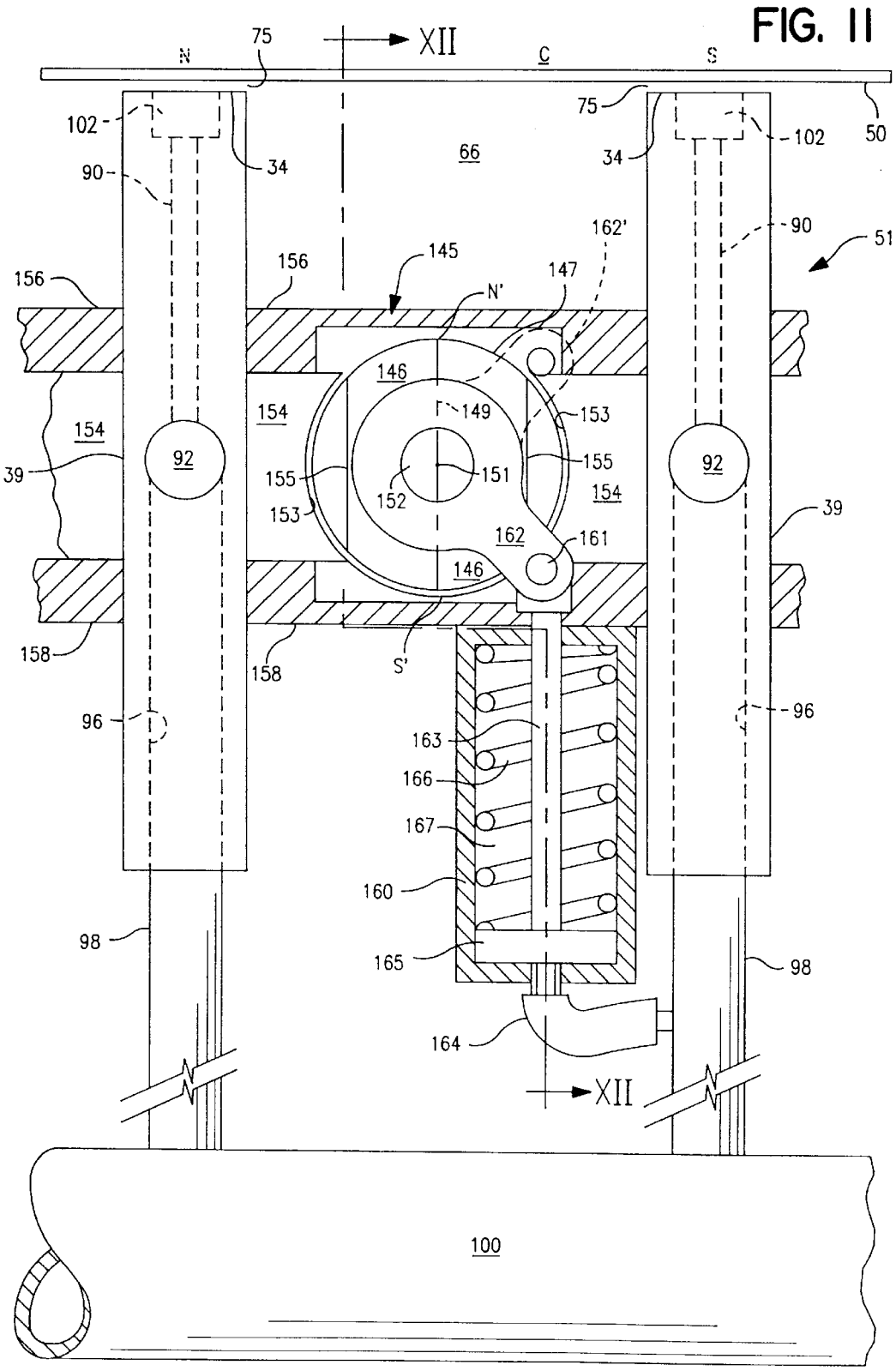
FIG. 11 is an enlarged cross-sectional elevation view as seen looking downstream from the upstream vantage point of FIG. 5 showing a permanent magnetic device rotatable by a fluid-driven magnet-rotating mechanism. The permanent magnetic device is shown in the open-circuit or "off" position.
Figure 12:
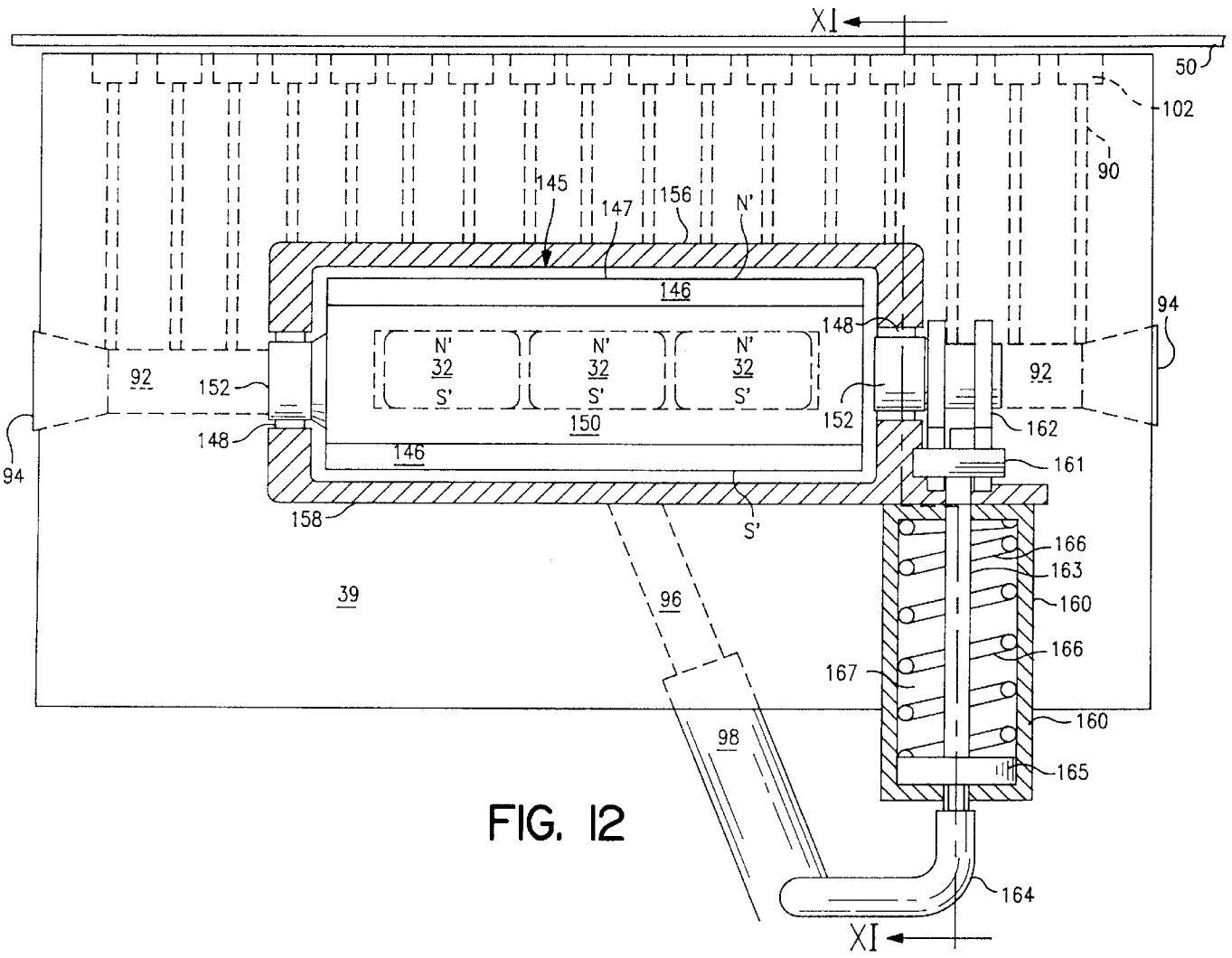
FIG. 12 is a cross-sectional elevation view of the apparatus of FIG. 11 as seen from the outboard vantage point of FIG. 4.
Figure 13:
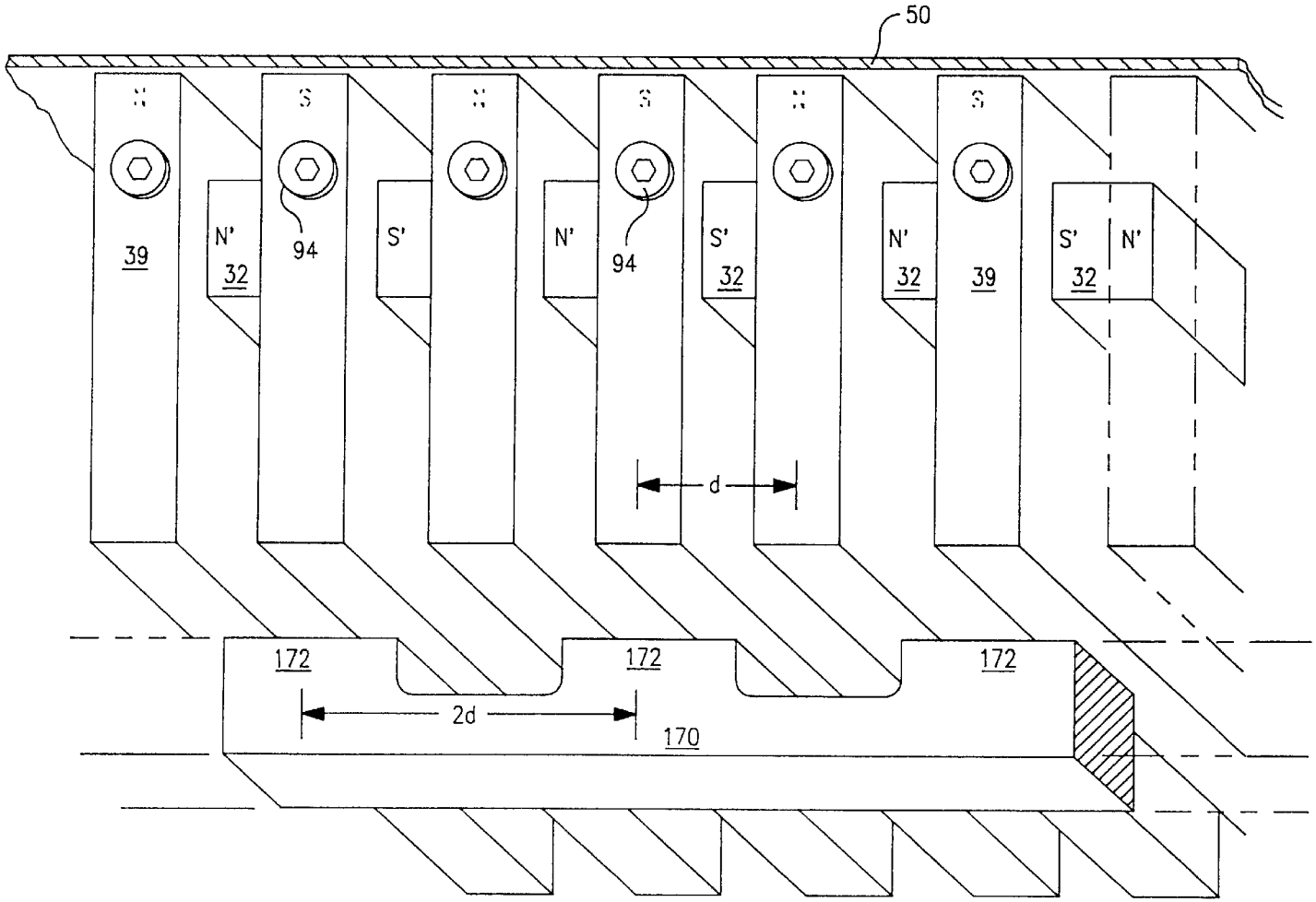
FIG. 13 shows the use of a movable magnetically soft ferromagnetic shunt in an alternative embodiment of the invention instead of using the rotatable permanent magnetic devices shown in FIGS. 11 and 12.
Figure 14:
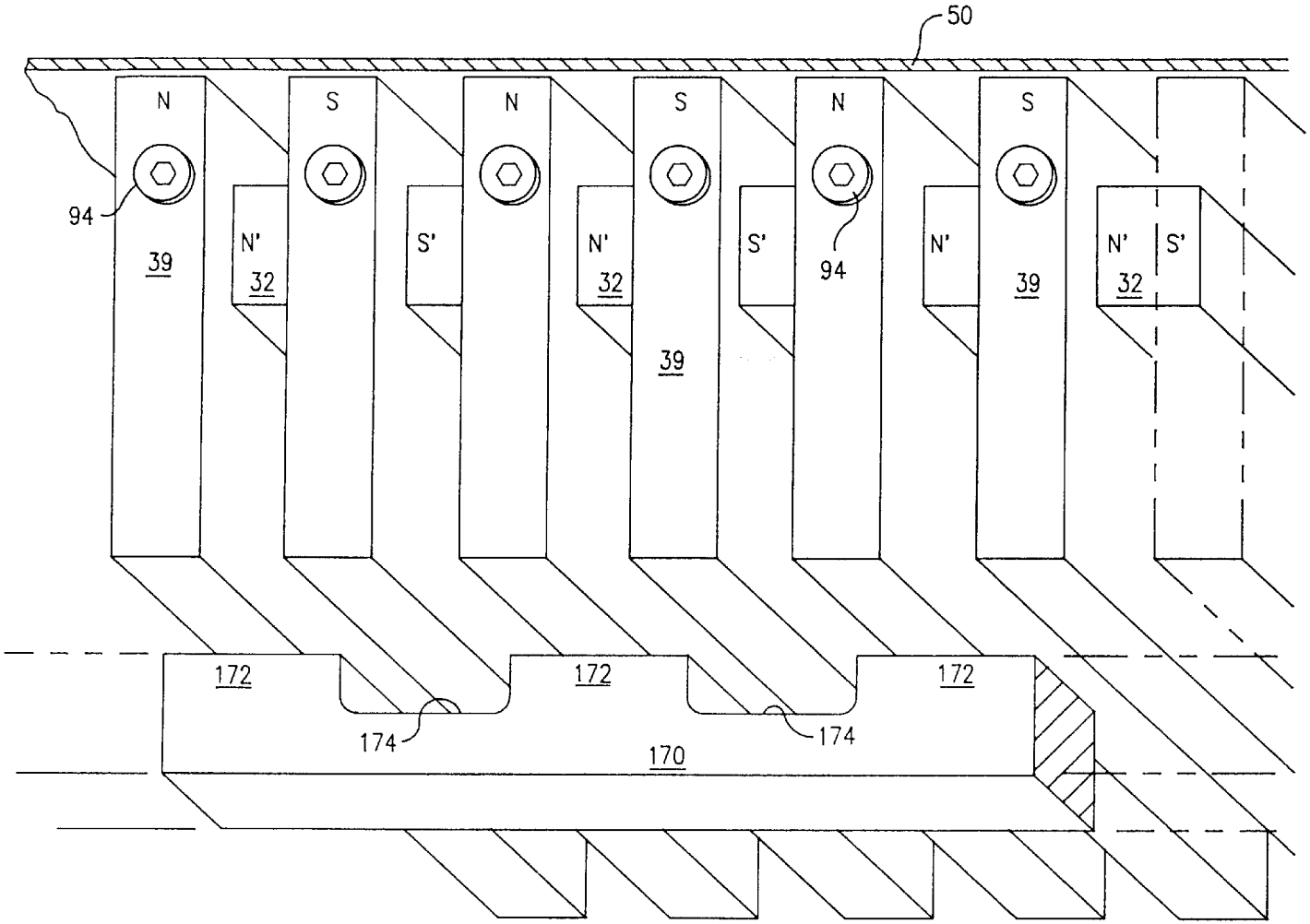
FIG. 14 is a view similar to FIG. 13 but shows the shunt bar in the "on" position (pole faces magnetized).

The nip pulleys 56, 60 and their fins 128 which are illustratively shown as being integral with the pulley body are made of non-magnetic material, i.e., diamagnetic or paramagnetic material, for example austenitic stainless steel, Type 304, so the fins and nip pulleys do not invite leakage flux to leave pole members 39, 39*n* and enter the fins and pulleys, which would reduce reach-out flux available from pole faces 34 of the nose portions 39*n* of the pole members 39 for stabilizing the moving casting belts. As an alternative, the fins may be made of such non-magnetic stainless steel, while the body of the pulley is made of magnetically soft ferromagnetic material for completing magnetic circuits in cooperation with pole member nose portions 39*n* . As a further alternative, the fins 128 may be made of magnetically soft ferromagnetic material, while the body of the pulley is made of non-magnetic material. Then, reach-out permanent magnets are arranged to magnetize the fins with alternate North and South polarity during operation of the machine for attracting and stabilizing the belt. These magnets may be movably mounted with operating mechanism, for example such as shown in FIGS. 11 and 12 moving the magnets for diminishing the magnetic attraction between the fins and the belt for facilitating removal of the belt from the machine and for facilitating installing another belt. As an alternative, a movable shunt for example as shown in FIGS. 13 and 14 may be used for diminishing the magnetic attraction between the fins and the belt for facilitating such removal and installation.

The permanent magnetic material in each of the permanent magnets 32 which powerfully magnetize the magnetic circuits 30 (FIG. 6) and also powerfully magnetize the whole magnetic pole members 39 for providing the powerful reach-out attraction forces (pull) on a moving casting belt 50 containing magnetically soft ferromagnetic material has certain very important critical characteristics: (1) A sample of this permanent magnetic material has a normal hysteresis loop (B—H loop) which crosses the B-axis at a point wherein the sample has a residual induction $B_r$ with a magnetic flux density equal to or greater than about 8,000 Gauss. (2) A sample of this permanent magnetic material has a normal hysteresis loop (B—H loop) wherein a straight line tangent to a midpoint of the portion of the loop in the second or fourth quadrant has a slope indicating a midpoint differential demagnetizing permeability in AGauss per ΔOersted equal to or less than about 4 with the magnetic permeability of air being taken as 1. Also, this permanent magnetic material needs to have a great degree of permanence—i.e., roughly speaking it needs to be hard to demagnetize, i.e., it is "hard" in a magnetic sense, i.e., a very large demagnetizing coercive force is required in order to demagnetize this permanent magnetic material. These advantageous characteristics of the magnets 32 will be discussed further in connection with FIGS. 7 and 15.

As used herein the term "midpoint differential demagnetizing permeability" of a sample of a permanent magnetic material means the slope expressed in ΔGauss per ΔOersted of a straight line which is tangent to the sample's B—H loop at a midpoint of the portion of this loop which is in the second or fourth quadrant. It is to be understood that the sample's B/H loop is drawn on a plot wherein values of B and H are scaled along the respective vertical and horizontal axes such that B/H or ΔB/ΔH of vacuum, i.e., the slope for the flux density B resulting from applying a coercive force H to vacuum when on this same plot is always 1; in other words, the ratio of the change in flux density ΔB to a change ΔH in applied coercive force for vacuum when drawn on this same plot is always 1. In the following tables we have set forth our preferences in regard to these important critical characteristics.

TABLE I

| A sample of permanent magnetic material in magnets 32 has a B-H loop which crosses the B-axis at a point where the residual induction $B_r$ has a magnetic flux density in Gauss: | |
|---|---|
| generally | equal to or greater than 8,000 |
| preferred | equal to or greater than about 9,000 |
| more preferred | equal to or greater than about 10,000 |
| more preferred | above about 11,000 |

TABLE II

| A sample of permanent magnetic material in magnets 32 has a midpoint differential demagnetizing permeability expressed in ΔGauss per ΔOersted | |
|---|---|
| preferred | equal to or less than about 4 |
| more preferred | equal to or less than about 2.5 |
| most preferred | equal to or less than about 1.2 |

In the introduction we stated that the very powerful magnetomotive force as shown in Table I provided by such permanent magnets 32 is not the sole reason in our view for their successful operation. Their very low midpoint differential demagnetizing permeability as shown in Table II is also very critical. For example, alnico 5 has a midpoint differential demagnetizing permeability of about 30. This value of about 30 for alnico 5 has a ratio compared to 1.2 for the most preferred value in Table II of about 30/1.2, which equals about 25. Consequently, for a given length N' to S' of the magnets, an incremental increase in spacings of gaps 75 (FIG. 6) would cause an effect generally speaking which is about twenty-five times as devastating for the magnetic attraction force which would be provided by magnets of alnico 5 as is provided by the present magnets 32. This is not a quantitative difference; it is a qualitative difference! Thus, alnico 5 magnets lose control over a thermally distorting casting belt 50 or 52; whereas the present magnets 32 do not lose control in arrays 51 or 51*n* configured and operated as described for these preferred embodiments.

Another way of thinking about unusual effects of each magnet 32 acting within its own magnetic circuit 30 (FIG. 6) provided by the critical characteristic of a very low midpoint demagnetizing permeability, for example such as equal to about 1.2, is to recognize that magnetic flux in circuit 30 must pass through each magnet 32 from S' to N'. Assume that magnet 32 has a physical length of one inch (25.4 mm) from end 33 to end 33. The value of 1.2 compared with air at 1 means that flux within magnet 32 itself must bridge across an "internal apparent air gap" of length of 1 physical inch divided by 1.2, which is an internal apparent air gap of 0.83 of an inch (21 mm). Compared to the magnet's own "internal apparent air gap" of 21 mm, a gap 75 of 1.5 mm at pole face 34 amounts only to 7.1%. Conversely, an alnico 5 magnet of 1 physical inch in length divided by its assumed midpoint differential demagnetizing permeability of 30 has an "internal apparent air gap" of only 0.033 of an inch (0.84 mm). Compared to the alnico 5 magnet's own "internal apparent air gap" of 0.84 mm, a gap 75 of 1.5 mm amounts to 178%. Once again it is seen that 178% is twenty-five times more devastating to magnetic attraction than 7.1%. The midpoint differential demagnetizing permeability of about 30 for alnico 5 was measured in *Permanent Magnet Design and Application Handbook* written by Professional Engineer Lester R. Moskowitz and published in 1976 and 1985 by Krieger Publishing Company in Malabar, Fla. 32950 by drawing a straight line tangent to a second quadrant midpoint in his FIG. 6–3 entitled: "Analysis of a magnetic hysteresis loop. (The hysteresis curve shown is typical for Alnico 5.)"

The elongated magnetic pole members 39 are shown in FIGS. 4 and 4A secured to and supported by a transverse beam 104 formed of non-magnetic material (paramagnetic or diamagnetic material) for example such as non-magnetic austenitic stainless steel, Type 303. The pole members 39 are seated in grooves 106 in the beam 104. At upstream ends of pole members 39 are fixture holes 95 for alignment and supplemental support of the pole members. A transverse beam 108 positioned below beam 104 is included in a chassis frame 141 of lower carriage L. This beam 108 is made of suitable structural material, for example such as structural steel.

In our present understanding of this invention, we believe that it is most valuable when employed in farthest upstream locations in twin-belt casting machines 36, i.e., in proximity to the first one-third or somewhat more or less of the overall length of the mold cavity C where thermal stresses on casting belts are most intense. This first one-third is measured from the entrance 49 where an in-feed nozzle 138 is shown introducing molten metal 139 in FIGS. 8, 9 and 10. This farthest upstream zone is the region where there is fragile freezing metal initially changing from its liquid to solid state.

The arrays 51 and 51*n* in FIGS. 4, 4A and 5 are shown rigidly mounted to the chassis of a belt carriage by transverse beams 104, 108. For continuous casting of some metals it may be desirable to employ hydro-magnetic arrays or pillows 51*n* and 51 which are rigidly mounted along the entire length of the mold cavity C.

Experience in continuous casting has shown that a modest degree of springiness often is desirable in belt-backup support apparatus associated with downstream portions of the mold cavity C, notably in the casting of aluminum alloys where the metal is not yet fully frozen throughout the entire thickness of the cast product P but where there is enough solid metal that significant shrinkage is occurring during its cooling. Such springiness enables the front surfaces of the moving casting belts to be kept in hugging close contact with the metal being cooled.

In continuous casting machines for metal casting operations where it is desired to provide springiness in belt-backup support apparatus, one or more downstream arrays 51 may be mounted on coil springs or transverse supports which may be designed to be compliant and springy. Their positions and alignment toward or away from a casting cavity C may be adjusted during operation by mechanisms not shown. Such belt-support backup adjustment mechanisms for adjusting compliant, springy support members may be similar to those shown and described in U.S. Pat.

Nos. 4,552,201; 4,671,341; 4,658,883; and 4,674,558 of Hazelett and Wood.

A method by which springiness or compliance of the hydro-magnetic belt-stabilizing pillows arrays 51 may be adjusted is to employ different diameters of throttling passageways 90 (seen most clearly in FIG. 6). The given pumping pressure may be selected within a range above about 30 psi, as may be desired for a particular belt-type casting machine using a particular moving, endless, flexible, thin-gauge, heat-conducting casting belt or belts for casting a particular metal or metal alloy.

In the embodiment of the invention shown in FIG. 8, there are four belt-stabilization arrays 51 of the hydro-magnetic devices 38. Also there are two belt-stabilization nose arrays 51*n* which are operatively associated with the lower and upper nip pulley rolls 56 and 60. In these nose arrays 51*n* the upstream slender elongated nose portions 39*n* (FIG. 4A) of pole members 39 are fitted into grooves 127 between circumferential fins 128 on the respective lower and upper nip pulley rolls 56 and 60. There are coolant deflector scoops 122 positioned downstream (in the direction shown by direction arrow 61) of the nose arrays 51*n* and also there are such deflector scoops positioned downstream of lower and upper arrays 51 shown near an intermediate portion of the mold cavity C. Coolant exiting from downstream ends of the lower and upper downstream arrays 51 may be allowed to fall off from the reverse surface of the lower belt and to spill off from the edges of the upper belt.

In FIG. 8, an upper downstream hydro pillow array 53 is shown flexibly mounted to the chassis frame 142 of the upper belt carriage by means of resilient mounts 140, for example such as coil springs. Magnets normally are omitted from a hydro pillow array 53.

Figure 9:
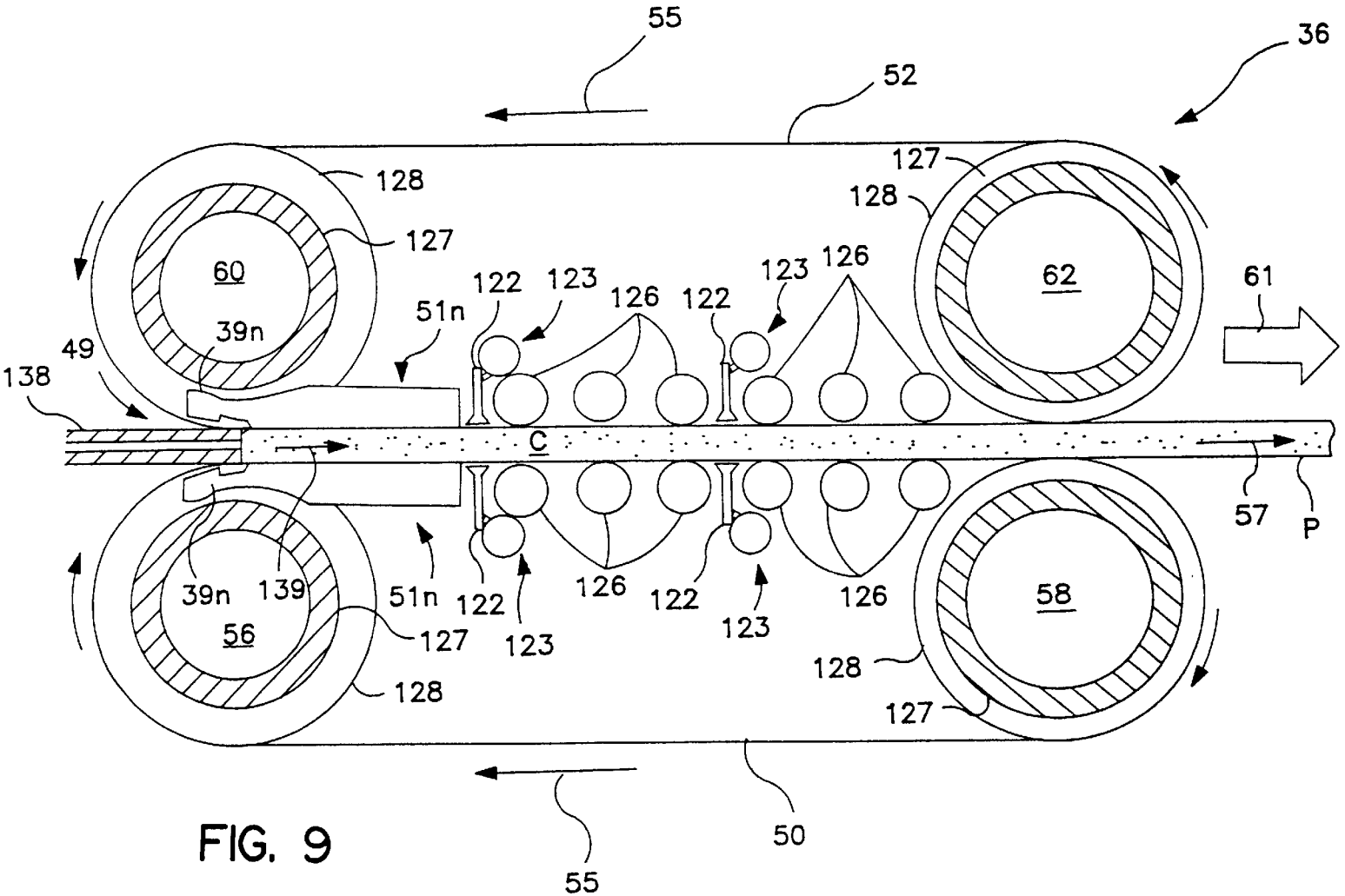
FIG. 9 is a view similar to FIG. 8 but illustrates another preferred embodiment of the invention wherein the arrays of hydro-magnetic devices which are shown positioned downstream in FIG. 8 are replaced with backup rollers shown positioned downstream in FIG. 9.
Figure 10:
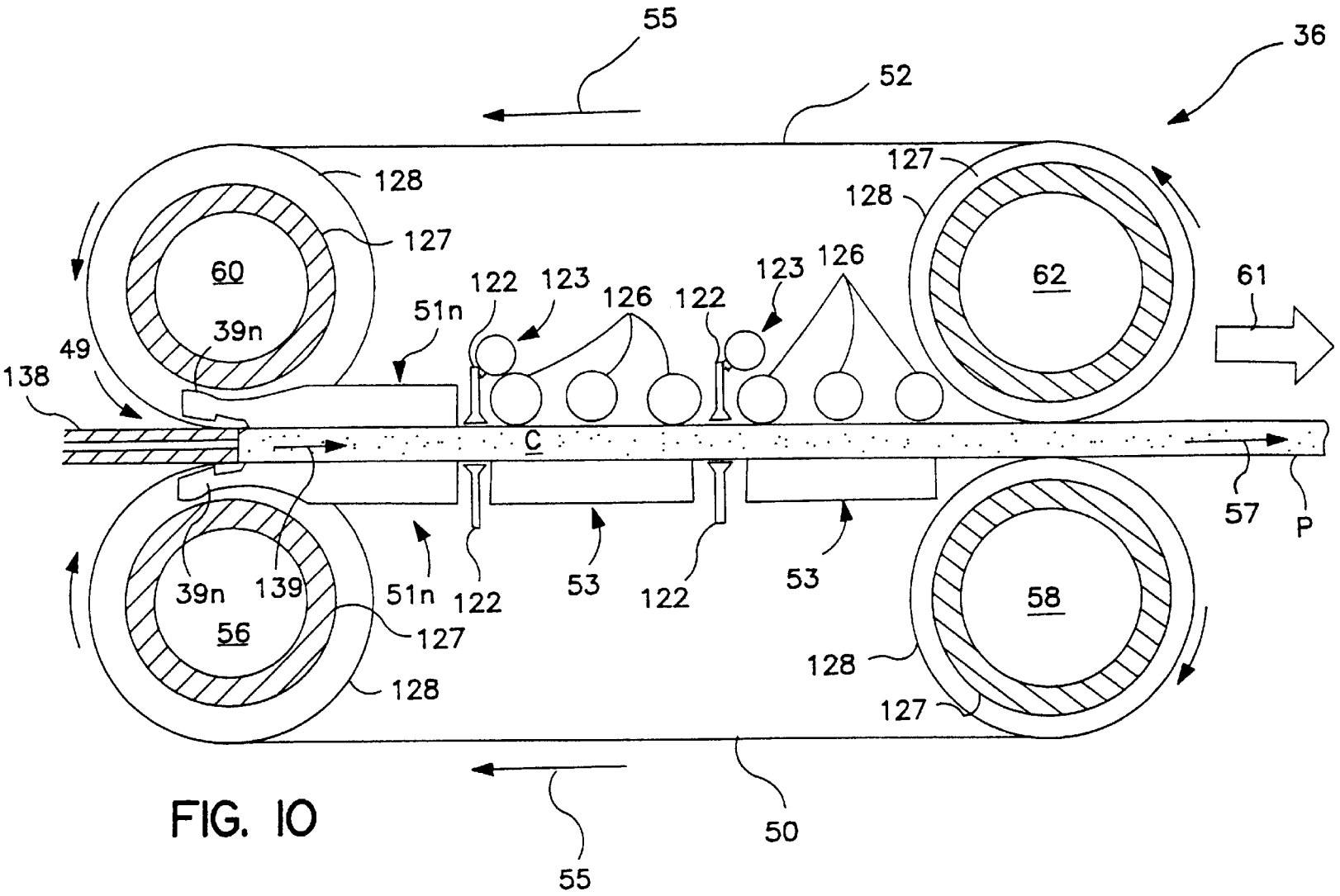
FIG. 10 is a view similar to FIG. 8, but illustrates another preferred embodiment wherein two arrays of hydro-magnetic devices which are shown positioned downstream in the upper carriage in FIG. 8 are replaced with backup rollers shown positioned downstream in FIG. 10. The two arrays shown positioned downstream in the lower carriage in FIG. 10 in opposition to the backup rollers are non-magnetic coolant pillows.

In connection with the embodiments of the invention shown in FIGS. 9 and 10 it is seen in FIG. 4A that any deflector (and applicator) scoop 123 which precedes a finned belt-backup roller 126 is equipped with a header 101 extending transversely of the chassis frame. This header 101 is supplied with a flow 93 of pumped coolant and includes numerous coolant discharge nozzles 103 (only one is seen in FIG. 4A) aiming jets 105 of coolant toward a downstream-directed coolant applicator surface 107 on this deflector and coolant applicator scoop 123. Such a deflector and applicator scoop 123 with a header 101, discharge nozzles 103 and an applicator surface 107 is known in the art. Immediately downstream of the coolant applicator surface 107 in FIG. 4A is shown a finned belt-backup roller 126 such as is known in the art.

In the embodiment of the invention shown in FIG. 9, in both the lower and upper belt carriages L and U there is a first sequence of finned belt-backup rollers 126 positioned downstream from a first deflector and applicator scoop 123, which is positioned immediately downstream from a nose array 51*n*. Then, in both carriages there is a second deflector and applicator scoop 123 followed by a second sequence of finned belt-backup rollers 126. One or more of these finned belt-backup rollers 126 may be resiliently mounted and/or bowable and may be adjustable toward and away from the mold cavity C as is shown in U.S. Pat. Nos. 4,552,201; 4,671,341; 4,658,883; and 4,674,558 of Hazelett and Wood.

In the embodiment of the invention shown in FIG. 10, the upper carriage of a twin-belt caster 36 is equipped similar to the upper carriage of the twin-belt caster 36 shown in FIG. 9, namely, there are two sequences of finned belt-backup rollers each preceded by a deflector and applicator scoop 123. In FIG. 10, the lower carriage has two non-magnetic arrays 53 of hydrodynamic devices which are like the arrays 51 of hydro-magnetic devices 38 shown in FIGS. 2, 3, 3A, 4, 4A, 5 and 6, except that the permanent magnets 32 are omitted from the non-magnetic arrays 53. These arrays 53 are preceded by deflector scoops 122 configured like the deflector scoop 122 shown in FIG. 4.

Figure 4B:
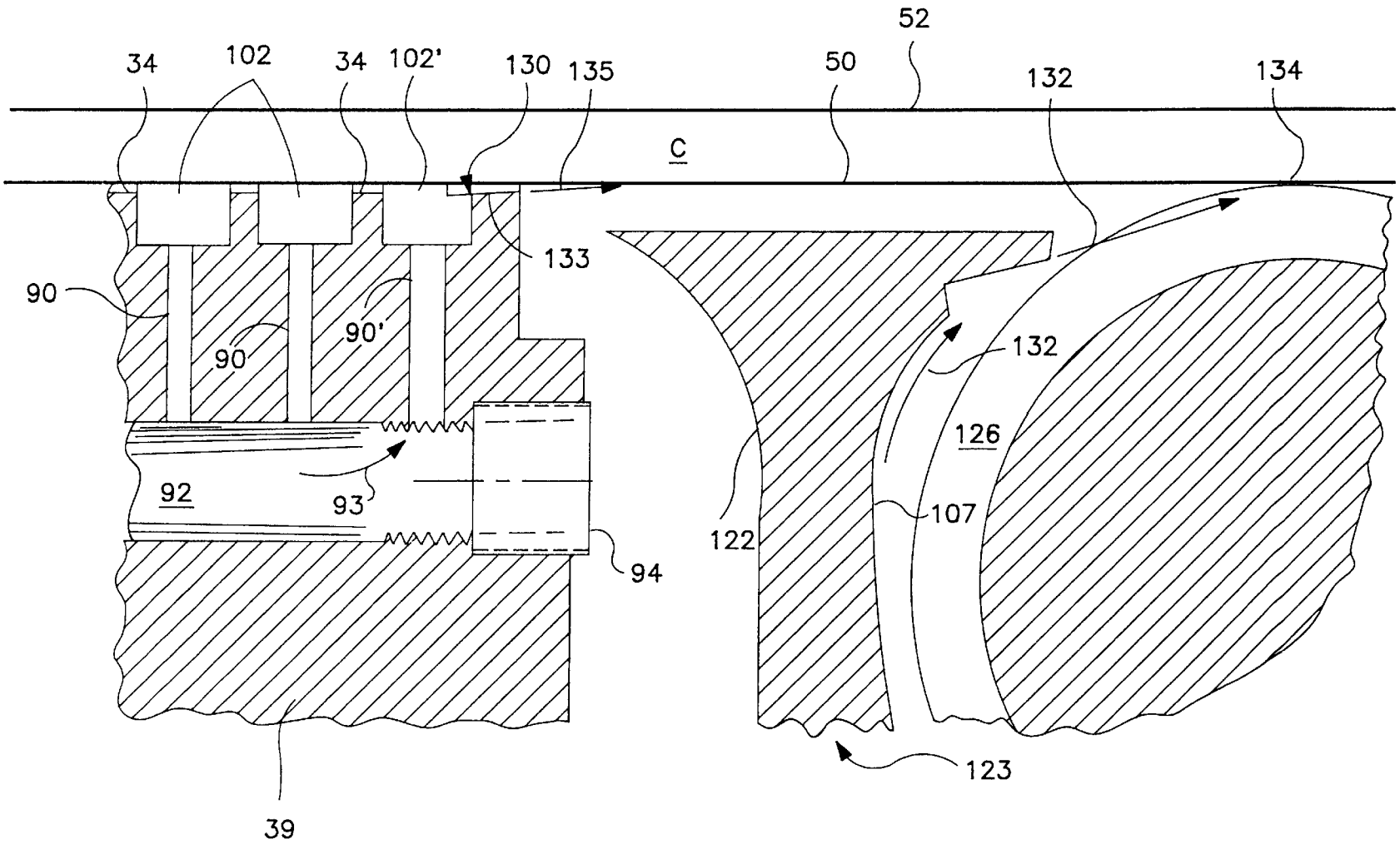
FIG. 4B shows an enlargement of a portion of FIG. 4A for illustrating a modified embodiment of the invention including a flat, downstream-aimed, "afterburner" coolant sweep nozzle.
Figure 4C:
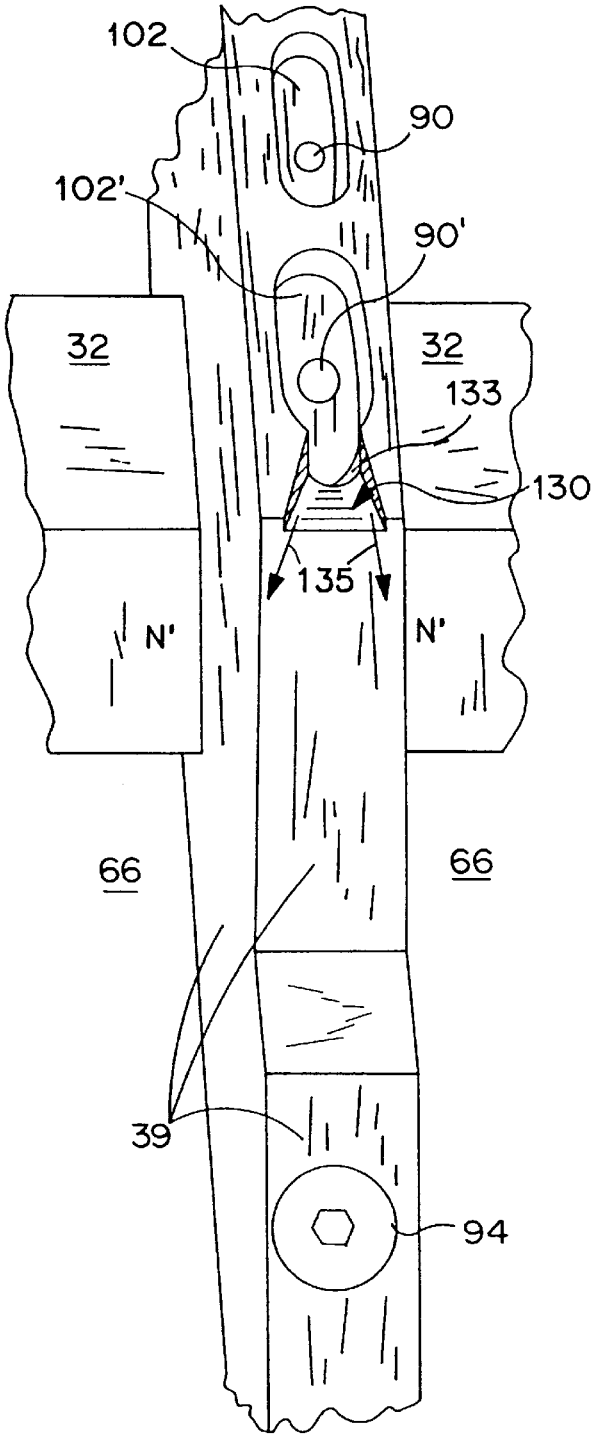
FIG. 4C is an enlargement of a portion of FIG. 2 for showing the "afterburner" sweep nozzle seen in FIG. 4B.

Depending on the quantity of sweep coolant 115 used, it may be desirable to employ an integral, flat, liquid-coolant nozzle or "afterburner" nozzle 130 (FIGS. 4B, 4C) pointing downstream from the downstream end of each magnetic pole member 39 and being an integral part thereof. This aft nozzle 130 covers the area of the casting belt 50 or 52 which lies between the last pressure pocket 102' and the coolant-belt-strike region of the coolant 132 coming from the applicator scoop 123 after it leaves the deflector 107. This strike region 134 (see also FIG. 4A) of the coolant 132 as shown is approximately where a first backup-roller fin 126 is shown touching the belt 50. The afterburner nozzle 130 is shown in FIG. 4B which is an enlarged part of FIG. 4A, and in FIG. 4C which is an enlarged part of FIG. 2 in which the lower casting belt 50 is removed for clarity of illustration. Aft nozzle 130 replaces the area of the downstream sharp prow 120 (FIGS. 2 and 3). The last (most downstream) pressure pocket, the one farthest to the right in FIG. 4B, is designated 102' because it is different from the other pressure pockets 102, since nozzle 130 is connected into nozzle 102' and is fed liquid coolant by it. The throttling passage 90' feeding into pressure pocket 102' differs from other throttling feeders 90 in being of substantially larger diameter, for example being about 3/16 of an inch in diameter. One flat side of each aft nozzle 130 is defined by the reverse surface of casting belt 50 or 52. The other flat side is defined by a converging platform-like ledge surface 133 formed on the aft end of pole member 39. The nozzle 130 is shown in FIG. 4B in longitudinal cross section and in FIG. 4C in an oblique view from above. The diverging downstream sweeping flow of coolant issuing from nozzle 130 is indicated by arrows 135 (FIGS. 4B and 4C). Instead of nozzle 130 any of several devices to eject liquid coolant downstream may be employed, for example, internal passages may be provided in pole members, such passages emptying at the sides of the pole members and pointing generally downstream. Alternatively, tubes or orifices and/or deflectors can be placed between the pole members in spaces 66 for dispatching liquid coolant downstream.

A magnet-rotating device 145 may be provided as shown in FIG. 11 to reduce the powerful reach-out attraction pull of the magnetic circuits 30 on a casting belt 50 for permitting installing or removing thin-gauge, flexible casting belts without damaging them. This device 145 has an elongated circular cylindrical rotor 147 mounted on bearings 148 (FIG. 12) and is shown extending longitudinally of a belt carriage, being oriented parallel with pole members 39 and positioned midway between them. The cylindrical rotor 147 has an axially split case 146 formed in two halves of magnetically soft ferromagnetic stainless steel, for example such as type 430 stainless steel. This rotor contains a plurality of magnets 32 (FIG. 12) whose internal magnetic flux path S'-N' is oriented parallel with a diametral plane 149 passing through the axis 151 of rotation of rotor 147. The rotor case 146 has flattened sides 155 which are parallel with diametral plane 149 for effectively forming north and south poles N' and S' on the rotor case. Mounted closely adjacent to the rotor 147 are intermediate bridging members 154 of magnetically soft ferromagnetic material, for example such as type 430 stainless steel. These bridging members 154 have cylindrically concave surfaces 153 facing toward and closely spaced from the cylindrical rotor 147.

The rotor 147 in FIGS. 11 and 12 is shown in its "off" position wherein magnetic circuits generally similar to those shown at 30 in FIG. 6 are effectively broken so that magnetic flux from the magnets 32 in FIG. 11 is diverted away from pole faces 34. This diverted flux primarily shunts from N' to S' by passing through the magnetic bridging members 154 in directions generally parallel with diametral plane 149 of the rotor. In this "off" position the diametral plane 149 and the rotor's flattened sides 155 are oriented parallel with side surface of the pole members 39. Thus, a greatly reduced amount of magnetic flux reaches pole faces 34. Consequently, there is greatly reduced attraction for the belt 50 so that it can be installed or removed without damage to it. Upper and lower support members 156 and 158 are non-magnetic, for example being made of austenitic stainless steel, Type 303.

For turning "on" the magnet-rotating device 145, its rotor 147 is turned 90° around its axis 151 so that its diametral plane 149 is aimed directly at central regions of the concave faces 153 of bridging members 154. Thus, the magnets' North and South poles N' and S' are closely linked magnetically by corresponding N' and S' poles on their case 146 for closely linking to these bridging members 154 for completing a magnetic circuit in the array shown in FIG. 11. This "on" magnetic circuit in FIG. 11 can be envisioned extending from a magnet north pole N' through an N' pole of rotor case 146, through a first bridging member 154, through a first pole member 39 to a first pole face 34, across a first gap 75 into the belt 50, extending within the belt to and then across a second gap 75 into a second pole face 34, through a second pole member 39 to a second bridging member 154 and through an S' pole of rotor case 146 to a magnet South pole S', with the magnetic circuit being completed internally within each magnet from S' to N'.

For turning rotor 147 through 90° to its "on" position, its case 146 is shown provided with trunnions 152 (FIG. 12) journaled in bearings 148 mounted on support members 156, 158 and having a clevis arm 162 affixed to a trunnion and pivotally connected at 161 to a piston rod 163 connected to a piston 165 in a hydraulic cylinder 160. A return spring 166 biases the piston to the "off" position of the magnet-rotating device 145. The "on" position of the rotor clevis arm 162 is shown in dashed outline 162' in FIG. 11. Cylinder 160 has its piston chamber 167 connected by a hose 164 to a coolant supply tube 98. Thus, whenever pumped coolant is supplied through a header 100, the coolant enters chamber 167 and raises piston 165 against biasing force of spring 166 for turning the rotor 147 to its "on" position. As soon as coolant pressure is turned off, the spring 166 turns to "off" position the magnet-rotating device 145.

Instead of using individual hydraulic cylinders 160, for operating each rotor 147, the clevis arms 162 of all magnetic-rotating devices 145 in an array 51 may be pivotally connected to a common actuator rod which extends out of the array 51 and is operated manually or hydraulically for simultaneously turning all rotors 147 to their "on" or "off" positions.

FIGS. 13 and 14 show an alternative mechanism for turning the magnetic circuits "on" or "off" employing a longitudinally movable shunt bar 170 of magnetically soft ferromagnetic material, for example such as type 430 stainless steel. This shunt bar 170 is slidable adjacent to magnetic pole members 39 from its "off" position shown in FIG. 13 to its "on" position in FIG. 14. This shunt bar is castellated for providing a plurality of mesa-like protrusions 172 with intervening grooves 174. These mesas are longitudinally spaced along bar 170 at center-to-center spacing equal to twice the center-to-center spacing "d" of the magnetic pole members 39. These mesas 172 and their intervening grooves 174 each extend about the same distance "d" along the shunt bar. Thus, as shown in FIG. 13 in the "off" position, each mesa 172 is directly adjacent to, i.e., is directly engaged with, two pole members 39 of opposite polarity, thereby bridging directly from a center of an N pole member 39 to a center of a neighboring S pole member for shunting magnetic flux being diverted away from pole faces 34. Conversely, in the "on" position all mesas 172 are directly adjacent to (engaged with) pole members 39 of the same polarity (for example N) with intervening grooves 174 all facing but spaced away from pole members of the same polarity (for example S) which is opposite to polarity of pole members engaged by the mesas. Thus, only minimal shunting occurs, and magnetic circuits 30 (FIG. 6) are completed as described previously.

In embodiments of the invention as shown, the elongated pole members 39 are mounted in an upstream-downstream orientation 61, because this longitudinal upstream-downstream orientation is convenient for twin-belt casters. In our view, there may be configurations of moving-casting-belt continuous casting machines in which it is convenient for transversely mounting elongated pole members 39 incorporating their numerous specially-designed nozzles 90, 102 and their sweep nozzles 112, 116 for propelling coolant flow 115 transversely across rear surfaces of a moving casting belt.

Also, it is noted that the elongated pole members 39 may be longitudinally contoured with their pole faces 34 being longitudinally curved to fit special continuous casting circumstances for instance in a one-belt continuous casting machine wherein the path of the single casting belt normally follows a gently curving arc of relatively long radius. The pole faces 34 in such a machine having a longitudinally curved casting cavity would curve longitudinally in a gently curving arc corresponding to the gentle arc of the moving casting belt for hydro-magnetically stabilizing the moving belt in its desired arcuate path. Such longitudinally curved pole faces are considered to be coplanar since they stabilize the moving casting belt in an even condition.

Also, in a continuous casting machine wherein one or a pair of casting belts are moving along a straight path, the pole faces 34 may be straight in a longitudinal direction along the casting path, but an array of the pole faces may be gently bowed transversely of the straight path for gently bowing a casting belt transversely as it moves along the casting path. Such a transversely bowed array of pole faces is considered to be a coplanar array since they stabilize the moving casting belt in an even condition.

The result of these embodiments of the present invention is that a moving casting belt is forcibly held in an even condition within narrow limits of evenness (flatness) and within narrow limits of standoff (gap 75) distance from pole faces 34 of its hydrodynamic support arrays 51 or 51*n* of hydro-magnetic devices 38.

We envision that any permanent magnets 32 made of permanent magnetic material exhibiting the very important critical characteristics described above are capable of successful performance in these disclosed embodiments of the invention. We prefer to use magnets 32 containing permanent magnetic materials commercially known as rare earth magnetic materials for example such as magnets comprising magnetic materials including at least one of the "rare earth" chemical elements (lanthanide family series of chemical elements numbered 57 to 71), for example magnets preferably containing permanent magnetic materials comprising the rare earth chemical elements neodymium or samarium. For example, magnets containing a permanent magnetic material comprising a compound of cobalt and samarium ($Co_5Sm$) having a maximum energy product of about 20 MGOe (Mega-Gauss-Oersteds) may be used since its B—H hysteresis loop has a residual induction $B_r$ of about 9,000 gauss, and magnets containing $Co_{17}Sm_2$ material having a maximum energy product in a range of about 22 to about 28 MGOe may be used for its B—H loop has a residual induction $B_r$ in a range of about 9,000 gauss to about 11,000 gauss.

$Co_5Sm$ permanent magnetic material having a maximum energy product of about 20 MGOe has a midpoint differential demagnetizing permeability of about 1.08. $Co_{17}Sm_2$ permanent magnetic materials having maximum energy products in a range of about 22 to about 28 MGOe have a midpoint differential demagnetizing permeability in a range of about 1.15 to about 1.0.

Our presently most preferred permanent magnets 32 contain a permanent magnetic material based on a tri-element (ternary) compound of iron, neodymium, and boron known generically as neodymium-iron-boron, Nd—Fe—B or NdFeB, which exhibits a maximum energy product in a range of about 25 to about 35 MGOe. Such magnets may be called "neo magnets", with about 32 to about 35 MGOe neo magnets presently being most preferred. NdFeB permanent magnetic material having a maximum energy product in the range of about 25 to about 35 MGOe have a B—H loop with a residual induction $B_r$ in a range of about 10,700 Gauss to about 12,300 Gauss and have a midpoint differential demagnetizing permeability of about 1.15. Neo magnets do have a low resistance to corrosion and so they are nickel-plated.

We envision that in the future other permanent magnetic materials for example ternary compounds such as iron-samarium-nitride and other as yet unknown ternary compound permanent magnetic materials and as yet unknown four-element (quaternary) permanent magnetic materials may become commercially available and may have B—H loops with a residual induction $B_r$ sufficiently high as shown in Table I and also may exhibit midpoint differential demagnetizing permeability sufficiently low to be suitable as shown in Table II for use in embodiments of this invention.

Figure 15:
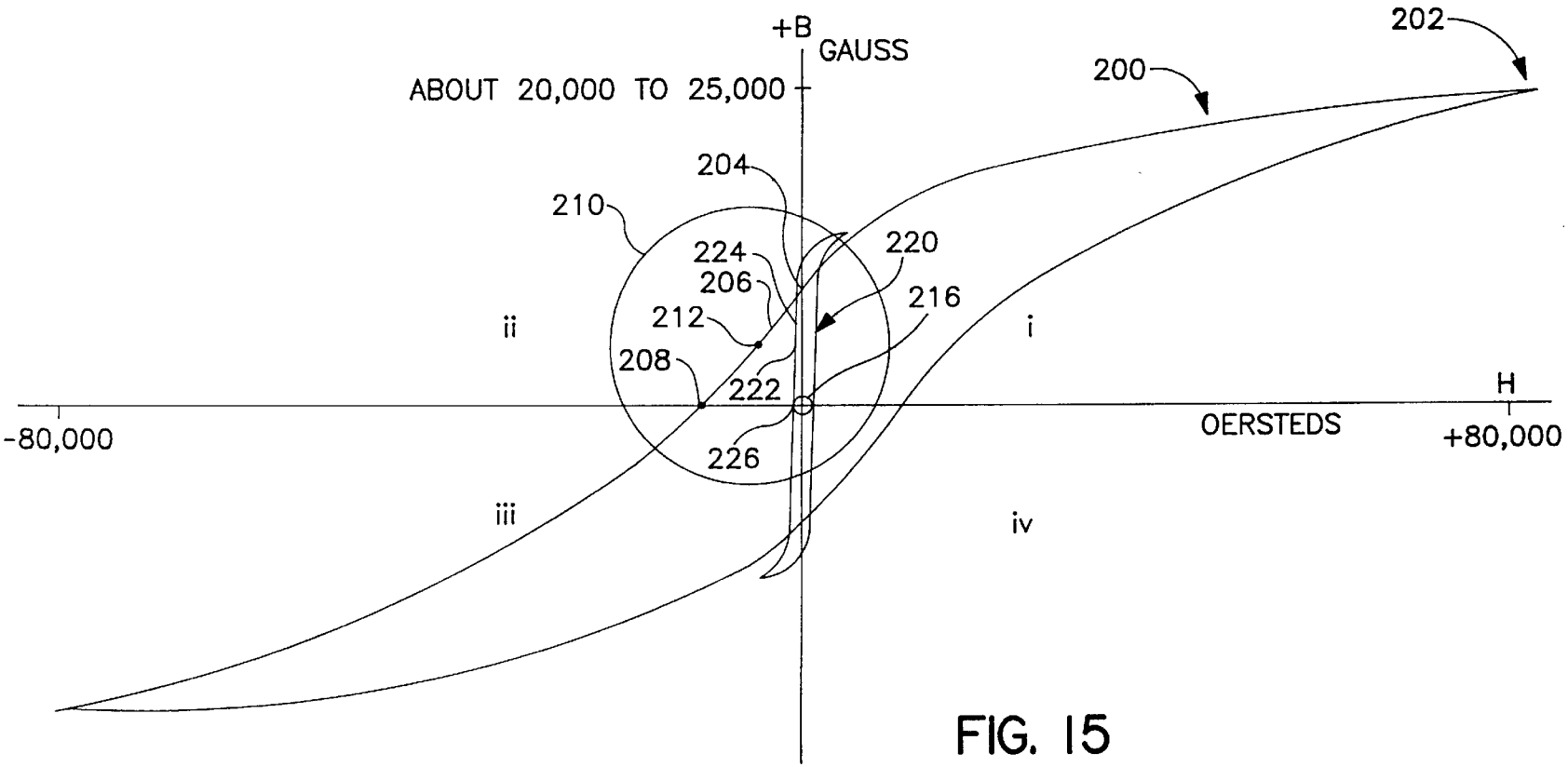
FIG. 15 shows hysteresis loops of two different permanent magnetic materials: alnico 5 and a most preferred permanent magnetic material described in detail later and which we employ in permanent magnets used in the most preferred embodiments of the invention as described.

In FIG. 15 is shown an approximate generalized B—H loop 200 for NdFeB permanent magnetic material having a maximum energy product of about 35 MGOe. The B and H axes cross at origin 216. This "neo magnet" material exhibits a saturation magnetization as shown generally at 202 in a range of about 20,000 to about 25,000 Gauss. This B—H curve 200 is shown crossing the positive B axis at a point 204 where there is residual induction $B_r$ of about 12,000 to about 12,300 Gauss. The portion of loop 200 in the second quadrant ii (the demagnetizing quadrant) advantageously is essentially a straight line 206 sloping down to a point 208 on the horizontal H axis having a value of about −11,000 Oersted. A negative sign for Oersteds left of the B axis indicates a coercive force H acting in an opposite direction from the original coercive force which produced the initial magnetic saturation at 202. A circle 210. indicates that performance of the portion 206 of loop 200 in the demagnetizing second quadrant ii is the region of present interest. At a midpoint 212 on this essentially straight demagnetizing portion 206 of the curve 200 a multiplication of a plotted flux density value of about 7,000 Gauss times a plotted coercive value of about 5,000 Oersteds gives a maximum energy product of about 35,000,000 Gauss Oersteds, i.e., about 35 Mega-Gauss-Oersteds (about 35 MGOe).

At the midpoint 212 is determined the midpoint differential demagnetizing permeability, which is the slope of a straight line tangent to the 206 portion of the B—H loop 200 at midpoint 212, which is about 1.15. In summary, this permanent magnetic "neo magnet" material has (1) a residual induction $B_r$ of about 12,000 to about 12,300 gauss and also has (2) a mean differential demagnetizing permeability of about 1.15, thereby providing powerful advantageous reach-out attraction force as described.

Also shown in FIG. 15 is an approximate generalized B—H loop 220 for alnico 5 having saturation magnetization. This alnico 5 loop crosses the B axis where there is a residual induction $B_r$ of about 12,800 Gauss as measured from the alnico 5 hysteresis loop in FIG. 6–3 of Lester R. Moskowitz's above-identified Handbook. However, the alnico 5 curve 220 has a saturation magnetization not much higher than about 15,000 Gauss. In the second quadrant ii the demagnetizing curve 222 for alnico 5 drops almost vertically and crosses the H axis at 226 at less than about 1,000 Oersteds. Thus, alnico 5 has a maximum energy product of less than about 7 MGOe. In addition to its relatively low maximum energy product, the steep dropoff of alnico 5's demagnetization curve 222 indicates a midpoint differential demagnetizing permeability at midpoint 224 of about 30, which renders alnico 5 unsuitable for use in magnets in embodiments of the present invention, as explained above.

Figure 7:
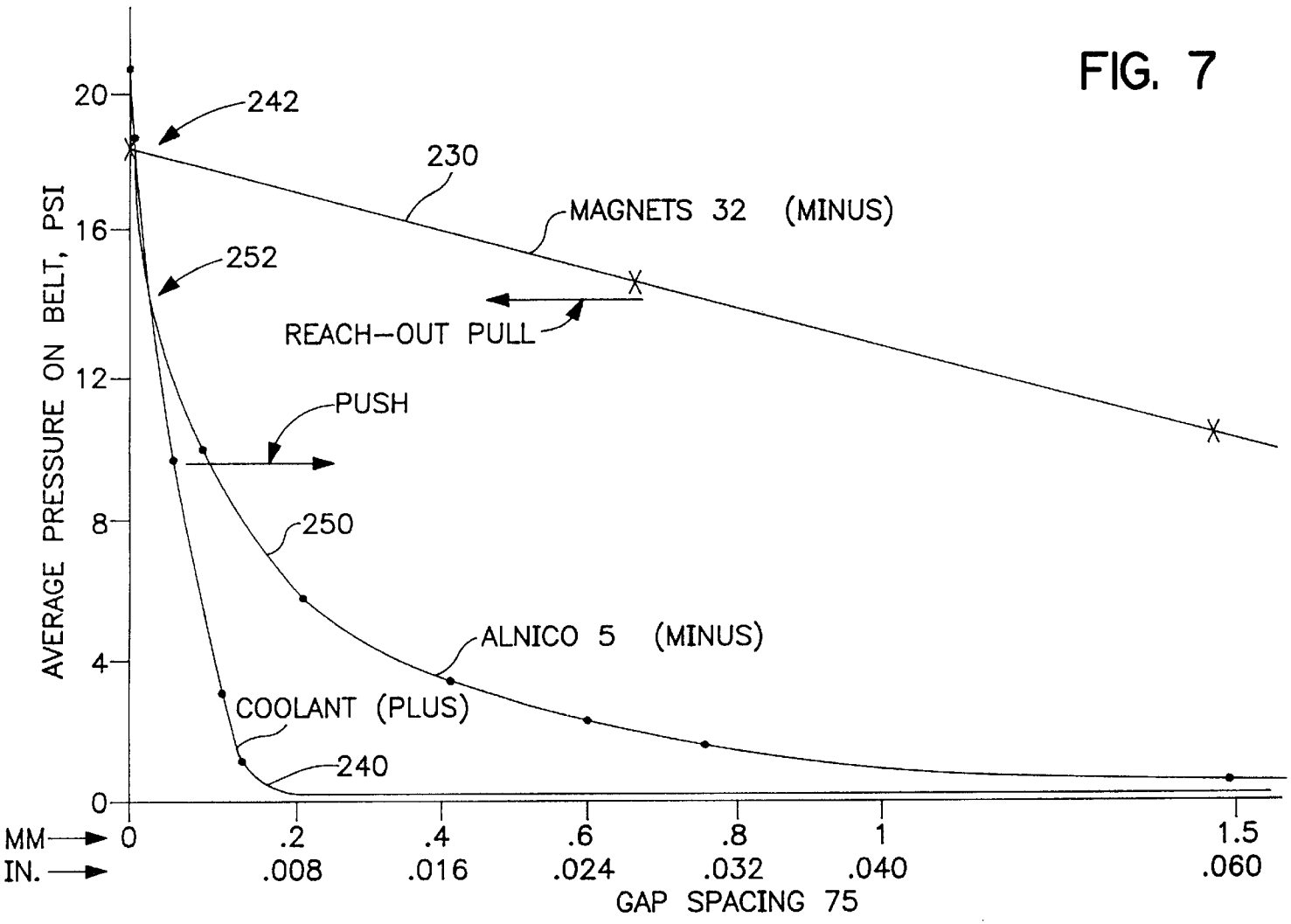
FIG. 7 shows plots illustrating equilibrium balancing or stabilization of a moving casting belt as a function of gap spacings between the moving casting belt and the magnet-nozzle pole faces (rims of the coolant pressure pockets). In other words.
Figure 7A:
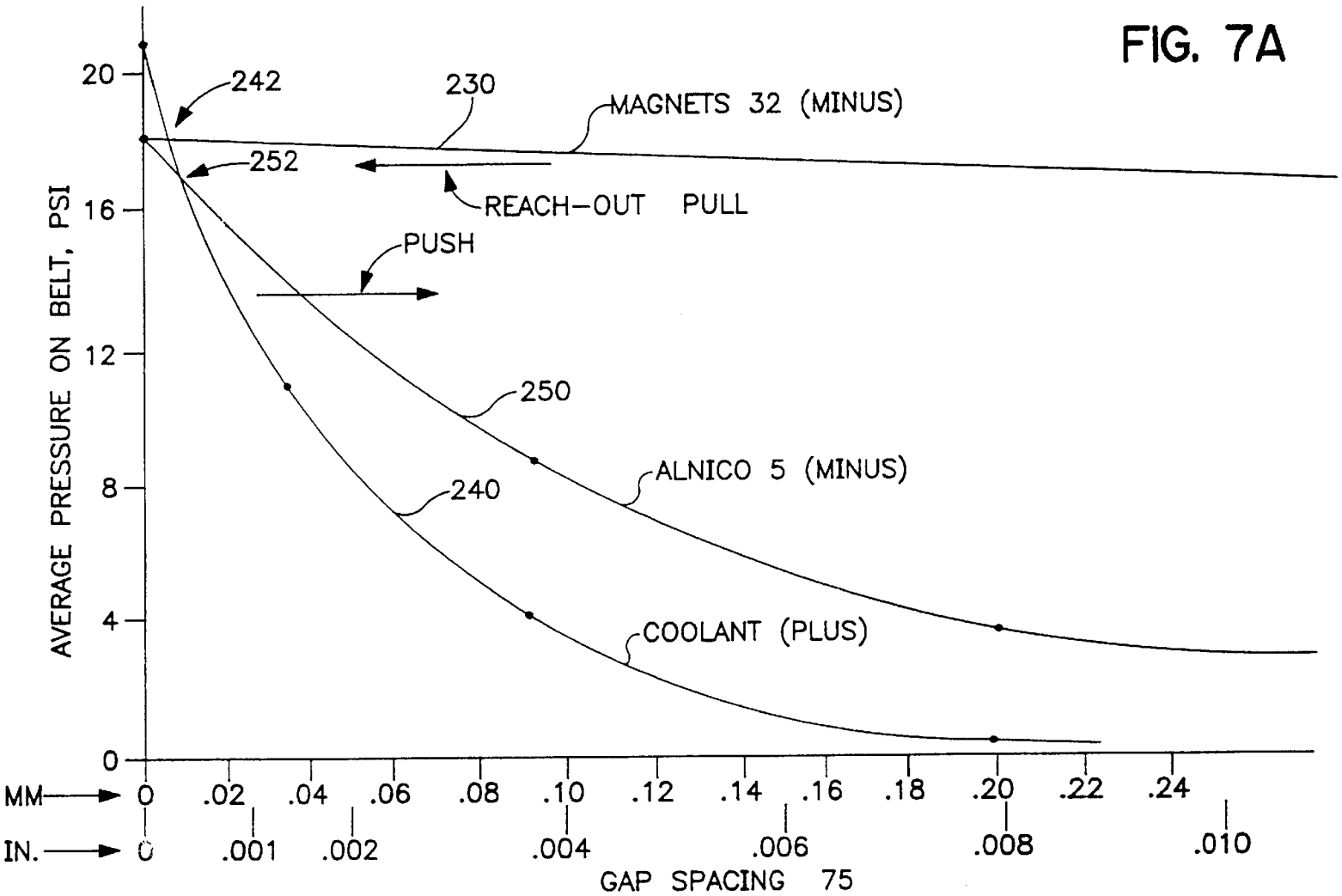
FIG. 7A is like the left portion of FIG. 7 but with the horizontal scale expanded about 6 to 1.
Figure 7A:
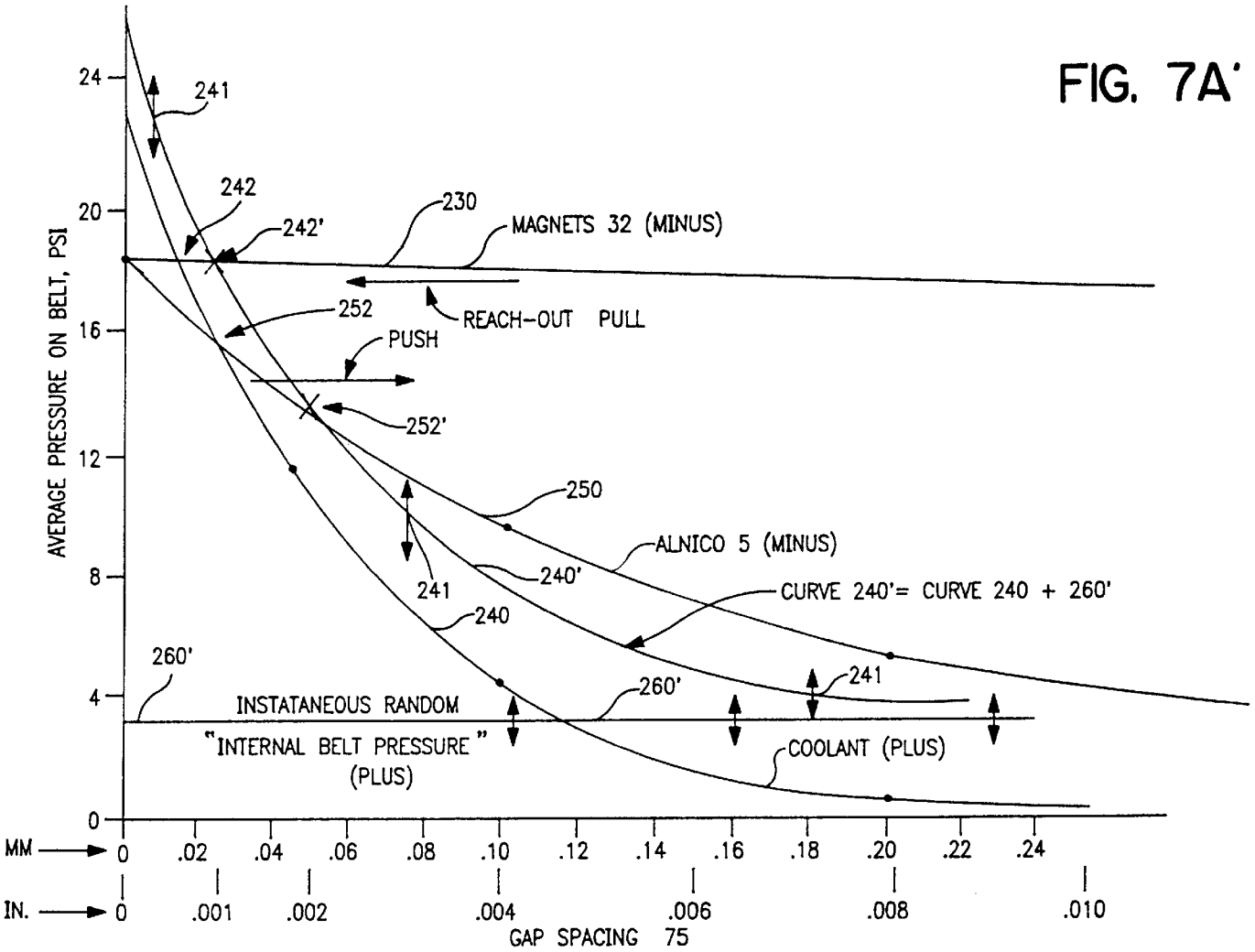

In FIGS. 7 and 7A is shown a straight line 230 which generally represents a gradual decrease in reach-out attraction force (pull on the belt) of pole faces 34 attracting a moving casting belt such as the belt 50 plotted as a function of increasing gap spacing 75 using magnets 32 made of permanent magnetic material "neo magnets" having the most preferred characteristics, for example having a maximum energy product of 35 MGOe. Increasing gap spacing 75 causes an increasing equivalence of demagnetizing coercivity to be experienced by the permanent magnets 32, and thus the attraction force decreases along a generally straight line 230 having a characteristic similar to the straight-line portion 206 of B—H loop 200 in FIG. 15.

Gap spacings 75 in inches and millimeters are shown along the horizontal axis and average pull forces (minus for magnetic attraction) on the belt and average push forces (plus for coolant repulsive effects) are shown along the vertical axis. Average pull forces and average push forces in p.s.i. on a casting belt are difficult to measure, and so these values along the vertical axis are only approximate; however, their relative values are generally proportioned appropriately, and it is their relative values which are significant.

Also shown in FIGS. 7 and 7A is a steeply falling curve 240 plotted as a function of gap spacings 75 which generally represents the steeply decreasing repulsive hydrodynamic forces (push on the belt) of coolant flows 97 (FIG. 6) issuing from pressure pockets 102 and fast-travelling coolant films 114 radiating from such pockets and passing through gaps 75. Assuming that an appropriate coolant pumping pressure is being supplied in header 100, then increasing the diameter of throttling orifices 90 serves to increase the flow 97 (FIG. 6) and to increase thickness of films 114, thereby increasing gap spacing 75 and causing the curve 240 to shift over somewhat to the right and also causing the curve 240 to become slightly less steep, and such result may be considered as causing the repulsive coolant pillow effect to become slightly more "springy".

An equilibrium-stabilized state for the moving casting belt occurs under a condition generally indicated at 242 in FIGS. 7 and 7A where the two curves 230 and 240 cross each other. This curve-crossing point 242 is the situation in which no randomly-varying, thermal expansion belt-distorting forces (hereinafter considered as acting similar to "internal belt pressures" are present such as those due to thermally induced expansion forces arising in the belt under the influence of hot metal within the mold cavity C while the reverse surface of the belt is cooled.

Although the word "force" would appear to be more natural than "pressure " in describing belt dynamics in reference to FIGS. 7, 7A, 7A' and 7A", we perceive that thermal dynamics produce pressure-like effects acting within localized areas of the casting belt. This pressure-like effect of internal thermal distortion forces is the meaning of the word "pressure" in the following discussion, not the larger pressure of coolant applied to the belt by pressure pockets 102 when the belt is in an equilibrium-stabilized state. Rapidly shifting destabilizing internal belt pressures that are always present during the casting of metal, yet are hardly quantifiable, may conveniently be represented in one's imagination as a random and continuous frenetically vertical shifting horizontal line 260' and 260" shown plotted respectively in FIGS. 7A' and 7A". FIG. 7A' shows the situation during an instant of moderate internal belt pressure (equivalent to about 3 psi pressure) indicated by a plotted level of horizontal line 260'. FIG. 7A" shows the situation during an instant of higher internal belt pressure plotted by a horizontal line 260" (equivalent to about 5.5 psi pressure).

To determine whether a given combination of circumstances will float the belt hovering securely and accurately, an analyst needs to plot all the forces, actual coolant pressures applied to the belt and internal belt pressures involved. In FIGS. 7 and 7A there is a plot of coolant pressure but no plot of random internal belt pressure. However, during operation in general as illustrated in FIG. 7A', there are two repulsive pressures: not only (i) that pressure due to coolant flows 97 and films 114 (per curve 240 in FIGS. 7 and 7A) but also (ii) that addition due to an instantaneous random internal belt pressure 260' plotted as being equivalent to about 3 psi in FIG. 7A'. These two curves 240 and 260' add up in FIG. 7A' to make a new curve 240', which is a total repulsive (push) pressure which is acting against the magnetic force (pull pressure) curve 230. We may imagine this summed curve 240' as continuously, frenetically and randomly varying up and down as indicated by arrows 241. In FIG. 7A' the resultant new instantaneous equilibrium crossing point 242' between reach-out magnet pull curve 230 and resultant push curve 240' is shifted somewhat to the right of the location where point 242 was plotted in FIG. 7A, yet the magnetically induced pull pressure of the reach-out magnets 32 is diminished only by a very small percentage, and so reach out magnetic attraction remains securely forcibly in control of a stabilized belt.

By contrast, in considering alnico 5 magnet curve 250, it is seen that the instantaneous equilibrium crossing point between this curve 250 and resultant push curve 240' is moved from location 252 in FIG. 7A relatively far to the right to a crossing point at 252'. Thus the magnetic pull pressure represented by alnico 5 curve 250 is reduced by about 33%. The frenetic changes in random internal belt pressure 260' (FIG. 7A') and 260" (FIG. 7A") are continually moving the equilibrium crossing points to new positions.

The situation becomes critical for magnet curve 250 but not for reach-out magnet curve 230 when the assumed instantaneous random internal belt pressure increases equivalent to about 5.5 psi as plotted by horizontal line 260" in FIG. 7A". The reach-out magnetic equilibrium crossing point 242" plotted on curve 230 represents only a small additional move to the right wherein reach-out pull is reduced slightly further by an additional very small percentage. But for alnico 5 magnets the indeterminate crossing points 252" on the alnico 5 curve 250 represent a reduction of magnetically induced pull pressure to less than about half of what it was before the instantaneous random internal belt pressure 260" occurred. The gap 75 is substantially increased to about 0.10 to 0.12 mm. Moreover, the -equilibrium position 252" is no longer a definite crossing point but rather is a zone of indeterminacy, since the encounter of the two curves 250 and 240" is not a determinate large angle as advantageously is provided by reach-out magnet curve 230 but instead is a sharply acute angle (between almost parallel curves 250 and 240") which makes an equilibrium position relatively indeterminate. In this particular case the curves 240" and 250 converge in almost parallel relationship for a substantial distance such that the secure forcible stabilizing capture of the belt has almost disappeared. Any random destabilizing internal belt pressure significantly higher than plotted at 260" would unconditionally overcome the magnetic force represented by alnico 5 curve 250 and would set the belt free from control by magnetic pole members 39 if alnico 5 magnets were attempted to be used.

This critically different behavior between reach-out magnet pull curve 230 in FIGS. 7 and 7A and the alnico 5 pull curve 250 occurs because the reach-out attraction (pull) curve 230 crosses the hydrodynamic coolant (push) curve 240 more nearly perpendicular than parallel. On the other hand, the alnico 5 attraction (pull) curve 250 crosses the hydrodynamic coolant (push) curve more nearly parallel than perpendicular. Thus, a thermal distortion displacement of a portion of a moving casting belt causing a gap spacing as little as about 0.2 mm would likely cause loss of stabilization control of the moving casting belt by alnico 5 magnets in dealing with random destabilizing forces. In contrast, a most preferred reach-out attraction force (pull) represented by line 230 falls off less than about 50% at a gap spacing even so large as 1.5 mm (about 0.06 of an inch) in FIG. 7, and thus a reach-out pull as represented by the curve 230 forcibly is most unlikely to lose stabilization control.

ADDENDUM

DETAILED DESCRIPTION OF THE ADDED EMBODIMENT

An alternative configuration of hydro-magnetic devices 38A in an embodiment of the present invention enables rotatable permanent magnets 32 to be placed in the grooves 127 between the fins 128 of each nip pulley 60 and 56. Hence, reach-out magnets 32 with their associated modified elongated pole members 39A are positioned all the way upstream to the nip region line 110. This upstream positioning of magnets 32 with their modified pole members 39A thereby provides a coplanar array 51 of spaced parallel magnetic pole faces 34 extending all of the way upstream to the nip region line 110. Thus, full reach-out magnetic attraction from a coplanar array of spaced, parallel pole faces 34 is made available to stabilize the ferrous casting belts 50 and 52 in the upstream area near to the entrance 49 (FIG. 1) of molten metal 37 into the moving mold cavity C. This upstream area of the moving mold cavity near nip region line 110 involves the zone of initial solidification of skins of frozen metal adjacent to the two revolving casting belts 52 and 50, a zone which is most critical in the casting of quality metallic product P (FIG. 1).

Figure 16:
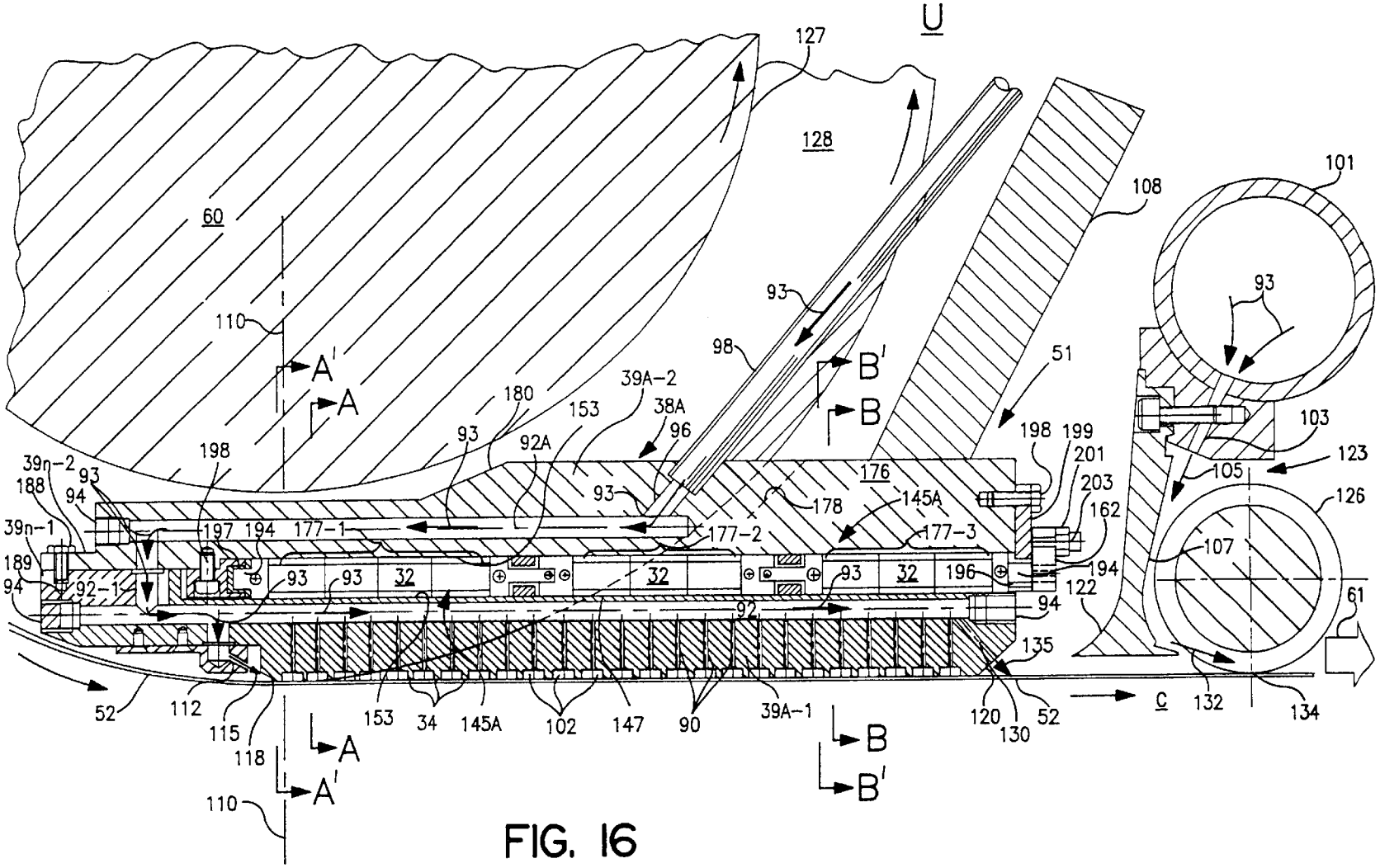
FIG. 16 is an elevational longitudinal sectional view as seen from the outboard side of the machine showing an alternate hydro-magnetic device or sub-assembly in a hydro-magnetic pillow array. This hydro-magnetic device is shown surrounded by other elements of the upper carriage of a belt-type casting machine such as shown in FIG. 1.

Referring mainly to FIG. 16, reach-out magnets 32 are shown positioned in interposed relationship between fins 128 of upstream nip pulley 60. The upstream end 118 of pole faces 34 of a modified elongated pole member 39A is shown positioned at the nip region line 110. This line 110 is the location of tangency of the casting belt 52 as it departs from nip pulley fins 128 and becomes planar (even) travelling downstream along the moving casting cavity C.

Figure 17:
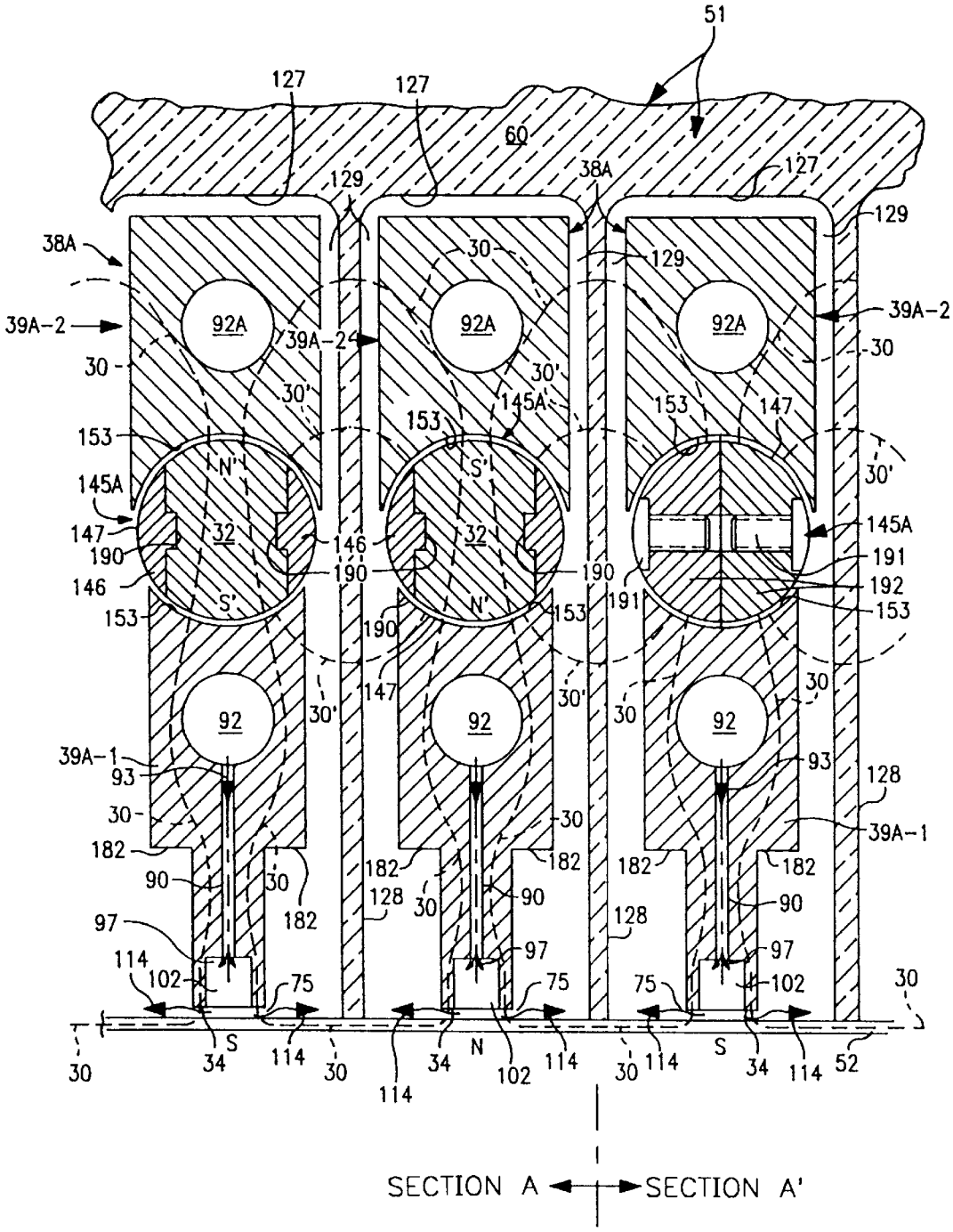
FIG. 17 is an enlarged partial sectional view showing a plurality of magnetic circuits according to the present alternative construction, with thin, fast-travelling coolant films passing through gaps between pole faces and the reverse surface of a moving casting belt. The left portion of this view is as indicated by A—A in FIGS. 16 and 19. The right portion of FIG. 17 is taken along A'—A'. The relative thickness of the coolant-film gap is here exaggerated for clarity of illustration.

In the construction shown in FIGS. 11 and 12, the rotatable magnets 32 were positioned downstream in alignment with the pulley fins 128 and did not extend upstream into interposed relationship between the fins. In the construction as shown in FIGS. 16–19 all elements of each modified pole member 39A (including their magnets) are made to fit within the width of one pulley groove 127 (FIG. 17). The center-to-center uniform spacing of the fins 128 in this embodiment as shown in FIGS. 16 to 19 is about one inch (about 25 millimeters), and the fin thickness is about ⅛ of an inch (about 3.2 mm) with a groove width of about ⅞ of an inch (about 22 mm). Thus, all elements of a modified pole member 39A are made sufficiently narrow to fit within a width of less than about ⅞ of an inch (less than about 22 mm). Thus, also, these modified elongated pole members 39A are positioned at center-to-center parallel spacings of about one inch (about 25 mm) across the hydro-magnetic pillow array 51.

Figure 19:
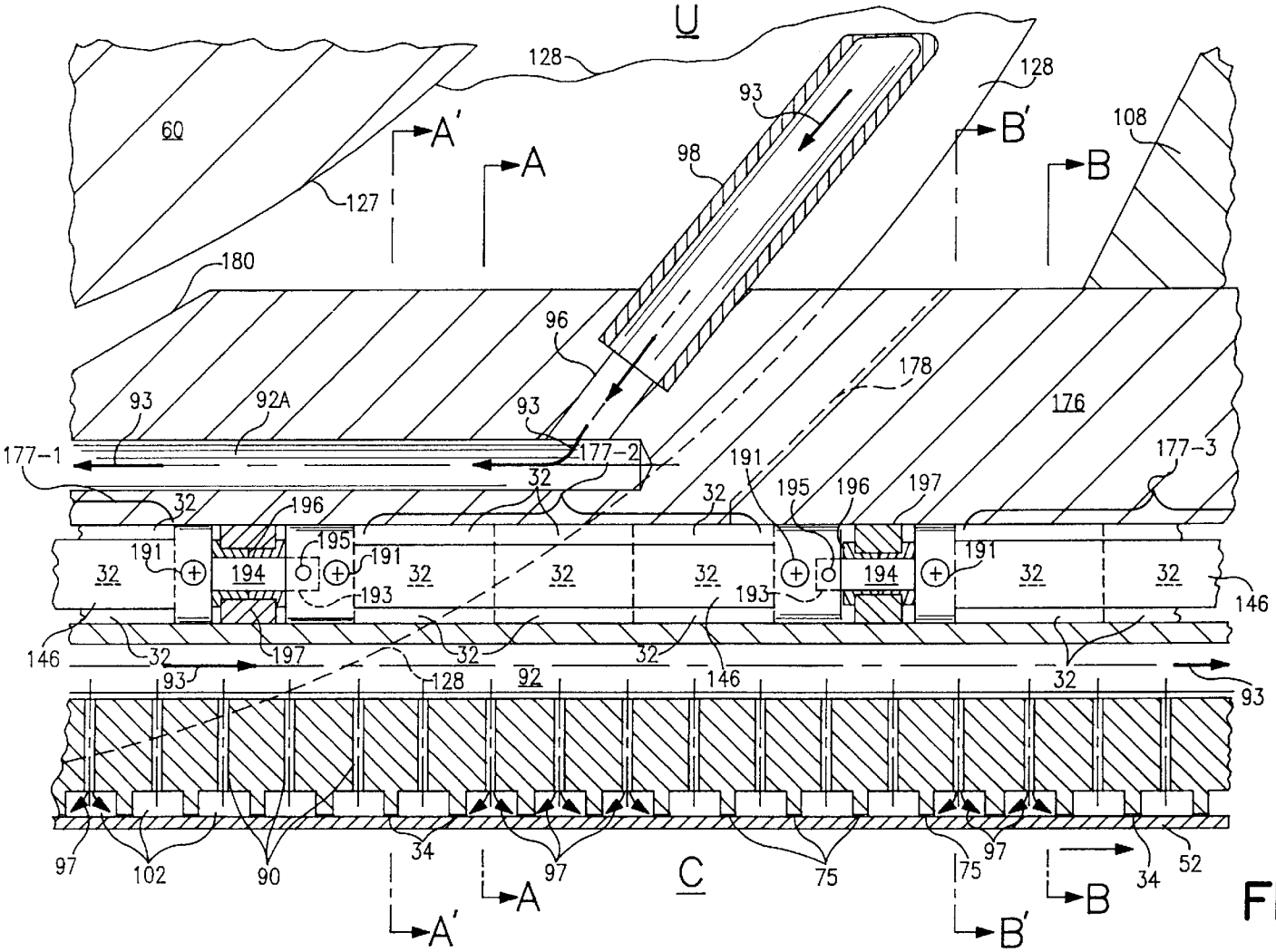
FIG. 19 is an enlarged portion of FIG. 16, showing particularly the pattern of assembly of the rotatable magnets.

The nip pulley 60 is shown having a solid central core with its fins integrally machined from this core, as is shown clearly in FIGS. 16, 17 and 19. This nip pulley 60 with its fins 128 is made of nonmagnetic stainless steel, for example such as Type 316 forged stainless steel, a non-magnetic material which has practically no effect on the magnetic situation.

Referring now also to FIG. 17 and looking downstream, it is seen that rotatable magnets 32 are placed between pulley fins 128. In FIG. 17 (and also in FIGS. 16, 18 and 19) the magnets 32 are shown rotated to their casting-belt-magnetizing position (reach-out-casting-belt-attracting position). Alternate upstream-downstream extending rows of magnets 32 in array 51 are assembled in their magnet-rotating devices 145A within their respective pole members 39A so as to have the same polarity orientation, for example, with North (N') on top; while the intervening rows of rotatable magnets 32 are assembled in their magnet-rotating devices 145A within their respective pole members 39A so as to have the opposite polarity orientation with South (S') on top. With these magnets in their position as shown applying reach-out attraction onto revolving belt 52, then pole faces 34 of elongated pole members 39A in successive hydro-magnetic devices 38A spaced transversely across hydro-magnetic pillow array 51 have alternate North (N) and South (S) polarities facing toward the revolving casting belt 52.

The "lines" of magnetic flux 30 bridge (pass through) the air gaps 129 near pulley fins 128 and bridge (pass through) the pulley fins 128 themselves, which are non-magnetic. A modest amount of leakage flux 30' is unavoidable. However, sufficient desired reach-out flux 30 goes through the pole faces 34 and extends through casting belt 52 so that the belt is thereby reach-out strongly attracted toward this hydro-magnetic coplanar pillow array 51 of magnetic poles 34.

Pumped coolant 93 under pressure as previously described is supplied from headers (not shown) such as headers 100 in FIGS. 4 and 4A. This pumped coolant 93 feeds through supply tubes 98 and through diagonal passages 96 leading into upstream-directed intermediary tunnel passages 92A (FIGS. 16, 17 and 19) and thence into downstream-directed tunnel passages 92 (FIGS. 16–19). These passages 92 may be considered as being plenum passages feeding pressurized coolant into fixedly throttling passageways 90. Issuing from passageways 90 coolant flow 97 of throttle-reduced pressure enters pressure pockets 102 whence fast-moving coolant films 114 (FIGS. 17 and 18) rush out from pockets 102 and pass through narrow gaps 75 between pole faces 34 and the belt 52. Thus, a balance is achieved between magnetic and hydrodynamic forces resulting in stabilized hovering of the moving ferrous casting belt 52 in close proximity to the coplanar array (even array) 51 of pole faces 34 as previously described for other embodiments of the invention.

It is noted that the tunnel passages 92 in FIGS. 4 and 4A have a portion which is upstream-directed and a portion which is downstream-directed, but their longer portions are upstream-directed. In contrast, as shown in FIG. 16, it is intermediary tunnel passages 92A which direct coolant flow 93 upstream to a significant distance beyond nip region line 110. Then, these intermediary passages 92A communicate with tunnel passages 92 at a location sufficiently far upstream from line 110 such that pumped coolant 93 flows downstream along the whole effective length of tunnel passages 92. Ends of passages 92A and 92 are closed by plugs 94.

Sweep nozzles 112 (only one is seen in FIG. 16) located near the leading ends 118 of the pole faces 34 and trailing end sweep nozzles 120 (only one is seen in FIG. 16) ("afterburner" nozzles) located at the downstream end 120 of the hydro-magnetic pillow array 51 provide downstream sweeping coolant flows 115 and 135, respectively, aimed at acute angles toward the reverse surface of the casting belt 52 for forcefully deflecting downstream and propelling downstream the coolant film flows 114 (FIGS. 17 and 18) which have issued from the pressure pockets 102 and have passed through gaps 75 between pole faces 34 and the reverse surface of the belt.

It is noted that embodiments of the invention shown in FIGS. 2 through 6 and FIGS. 11 through 14, have magnets 32 positioned between the elongated pole members 39, Moreover, for applying reach-out attraction onto the belts the internal North (N')–South (S') magnetic flux path of each of the fixed-position magnets in FIGS. 2 through 6 and in FIGS. 13 and 14 is oriented parallel with the plane of the casting belts and perpendicular to the side surfaces of these pole members 39. The magnetic-rotating device 145 in FIGS. 11 and 12 also is positioned between the pole members 39. In FIG. 11 this magnet-rotating device 145 is shown turned to its "OFF" position wherein the internal North (N')–South (S') magnetic flux path of its magnets 32 and also of rotor 147 is oriented perpendicular to the plane of the casting belts and parallel with the side surfaces of the pole members 39. When the control arm 162 of this rotatable device 145 is turned to the "ON" position 162' (FIG. 11), then the internal North (N')–South (S') magnetic flux path of magnets 32 and their rotor 147 becomes oriented parallel with the plane of the casting belt and perpendicular to the pole members 39.

In FIG. 11 there are bridging members 154 of magnetically soft ferromagnetic material which have elongated cylindrically concave surfaces 153 facing toward and closely spaced from the elongated cylindrical rotor 147 of magnet-rotating device 145 for carrying magnetic flux between the "ON"-positioned rotor and the two nearby pole members 39.

In the embodiment shown in FIGS. 16 through 19 modified magnet-rotating devices 145A (only one is shown) are positioned within their respective modified elongated pole members 39A. For emphasis it is repeated: each modified magnet-rotating device 145A (FIGS. 16–19) is positioned within each modified pole member 39A in contradistinction to magnet-rotating devices 145 (FIGS. 11 and 12) which are positioned between two successive pole members 39.

In order to accommodate this magnet-rotating device 145A within each modified elongated pole member 39A, each such pole member is made in first and second parts 39A-1 and 39A-2 each of which has an elongated cylindrically concave surface 153 (FIGS. 17 and 18) facing toward and closely spaced from the elongated cylindrical rotor 147 of the magnet-rotating device 145A.

The first pole member part 39A-1 is proximate to the casting belt 52 or 50 and is configured to include a tunnel passage 92, throttling passageways 90, pressure pockets 102, magnetic pole faces 34, sweep nozzles 112 and 120, and includes other features as shown in FIGS. 16–19.

Figure 18:
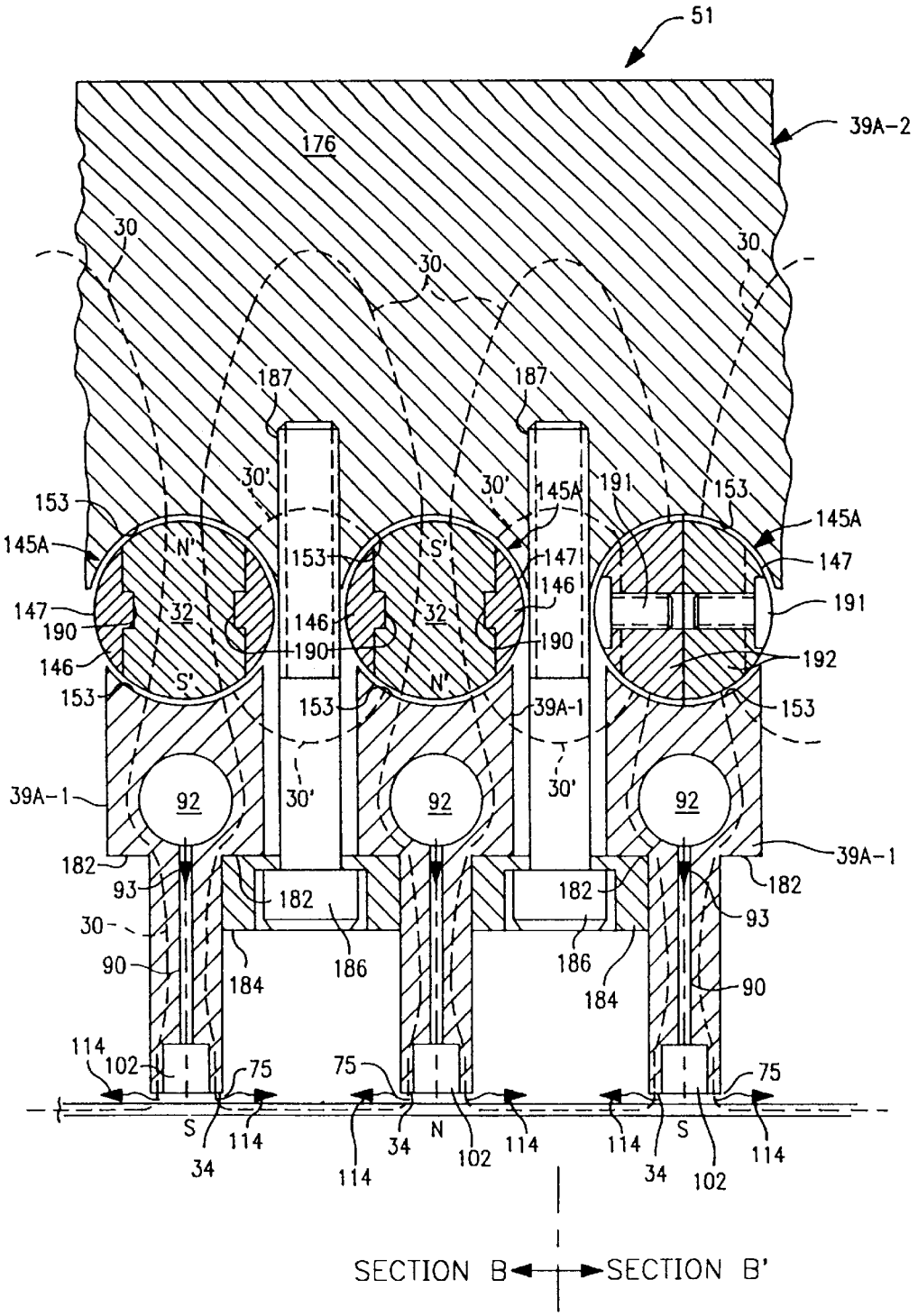
FIG. 18 is an enlarged partial sectional view similar to FIG. 17, but FIG. 18 is a view farther downstream, away from the nip pulley fins, with left and right portions of FIG. 18 being located along B—B and B'—B' respectively, in FIGS. 16 and 19.

The second pole member part 39A-2 is remote from the casting belt 52 or 50 and includes diagonal passage 96, intermediate passage 92A and includes other features as shown in FIGS. 16–19. This second part 39A-2 also includes a backbone portion 176 (FIG. 18) of the array 51. This backbone 176 is shown in FIG. 18 spanning transversely across and rigidly interconnecting a plurality of the second (remote) pole member parts 39A-2. This backbone 176 is shown including a plurality of elongated cylindrically curved surfaces 153 closely spaced with respective rotors 147 within the respective modified pole members 39A. The backbone 176 may be machined as may be desired so as to span transversely across and interconnect a large number of the remote pole member parts 39A-2. It may extend transversely across the full width of the belt, if desired, depending upon fabrication procedures. Alternatively, a plurality of narrower backbones 176 may be fabricated so as to be placed side-by-side for extending transversely across the full width of the belt.

In order to assemble and support the whole array 51 in the machine, a transverse beam 180 (FIGS. 16 and 19) is secured to the backbone 176 (or is secured to a plurality of narrower backbones 176 placed side-by-side).

As is shown in FIGS. 16 and 19 by a diagonal dashed line 178, the backbone 176 is slotted to provide clearance shown in FIG. 17 by gaps 129 for nip pulley fins 128. This slotting at 178 provides slots each having a width equal to two air gaps 129 (FIG. 17) plus the width of a fin 128 and thereby forms a plurality of upstream-extending remote pole member parts 39A-2 (FIGS. 16, 17 and 19). To provide clearance for the core of nip pulley 60, a surface of each remote pole part 39A-2 is diagonally machined at 180.

For securing the proximate pole member parts 39A-1 to the backbone 176 longitudinally extending shoulders 182 are provided on both sides of their members 39A-1. Longitudinally-extending non-magnetic clamp bars 184, for example of non-magnetic stainless steel, fitted against shoulders 182 of two neighboring proximate pole parts 39A-1 are attached to the backbone 176 by non-magnetic machine screws 186 threaded into sockets 187 in the backbone 176. The width of clamp bars 184 is suitable for accurately positioning the proximate pole parts 39A-1 in spaced parallel relationship. Also, the length of machine screws 186 are sized so their ends will abut the ends of sockets 187 when the cylindrically curved surfaces 153 of proximate pole parts 39A-1 are suitably closely spaced from the rotors 147 of respective magnet-rotating devices 145A.

Inviting attention again to FIG. 16, it is seen that a nose portion 39*n*-1 of proximate pole part 39A-1 projects up above the cylindrically curved surface 153 of this proximate pole part. This nose portion 39*n*-1 abuts up against the remote pole part 39A-2 at nose portion 39*n*-2 and contains a connection passage 92-1 providing communication between intermediate passage 92A and tunnel passage 92. Also, this nose portion 39*n*-1 helps to secure together the remote and proximate pole parts 39A-2 and 39A-1 by means of a machine screw 188 which is passed through a nose 39*n*-2 of remote pole part 39A-2 and is threaded into a socket 189 in the nose portion 39*n*-1.

The construction and actuation of the modified magnet-rotating devices 145A (only one is shown) will now be described. The magnets 32 are assembled in a plurality of strings 177 (FIGS. 16 and 19) in each rotor 147 of a magnet-rotating device 145A. For example, FIG. 16 shows a rotor having three magnet strings 177-1, 177-2 and 177-3. Two of the axially-aligned-magnet strings 177-2 and 177-3 comprise three magnets each. The rotor is shown having a third farthest upstream string 177-1 comprising four magnets. This latter string 177-1 extends upstream to the nip region line 110.

The magnets 32 are shown (FIGS. 17 and 18) shaped with a pair of parallel flat sides having a pair of parallel keyway grooves 190, one in each side. These keyways 190 extend in a direction longitudinally of the elongated cylindrical rotor 147, i.e., they extend parallel with the rotor's axis of rotation. The magnets in each string 177-1, 177-2 and 177-3 are captured between a pair of parallel non-magnetic elongated side fittings 146 forming a split case for the magnets. The inner surfaces of these side fittings 146 conform with sides of magnets in a string. Each fitting has an elongated rib (key) projecting radially inwardly therefrom and engaging in the aligned keyways 190 of the magnets in the string.

The peripheries of side fittings 146 and the peripheries of magnet poles N' and S' are shaped to form a circular cylindrical exterior surface for the rotor closely spaced from the concave cylindrical surfaces 153 of the proximate and remote pole parts 39A-1 and 39A-2.

As shown at the right in FIGS. 17 and 18, the ends of side fittings 146 are attached by machine screws 191 to respective halves of end fittings 192. As shown most clearly in FIG. 19, the end fittings of the intermediate string 177-2 have sockets 193 concentric with the axis of the rotor 147. Journals 194 project axially from end fittings of the upstream and downstream strings 177-1 and 177-3 and their ends fit into sockets 193 and are secured in these sockets by pins 195. These journals 194 are supported by and are rotatable within bushings 195 which are captured by housings 196.

An upstream end journal 194 on the upstream end fitting of the first string 177-1 is received in a bushing held by a housing 197 secured to the remote pole piece 39A-2 by a machine screw 198. A downstream end journal 194 projects axially through a bushing 196 held by a bracket 199 secured to the remote pole piece 39A-2 by a machine screw 198.

In order to permit removal and replacement of the ferrous casting belt 52, each magnet rotating device 145A is turned 90° around the axis of its rotor 147 from its "ON" position shown in FIGS. 16–19 to an "OFF" position wherein its magnet poles N' and S' face in a direction parallel with the belt, i.e., like-polarity poles N' and N' and like polarity poles S' and S' become turned toward each other, thereby greatly reducing attraction between the pole faces 34 and the belt 52. An actuator lever arm 162 (FIG. 16) is fastened to the axially projecting downstream end journal 194 of each magnet-rotating device 145A in the array 51. A common operating rod 201 is attached by a pivot connection 203 to the end of each actuator lever arm 162 in the whole array. Thus, all strings of magnets in the whole array 51 are simultaneously turnable to their "ON" or "OFF" positions by shifting the common operating rod 201.

Although specific presently preferred embodiments of the invention have been disclosed herein in detail, it is to be understood that these examples of the invention have been described for purposes of illustration. This disclosure is not intended to be construed as limiting the scope of the invention, since the described methods and apparatus may be changed in detail, or to equivalent permanent magnetic materials, by those skilled in the art of continuous casting, in order to adapt these apparatuses and methods for keeping flat with suitable evenness a revolving, endless, flexible, heat-conducting casting belt containing magnetically soft ferromagnetic material and operating in a continuous-casting machine during the continuous casting of metal, in order further to be useful in various particular belt-type continuous casting machines or various belt-type caster installation situations, without departing from the scope of the following claims.

We claim:

1. A method for stabilizing and cooling an endless, flexible, thin-gauge, heat-conducting casting belt containing magnetically soft ferromagnetic material which travels along a mold space wherein molten metal is cast, the casting belt having a front surface facing toward the mold space and having a reverse surface facing away from the mold space, said method comprising the steps of:

applying to the casting belt reach-out magnetic attraction from an array of magnetically soft ferromagnetic pole members having pole faces arranged in a coplanar array facing toward the reverse surface of the casting belt by magnetizing said pole members by positioning in magnetic association with said pole members permanent magnets capable of providing sufficient reach-out magnetic attraction to the casting belt for suitably stabilizing the casting belt; and simultaneously applying to the reverse surface of the casting belt a multiplicity of flows of pumped liquid coolant issuing adjacent to the pole faces, said flows levitating the casting belt spaced by gaps from the pole faces and said flows travelling through the gaps between the reverse surface of the casting belt and the pole faces.

2. A method claimed in claim 1, including:

fixedly throttling said multiplicity of flows of pumped liquid coolant prior to applying them to the reverse surface of the casting belt.

3. A method claimed in claim 1, including:

directing a substantially unidirectional flow of liquid coolant along the reverse surface of the casting belt through spaces between the pole members, for sweeping away from the reverse surface coolant which has travelled through said gaps.

4. A method claimed in claim 1, including:

magnetizing said pole members using permanent magnets providing pole faces having alternate North and South polarity in said coplanar array.

5. A method claimed in claim 4, including:

issuing pumped liquid coolant into pressure pockets rimmed by the pole faces, and individually fixedly throttling pumped liquid coolant prior to issuing into each pressure pocket.

6. A method claimed in claim 1, including:

issuing pumped liquid coolant into pressure pockets facing the reverse surface of the casting belt adjacent to the pole faces, and throttling the pumped liquid coolant prior to issuing the pumped liquid coolant into the pressure pockets.

7. A method claimed in claim 1, including:

supplying pumped liquid coolant suitably pressurized prior to fixedly throttling said multiplicity of flows for levitating the casting belt spaced by gaps from the pole faces.

8. A method claimed in claim 1, wherein:

at least one magnet has a midpoint differential demagnetizing permeability not exceeding about 4 ΔGauss per ΔOersted.

9. A method claimed in claim 8, wherein:

at least one magnet has a residual induction equal to at least about 8,000 Gauss.

10. A method claimed in claim 1, wherein:

at least one magnet has a midpoint differential demagnetizing permeability not exceeding about 2.5 ΔGauss per ΔOersted.

11. A method claimed in claim 10, wherein:

at least one magnet has a residual induction equal to at least about 10,000 Gauss.

12. A method claimed in claim 1, wherein:

at least one magnet has a residual induction equal to at least about 10,000 Gauss and has a midpoint demagnetizing permeability not exceeding about 1.2 ΔGauss per ΔOersted.

13. A method claimed in claim 1, including:

enabling convenient removal of the casting belt from the mold space by diverting sufficient magnetic flux away from the casting belt.

14. A method claimed in claim 1, including:

supplying pumped liquid coolant under pressure for forming said flows of pumped liquid coolant prior to feeding molten metal into said mold space;

stopping the feeding of molten metal prior to stopping supplying of pumped liquid coolant prior to removing the casting belt from the mold space; and automatically selectively diverting magnetic flux to the casting belt and away from the casting belt by employing pressure of pumped liquid coolant for diverting magnetic flux to the casting belt and employing absence of said pressure for diverting magnetic flux away from the casting belt for enabling convenient removal of the casting belt from the mold space.

15. A method for stabilizing and cooling an endless, flexible, thin-gauge, heat-conducting casting belt containing magnetically soft ferromagnetic material which travels along a mold space wherein molten metal is cast, the casting belt having a front surface facing toward the mold space and having a reverse surface facing away from the mold space, said method comprising the steps of:

positioning the reverse surface of the casting belt near an array of magnetically soft ferromagnetic pole members having pole faces arranged in a coplanar array facing toward the reverse surface of the casting belt;

magnetizing said pole members by positioning permanent magnets in magnetic associated with pair of said pole members for providing pole faces having alternate North and South polarity in said coplanar array providing sufficient reach-out magnetic attraction from the pole members for stabilizing the casting belt in even condition, while simultaneously supporting the belt spaced away from the pole faces by pumping liquid coolant flows into pressure pockets rimmed by the pole faces for applying the coolant flows to the reverse surface of the casting belt, with coolant escaping from the pressure pockets by travelling through gaps between the reverse surface of the casting belt and the pole faces.

16. A method for stabilizing and cooling an endless, flexible, thin-gauge, heat-conducting casting belt containing magnetically soft ferromagnetic material travelling along a mold space wherein molten metal is cast, the casting belt having a front surface facing toward the mold space and having a reverse surface facing away from the mold space, said method comprising the steps of:

pulling the moving belt by reach-out magnetic attraction toward a coplanar array of pole faces facing toward the reverse surface of the moving belt and having alternate North and South magnetic polarity on pole members of magnetically soft ferromagnetic material magnetized by positioning in magnetic association with the pole members permanent magnets capable of providing sufficient reach-out magnetic attraction for stabilizing the belt in even condition; and simultaneously levitating the belt spaced away from the pole faces hovering upon throttled pumped liquid coolant issuing from nozzles adjacent to the pole faces and travelling through gaps between the reverse surface of the levitated moving belt and the pole faces.

17. A method claimed in claim 16, including:

issuing throttled pumped liquid coolant through a plurality of nozzles in each pole member facing toward the reverse surface of the belt.

18. A method claimed in claim 17, including:

providing elongated pole members each having an elongated pole face, positioning the elongated pole members in spaced parallel relation defining elongated spaces between neighboring pole members spaced to a pitch in a range from about ¾ of an inch to about 2 inches.

19. A method claimed in claim 18, including:

issuing individually throttled pumped liquid coolant through respective individual nozzles spaced longitudinally along each pole member, wherein each nozzle is rimmed by a portion of an elongated pole face.

20. A method for stabilizing and cooling an endless, flexible, thin-gauge, heat-conducting casting belt containing magnetically soft ferromagnetic material which travels along a mold space wherein molten metal is cast, the casting belt having a front surface facing toward the mold space and having a reverse surface facing away from the mold space, said method comprising the steps of:

providing a multiplicity of elongated magnetically soft ferromagnetic pole members each having an elongated pole face;

positioning the pole members in spaced parallel relationship defining elongated spaces between neighboring pole members with their elongated pole faces arranged in a coplanar array;

providing a multiplicity of reach-out permanent magnets each having North and South magnetic poles;

magnetizing the pole members by the magnets arranged with their respective North and South magnetic ploes in magnetic association with alternate pole members for providing alternate North and South polarity of successive pole faces in the array;

applying to the casting belt reach-out magnetic attraction from said coplanar array of pole faces of magnetized pole members facing toward the reverse surface of the casting belt; and levitating the casting belt spaced away from the pole faces by applying to the reverse surface of the casting belt a multiplicity of flows of throttled pumped liquid coolant issuing adjacent to the pole faces and travelling through gaps between the reverse surface of the casting belt and the pole faces.

21. A method claimed in claim 20, including:

positioning the elongated pole members in spaced parallel relationship defining elongated spaces between neighboring pole members wherein said pole members are spaced to a pitch in a range from about ¾ths of an inch to about 2 inches.

22. A method claimed in claim 21, including:

applying liquid coolant sweeping along the reverse surface of the belt in the elongated spaces between neighboring pole members.

23. A method claimed in claim 21, including:

interposing at least one of the permanent magnets in each of said elongated spaces between successive spaced parallel elongated pole members; and arranging said permanent magnets in said elongated spaces with pairs of same polarity permanent magnet poles facing toward opposite sides of each pole member.

24. A method claimed in claim 23, including:

positioning a plurality of North (N') and South (S') pole surfaces of reach-out permanent magnets adjacent to sides of neighboring pole members.

25. A method claimed in claim 23, including:

interposing a plurality of reach-out permanent magnets aligned along each elongated space; and arranging their polarities in the same direction in each elongated space.

26. A method claimed in claim 20, wherein:

said reach-out permanent magnets have a residual induction equal to at least about 8,000 Gauss and also have a midpoint differential demagnetizing permeability not exceeding about 4 ΔGauss per ΔOersted.

27. A method claimed in claim 26, including:

diverting magnetic flux away from the casting belt for enabling convenient removal of the belt from the mold space.

28. A method for stabilizing and cooling an endless, flexible, thin-gauge, heat-conducting casting belt containing magnetically soft ferromagnetic material which travels along a mold space wherein molten metal is cast, the casting belt having a front surface facing toward the mold space and having a reverse surface facing away from the mold space, said method comprising the steps of:

providing a multiplicity of reach-out magnetic circuits;

each magnetic circuit including a portion thereof lying within the casting belt and extending along a path within the casting belt located between the front and reverse surfaces of the casting belt and extending generally parallel with the front and reverse surfaces;

each magnetic circuit also including a portion thereof extending in a generally U-shaped pattern with legs of the U-shaped pattern extending toward the reverse surface of the casting belt toward opposite ends of said path;

applying flows of pumped liquid coolant to the reverse surface of the casting belt in regions where legs of the U-shaped pattern extend toward the reverse surface of the casting belt for cooling the belt and for levitating the belt by hydrodynamic forces of the flows of pumped liquid coolant which increase lengths of said legs of the U-shaped pattern; and diminishing magnetic flux in said reach-out magnetic circuits for enabling convenient removal of the casting belt from the mold cavity.

29. A method claimed in claim 28, in which:

said magnetic circuit paths extend transversely with respect to travel direction of the casting belt; and adjacent legs of neighboring U-shaped patterns have the same magnetic polarity providing leg pairs of North magnetic polarity alternating with leg pairs of South magnetic polarity in a direction extending transversely with respect to travel direction of the casting belt.

30. A method claimed in claim 28, wherein a nip pulley roll is positioned in a nip region at an upstream end of the mold space, said nip pulley roll being formed of non-magnetic material and having multiple circumferential fins of non-magnetic material uniformly axially spaced along the nip pulley roll and all having the same outside diameter, and said casting belt in approaching the mold space travels partially around the nip pulley roll in contact with said fins and then tangentially separates from the fins at the nip region and proceeds downstream in a generally planar configuration along the mold cavity, said method including:

directing said reach-out magnetic circuits through the nonmagnetic circumferential fins of the nonmagnetic nip pulley roll as well as through minimal air gaps located on either side of each fin.

31. A method claimed in claim 30, in which:

each of said reach-out magnetic circuits is magnetically energized by a plurality of reach-out permanent magnets arranged in alignment in a string of magnets interposed between successive neighboring fins and located between the casting belt and the nip pulley roll.

32. A method claimed in claim 31, in which:

the strings of reach-out magnets are rotatable about axes extending parallel with each other and generally parallel with the planar casting belt;

in applying reach-out attraction forces to the casting belt downstream from the nip region the strings of reach-out magnets are rotated to orient their internal North (N')-South (S') flux paths generally perpendicular to the generally planar casting belt with alternate successive strings across the width of the casting belt having alternate North (N') and South (S') polarities facing toward the casting belt; and diminishing magnetic flux in said reach-out magnetic circuits for enabling convenient removal of the casting belt from the casting cavity comprises a step of:

simultaneously rotating the strings of magnets to orient their internal North (N')-South (S') flux paths generally parallel with the generally planar casting belt, with the North (N') polarity of each string being directed toward the North (N') polarity of a neighboring string and with the South (S') polarity of each string being directed toward the South (S') polarity of a neighboring string.

33. Apparatus for stabilizing and cooling an endless, flexible, thin-gauge, heat-conducting casting belt containing magnetically soft ferromagnetic material which travels along a mold space wherein molten metal is cast, the casting belt having a front surface facing toward the mold space and having a reverse surface facing away from the mold space, said apparatus comprising:

a multiplicity of hydro-magnetic devices;

each hydro-magnetic device including a pole member of magnetically soft ferromagnetic material having a pole face;

said pole faces being positioned in a coplanar array faceable toward the reverse surface of the casting belt;

each hydro-magnetic device including at least one pressure pocket faceable toward the reverse surface of the casting belt adjacent to the pole face and including a passageway for feeding pumped liquid coolant into the pressure pocket;

a plurality of permanent magnets, at least one of said magnets being in magnetic association with each of said pole members for magnetizing said pole members with their pole faces having alternate North and South polarity in said array; and said magnets providing sufficient reach-out magnetic pull on the casting belt toward the pole faces for suitably stabilizing the casting belt in even condition while hovering upon pumped liquid coolant issuing from the pressure pockets and available for travelling through gaps between the reverse surface of the casting belt and the pole faces.

34. Apparatus claimed in claim 33, in which:

a plurality of coolant sweep nozzles direct a substantially unidirectional flow of liquid coolant for sweeping along the reverse surface of a casting belt with sufficient momentum for clearing away from the reverse surface of the casting belt coolant which has travelled through gaps between the reverse surface of the casting belt and the pole faces.

35. Apparatus claimed in claim 34, in which:

each hydro-magnetic device includes a plurality of pressure pockets faceable toward the reverse surface of a casting belt, said pressure pockets are adjacent to a pole face, and said hydro-magnetic device includes a plurality of said passageways throttling flows of pumped liquid coolant feeding into respective individual pressure pockets.

36. Apparatus claimed in claim 33, in which:

the pole members are elongated and are positioned in spaced parallel relationship forming a coplanar array of spaced parallel elongated pole faces;

each pole member includes a plurality of pressure pockets located at spaced positions along the elongated pole member with each pressure pocket being rimmed by a respective portion of the pole face of the pole member in which the pressure pocket is located.

37. Apparatus claimed in claim 36, in which:

said coolant sweep nozzles direct said substantially unidirectional flow of liquid coolant through elongated spaces between elongated pole members.

38. Apparatus claimed in claim 33, including:

magnetic flux diversion apparatus movable between "on" and "off" positions;

the "on" position allowing occurrence of said sufficient reach-out magnetic pull toward the pole faces; and the "off" position reducing magnetic pull toward the pole faces for enabling convenient removal of the casting belt away from the mold space.

39. Apparatus claimed in claim 38, including:

pressure-responsive mechanism responsive to existence of pressure of pumped liquid coolant for moving said flux diversion apparatus to "on" position and responsive to absence of pressure of pumped liquid coolant for moving said flux diversion apparatus to "off" position.

40. Apparatus for stabilizing and cooling an endless, flexible, thin-gauge, heat-conducting casting belt containing magnetically soft ferromagnetic material which travels along a mold space wherein molten metal is cast, the casting belt having a front surface facing toward the mold space and having a reverse surface facing away from the mold space, said apparatus comprising:

spaced, parallel, elongated, magnetically soft ferromagnetic pole members;

each pole member having an elongated pole face extending longitudinally along the pole member;

said pole faces of said pole members being arranged in a coplanar array of pole faces facing the reverse surface of the casting belt;

each pole member having a plurality of nozzles in its elongated pole face;

said nozzles being located at spaced positions along the pole face;

each pole member having a supply passage therein for feeding coolant to said nozzles; and a multiplicity of reach-out permanent magnets positioned with their respective North and South magnetic poles in magnetic association with alternate pole members for magnetizing said pole members forming an array of pole faces of alternate North and South magnetic polarity pulling the casting belt toward the pole faces by reach-out magnetic attraction.

41. Apparatus claimed in claim 40 and wherein the casting belt travels partially around a finned nip pulley roll at an entrance to the mold space, in which:

the finned nip pulley roll is non-magnetic and has non-magnetic fins; and elongated pole members have elongated slender nose portions projecting upstream relative to travel direction of the casting belt and fitting into grooves in the nip pulley roll between neighboring fins.

42. Apparatus claimed in claim 41, in which:

nose portions of elongated pole members project upstream beyond a nip region in the entrance to the mold space where the casting belt separates from contact with the fins.

43. Apparatus claimed in claim 41, in which:

each nose portion includes a sweep nozzle aimed downstream relative to travel direction of the casting belt, said sweep nozzles being aimed toward the reverse surface of the casting belt at an acute angle for directing a flow of coolant sweeping downstream along the reverse surface of the casting belt between the elongated pole members.

44. Apparatus claimed in claim 43, in which:

the sweep nozzles are positioned upstream beyond a nip region in the entrance to the mold space where the casting belt separates from contact with the fins.

45. Apparatus claimed in claim 41, in which:

said elongated pole members comprise:

first parts thereof proximate to the casting belt, and second parts thereof remote from the casting belt;

said first and second parts of the pole members fit into respective grooves in the nip pulley roll between neighboring fins;

each of said elongated pole members includes an elongated rotor positioned therein between said first and second parts of the pole member;

each elongated rotor extends longitudinally of the elongated pole member;

each elongated rotor has an axis of rotation extending longitudinally of the elongated pole member;

each elongated rotor includes at least one string of permanent magnets and having their internal North (N')-South (S') flux paths oriented in the same direction; and all of said internal flux paths are oriented perpendicular to the axis of rotation of the rotor.

46. Apparatus claimed in claim 45, in which:

said first and second parts of each pole member have circular cylindrical surfaces facing toward and closely spaced from the elongated rotor in the pole member; and said circular cylindrical surfaces are concentric with the axis of rotation of the rotor.

47. Apparatus claimed in claim 46, in which:

a common actuator device is connected to each rotor for simultaneously rotating all rotors between an "ON" reach-out attraction orientation wherein the internal North (N')-South (S') flux paths of the strings of magnets in alternate successive rotors in an array of pole members extending transversely across the casting belt have alternate polarities directed toward the casting belt and toward the first pole parts of successive pole members in the array for applying reach-out attraction forces from said first pole parts to the casting belt, and an "OFF" reduced-attraction orientation wherein there is greatly reduced attraction forces applied from said first pole parts to the casting belt and wherein the internal North (N')-South (S') flux paths of the strings of magnets in the rotors are oriented generally parallel with the casting belt.

48. Apparatus claimed in claim 45, in which:

each rotor includes a plurality of axially-aligned strings of reach-out permanent magnets; and at least one of said strings in each rotor is positioned sufficiently far downstream that it is located downstream from said fins.

49. Apparatus claimed in claim 45, in which:

the elongated pole members with their elongated rotors extend downstream from the nip region to downstream positions located downstream from said fins.

50. Apparatus claimed in claim 40, in which:

the reach-out permanent magnets have a residual induction equal to at least about 8,000 Gauss; and the reach-out permanent magnets have a midpoint differential demagnetizing permeability not exceeding about 4 ΔGauss per ΔOersted.

51. Apparatus claimed in claim 50, including:

magnetic flux diversion apparatus movable between "on" and "off" positions;

the "on" position allowing occurrence of sufficient reach-out magnetic attraction toward the pole faces for suitably stabilizing the casting belt against thermal distortion; and the "off" position reducing magnetic pull toward the pole faces for enabling convenient removal of the casting belt away from the mold space.

52. Apparatus claimed in claim 40, in which:

each nozzle includes a pressure pocket facing toward the reverse surface of the casting belt and being rimmed by an area of the pole face of the pole member in which the nozzle is located; and each nozzle includes a throttling passageway feeding coolant from the supply passage into the pressure pocket.

53. Apparatus claimed in claim 52, in which:

a throttling passageway feeding coolant from the supply passage into a downstream pressure pocket positioned nearest to a downstream end of each elongated pole members is larger in cross sectional area than cross sectional areas of other throttling passageways in the pole member feeding other pressure pockets in the pole member; and the downstream pressure pocket opens in a downstream direction forming a sweep nozzle aimed downstream for flowing coolant downstream along the reverse surface of the casting belt.

54. Apparatus claimed in claim 53, in which:

the downstream end of each pole member has a ledge surface facing toward the reverse surface of the casting belt and converging toward the reverse surface of the casting belt in a downstream direction; and the downstream pressure pocket opens in a downstream direction with side walls diverging in a downstream direction and straddling said ledge surface.

55. Apparatus claimed in claim 40, in which:

an end of each elongated pole member, said end being downstream relative to travel direction of the casting belt, includes a sweep nozzle aimed downstream toward the reverse surface of the casting belt for directing a flow of coolant sweeping downstream along the reverse surface of the casting belt.

56. Apparatus claimed in claim 40 and wherein the casting belt travels partially around a nip pulley roll rotatable around an axis and having a plurality of circular fins of the same diameter axially spaced along the pulley roll and projecting radially from the pulley roll defining grooves between neighboring fins, in which:

said pulley roll is non-magnetic;

said circular fins are formed of magnetically soft ferromagnetic material; and each elongated pole member has an elongated slender nose portion projecting upstream relative to travel direction of the casting belt and fitting into a groove between neighboring fins.

57. In a belt-type continuous casting machine employing at least one moving, endless, flexible, thin-gauge, heat-conducting casting belt containing magnetically soft ferromagnetic material travelling along a moving mold space wherein the casting belt has a front surface facing the mold space wherein molten metal is cast and a reverse surface for cooling the casting belt, apparatus for stabilizing and cooling the moving belt comprising:

an array of spaced, parallel hydro-pillow devices;

each of said hydro-pillow devices including an elongated member having an elongated face extending along the member;

said elongated faces of said members being in a spaced, parallel coplanar array of elongated faces facing the reverse surface of the casting belt;

each elongated member having a plurality of nozzles in its elongated face;

said nozzles being located at spaced positions along the elongated face;

each elongated member having a supply passage extending along said member therein for feeding coolant to said nozzles;

each nozzle including an outlet facing toward the reverse surface of the casting belt and being rimmed by an area of the face; and each member including throttling passageways feeding coolant from the supply passage to the outlets.

58. Apparatus claimed in claim 57, in which:

said hydro-pillow devices are magnetic hydro-pillow devices;

said elongated members are formed of magnetically soft ferromagnetic material;

said elongated faces are elongated pole faces;

a multiplicity of reach-out permanent magnets positioned with their respective North and South magnetic poles in magnetic association with alternate elongated members in the array magnetize said elongated members forming an array of elongated pole faces of alternate North and South magnetic polarity pulling the casting belt toward the elongated pole faces by reach-out magnetic attraction;

the reach-out permanent magnets have a residual induction equal to at least about 8,000 Gauss; and the reach-out permanent magnets have a midpoint differential demagnetizing permeability not exceeding about 4 ΔGauss per ΔOersted.

59. Apparatus claimed in claim 58, in which:

at least one reach-out permanent magnet is interposed in an elongated space between neighboring elongated members;

the magnets are oriented with their respective North and South magnetic poles facing toward sides of the neighboring elongated members; and respective elongated members have same polarity magnetic poles facing toward opposite sides of the elongated member magnetizing the elongated members for providing the array of elongated pole faces having alternate North and South magnetic polarity.

60. Apparatus claimed in claim 58, including additionally:

an array of spaced, parallel, hydro-pillow devices;

each of said hydro-pillow devices including an elongated member having an elongated pillow face extending longitudinally along the elongated member;

said elongated pillow faces being in a spaced, parallel, coplanar array of elongated pillow faces facing the reverse surface of the casting belt;

each elongated member having a plurality of nozzles in its elongated pillow face;

said nozzles being located at spaced positions along the elongated pillow face;

each elongated member having a supply passage therein for feeding coolant to said nozzles;

each nozzle including an outlet facing toward the reverse surface of the casting belt and being rimmed by an area of the pillow face;

said members including throttling passageways for feeding coolant from the supply passage to the outlets;

said throttling passageways in said hydro-pillow devices having a larger cross sectional area than throttling passageways in said magnetic hydro-pillow devices; and said array of hydro-pillow devices are positioned downstream from said array of magnetic hydro-pillow devices relative to travel direction of the moving casting belt.

61. Apparatus claimed in claim 60, in which:

said elongated members of said hydro-pillow devices extend downstream from the pole members of said magnetic hydro-pillow devices; and reach-out permanent magnets are included only in the magnetic hydro-pillow devices.

62. Apparatus claimed in claim 57, in which:

resilient mounting mechanism resiliently mounts said array of hydro-pillow devices with compliant movement in a direction toward and away from the mold space.

* * * * *